US010519393B2

(12) United States Patent
Waynick et al.

(10) Patent No.: US 10,519,393 B2
(45) **Date of Patent: *Dec. 31, 2019**

(54) COMPOSITION AND METHOD OF MANUFACTURING CALCIUM MAGNESIUM SULFONATE GREASES

(71) Applicant: NCH Corporation, Irving, TX (US)

(72) Inventors: J. Andrew Waynick, Lantana, TX (US); Joe L. Garza, Carrollton, TX (US)

(73) Assignee: NCH Corporation, Irving, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/145,368

(22) Filed: Sep. 28, 2018

(65) Prior Publication Data

US 2019/0185777 A1 Jun. 20, 2019

Related U.S. Application Data

(63) Continuation-in-part of application No. 15/593,792, filed on May 12, 2017, now Pat. No. 10,087,387, and a continuation-in-part of application No. 15/593,839, filed on May 12, 2017, now Pat. No. 10,087,388, and a continuation-in-part of application No. 15/593,912, filed on May 12, 2017, now Pat. No. 10,087,391.

(60) Provisional application No. 62/338,193, filed on May 18, 2016.

(51) Int. Cl.
*C10M 115/10* (2006.01)

(52) U.S. Cl.
CPC ..... *C10M 115/10* (2013.01); *C10M 2201/02* (2013.01); *C10M 2201/062* (2013.01); *C10M 2201/085* (2013.01); *C10M 2201/087* (2013.01); *C10M 2207/125* (2013.01); *C10M 2219/0466* (2013.01); *C10N 2210/01* (2013.01); *C10N 2210/02* (2013.01); *C10N 2230/02* (2013.01); *C10N 2230/08* (2013.01); *C10N 2250/10* (2013.01)

(58) Field of Classification Search
CPC ..... C10N 2270/00; C10N 2230/52; C10N 2230/06; C10N 2220/082; C10N 2220/022; C10N 2250/10; C10N 2210/02; C10N 2210/01; C10M 2219/046
USPC ..... 508/391
See application file for complete search history.

(56) References Cited

U.S. PATENT DOCUMENTS

| | | | |
|---|---|---|---|
| 2,270,577 | A | 1/1942 | Bergstrom |
| 2,402,325 | A | 6/1946 | Griesinger |
| 2,418,894 | A | 4/1947 | McNab |
| 2,444,970 | A | 7/1948 | Zimmer |
| 2,485,861 | A | 10/1949 | Campbell |
| 2,501,731 | A | 3/1950 | Mertes |
| 2,535,101 | A | 12/1950 | Sproule |
| 2,540,533 | A | 2/1951 | Kolfenbach |
| 2,585,520 | A | 2/1952 | Van Ess |
| 2,616,904 | A | 11/1952 | Asseff |
| 2,616,905 | A | 11/1952 | Asseff |
| 2,616,906 | A | 11/1952 | Asseff |
| 2,616,911 | A | 11/1952 | Asseff |
| 2,616,924 | A | 11/1952 | Asseff |
| 2,616,925 | A | 11/1952 | Asseff |
| 2,617,049 | A | 11/1952 | Asseff |
| 2,695,910 | A | 11/1954 | Asseff |
| 2,723,235 | A | 11/1955 | Asseff |
| 2,839,470 | A | 6/1958 | Warren |
| 2,861,951 | A | 11/1958 | Carlyle |
| 2,865,956 | A | 12/1958 | Ellis |
| 2,898,296 | A | 8/1959 | Pattenden et al. |
| 2,920,105 | A | 1/1960 | Kluge |
| 2,937,991 | A | 5/1960 | Carlyle |
| 2,940,930 | A | 6/1960 | Pattenden et al. |
| 2,956,018 | A | 10/1960 | Carlyle |
| 2,967,151 | A | 1/1961 | Morway |
| 2,977,301 | A | 3/1961 | Bergen |
| 2,978,410 | A | 4/1961 | Fullerton |
| 3,027,325 | A | 3/1962 | McMillen |
| 3,057,896 | A | 10/1962 | Schlight et al. |
| 3,150,088 | A | 9/1964 | Hunt et al. |
| 3,186,944 | A | 6/1965 | Dreher |
| 3,242,079 | A | 3/1966 | McMillen |
| 3,372,115 | A | 3/1968 | McMillen |
| 3,376,222 | A | 4/1968 | McMillen |
| 3,377,283 | A | 4/1968 | McMillen |
| 3,492,231 | A | 1/1970 | McMillen |
| 3,537,996 | A | 11/1970 | Hoist |

(Continued)

FOREIGN PATENT DOCUMENTS

| | | |
|---|---|---|
| CN | 101153239 | 4/2008 |
| CN | 101993767 | 3/2011 |

(Continued)

OTHER PUBLICATIONS

Kobylyanskli, E.V., Structure of Ultrabasic Sulfonate Greases:, Chem. and Tech. of Fuels and Oils, 2002, 38(2).

(Continued)

*Primary Examiner* — Vishal V Vasisth

(74) *Attorney, Agent, or Firm* — Ross Barnes LLP; Robin L. Barnes

(57) ABSTRACT

A sulfonate-based grease composition and method of manufacture comprising (1) addition of both overbased calcium sulfonate and overbased magnesium sulfonate in a ratio range of 60:40 to 100:1, with the magnesium sulfonate added all at once, a portion prior to conversion and another portion after conversion, and/or one more delay periods between the addition of water or other reactive ingredient and the addition of magnesium sulfonate; (2) one or more delay periods between the addition of at least a portion of a facilitating acid and at least a portion of the next subsequently added ingredient; (3) no conventional non-aqueous converting agents added prior to conversion; or (4) a combination thereof. The grease has a high dropping point and reduced thickener yield.

5 Claims, No Drawings

(56) References Cited

U.S. PATENT DOCUMENTS

| | | | | |
|---|---|---|---|---|
| 3,629,109 | A * | 12/1971 | Karn et al. | C07C 51/414 44/373 |
| 3,655,558 | A | 4/1972 | Geyer et al. | |
| 3,661,622 | A | 5/1972 | Rogers | |
| 3,671,012 | A | 6/1972 | Scott | |
| 3,679,584 | A | 7/1972 | Hellmuth | |
| 3,681,242 | A | 8/1972 | Gilani et al. | |
| 3,746,643 | A | 7/1973 | Rogers | |
| 3,791,973 | A | 2/1974 | Gilani et al. | |
| 3,816,310 | A | 6/1974 | Hunt | |
| 3,850,823 | A | 11/1974 | Kjonaas | |
| 3,907,691 | A | 9/1975 | King et al. | |
| 3,929,650 | A | 12/1975 | King et al. | |
| 3,940,339 | A | 2/1976 | Clarke, Jr. et al. | |
| 4,129,589 | A | 12/1978 | Eliades et al. | |
| 4,297,227 | A | 10/1981 | Witte et al. | |
| 4,376,060 | A | 3/1983 | Stadler | |
| 4,435,299 | A | 3/1984 | Carley et al. | |
| 4,444,669 | A | 4/1984 | Wittse, Jr. et al. | |
| 4,483,775 | A | 11/1984 | Yamaguchi | |
| 4,560,489 | A | 12/1985 | Muir | |
| 4,597,880 | A | 7/1986 | Eliades | |
| 4,728,578 | A | 3/1988 | Higgins et al. | |
| 4,744,920 | A | 5/1988 | Fischer et al. | |
| 4,780,224 | A | 10/1988 | Jao | |
| 4,787,992 | A | 11/1988 | Waynick | |
| 4,810,396 | A | 3/1989 | Jao et al. | |
| 4,810,398 | A | 3/1989 | Van Kruchten et al. | |
| 4,824,584 | A | 4/1989 | Muir | |
| 4,830,767 | A | 5/1989 | Waynick | |
| 4,902,435 | A | 2/1990 | Waynick | |
| 4,904,399 | A | 2/1990 | Waynick | |
| 4,929,371 | A | 5/1990 | Waynick | |
| 5,084,193 | A | 1/1992 | Waynick | |
| 5,126,062 | A | 6/1992 | Barnes | |
| 5,190,678 | A | 3/1993 | Swartz | |
| 5,308,514 | A | 5/1994 | Olson | |
| 5,338,467 | A | 8/1994 | Olson et al. | |
| 6,172,122 | B1 | 1/2001 | Lawate et al. | |
| 6,239,083 | B1 | 5/2001 | Muir | |
| 6,432,889 | B1 | 8/2002 | Kinoshita et al. | |
| 6,534,450 | B1 | 3/2003 | Harrison et al. | |
| 6,596,672 | B1 | 7/2003 | Carrick et al. | |
| 6,869,111 | B2 | 3/2005 | Goto et al. | |
| 6,875,731 | B1 * | 4/2005 | Bence | C10M 159/24 508/391 |
| 7,241,723 | B2 | 7/2007 | Zhang | |
| 7,294,608 | B2 | 11/2007 | Oldiges | |
| 7,517,837 | B2 | 4/2009 | Kurosky et al. | |
| 9,273,265 | B2 | 3/2016 | Waynick | |
| 9,458,406 | B2 | 10/2016 | Waynick | |
| 2003/0111838 | A1 | 6/2003 | Goto et al. | |
| 2004/0214732 | A1 | 10/2004 | Oldiges et al. | |
| 2004/0235679 | A1 | 11/2004 | Kurosky et al. | |
| 2005/0054541 | A1 | 3/2005 | Zhang et al. | |
| 2005/0215442 | A1 | 9/2005 | Sivik et al. | |
| 2006/0025317 | A1 | 2/2006 | Olson et al. | |
| 2006/0223719 | A1 | 10/2006 | Riff et al. | |
| 2007/0060485 | A1 | 3/2007 | Waynick | |
| 2009/0305920 | A1 | 12/2009 | Kato et al. | |
| 2011/0021391 | A1 | 1/2011 | E et al. | |
| 2011/0048809 | A1 | 3/2011 | Duckworth | |
| 2011/0092404 | A1 | 4/2011 | Zhang et al. | |
| 2011/0136709 | A1 | 6/2011 | Tanaka et al. | |
| 2011/0160105 | A1 | 6/2011 | Tanaka et al. | |
| 2011/0190177 | A1 | 8/2011 | Zaki | |
| 2011/0195880 | A1 | 8/2011 | Kawamura et al. | |
| 2011/0233473 | A1 | 9/2011 | Fletcher | |
| 2013/0109602 | A1 * | 5/2013 | Waynick | C10M 115/10 508/180 |
| 2014/0121139 | A1 * | 5/2014 | Waynick | C10M 169/04 508/162 |
| 2016/0115416 | A1 | 4/2016 | Waynick | |
| 2016/0230112 | A1 | 8/2016 | Waynick | |

FOREIGN PATENT DOCUMENTS

| | | |
|---|---|---|
| CN | 102051257 | 5/2011 |
| CN | 102634400 | 8/2012 |
| CN | 103952215 | 7/2014 |
| CN | 104024162 | 9/2014 |
| CN | 104327906 | 2/2015 |
| CN | 103740435 | 6/2015 |
| GB | 816318 | 7/1959 |
| GB | 1239860 | 7/1971 |
| JP | 2004346120 | 12/2004 |
| JP | 2007084620 | 4/2007 |
| JP | 2009286950 | 12/2009 |
| JP | 2009292918 | 12/2009 |
| JP | 2009298890 | 12/2009 |
| WO | WO2011098616 | 8/2011 |
| WO | WO2015071331 | 5/2015 |

OTHER PUBLICATIONS

Boner, C.J. Manufacture and Application of Lubricating Greases, 1954, p. 369, Hafner Publishing Company, Inc.

* cited by examiner

COMPOSITION AND METHOD OF MANUFACTURING CALCIUM MAGNESIUM SULFONATE GREASES

CROSS-REFERENCE TO RELATED APPLICATION

This application is a CIP of Ser. No. 15/593,792 filed May 12, 2017 now patent Ser. No. 10/087,387 which claims benefit of 62/338,193 filed May 18, 2016 and is also a CIP of Ser. No. 15/593,839 filed May 12, 2017 now patent Ser. No. 10/087,388 which claims benefit of 62/338,193 filed May 18, 2016 and is also a CIP of Ser. No. 15/593,912 filed May 12, 2017 now patent Ser. No. 10/087,391 which claims benefit of 62/338,193 filed May 18, 2016

BACKGROUND OF THE INVENTION

1. Field of the Invention

This invention relates to overbased calcium sulfonate greases and overbased calcium magnesium sulfonate greases made (a) by adding overbased magnesium sulfonate to any known composition or method of making an overbased calcium sulfonate grease, so that both overbased calcium sulfonate and overbased magnesium sulfonate are used as ingredients; (b) with one or more delay periods between the addition of a facilitating acid and the subsequent addition of one or more other ingredients; and/or (c) without any conventional non-aqueous converting agents, to obtain an excellent grease with a high dropping point and good thickener yield. This invention also relates to such greases made in combination with one or more of the following methods or ingredients: (1) a delayed addition of magnesium sulfonate relative to water or one or more other reactive ingredients; (2) a split addition of magnesium sulfonate; (3) the addition of calcium hydroxyapatite and/or added crystalline calcium carbonate as calcium-containing bases for reacting with complexing acids; (4) the addition of an alkali metal hydroxide; or (5) the delayed addition of conventional non-aqueous converting agents.

2. Description of Related Art

Overbased calcium sulfonate greases have been an established grease category for many years. One known process for making such greases is a two-step process involving the steps of "promotion" and "conversion." Typically the first step ("promotion") is to react a stoichiometric excess amount of calcium oxide (CaO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases.

Typically the second step ("conversion") is to add a converting agent or agents, to the product of the promotion step, along with a suitable base oil (such as mineral oil) if needed to keep the initial grease from being too hard, to convert the amorphous calcium carbonate contained in the overbased calcium sulfonate to a very finely divided dispersion of crystalline calcium carbonate (calcite). Prior art converting agents include water and conventional non-aqueous converting agents, such as propylene glycol, isopropyl alcohol, formic acid or acetic acid. When acetic acid or other acids are used as a converting agent, typically water and another conventional non-aqueous converting agent (a third converting agent, such as an alcohol) are also used; alternatively only water (without the third converting agent) is added, but the conversion then typically occurs in a pressurized vessel. Because an excess of calcium hydroxide or calcium oxide is used to achieve overbasing, a small amount of residual calcium oxide or calcium hydroxide may also be present as part of the oil soluble overbased calcium sulfonate and will be dispersed in the initial grease structure. The extremely finely divided calcium carbonate formed by conversion, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

In addition to simple calcium sulfonate greases, calcium sulfonate complex greases are also known in the prior art. These complex greases are typically produced by adding a strong calcium-containing base, such as calcium hydroxide or calcium oxide, to the simple calcium sulfonate grease produced by either the two-step or one-step process and reacting with up to stoichiometrically equivalent amounts of complexing acids, such as 12-hydroxystearic acid, boric acid, acetic acid (which may also be a converting agent when added pre-conversion), or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467.

Additionally, it is desirable to have a calcium sulfonate complex grease composition and method of manufacture that results in both improved thickener yield (by requiring a smaller percentage of overbased calcium sulfonate in the final grease) and dropping point. The term "thickener yield" as used herein refers to the concentration of the highly overbased oil-soluble calcium sulfonate required to provide a grease with a specific desired consistency as measured by the standard penetration tests ASTM D217 or D1403 commonly used in lubricating grease manufacturing. The term "dropping point" as used herein refers to the value obtained by using the standard dropping point test ASTM D2265 commonly used in lubricating grease manufacturing. Many of the known prior art compositions and methodologies require an amount of overbased calcium sulfonate of least 36% (by weight of the final grease product) to achieve a suitable grease in the NLGI No. 2 category with a demonstrated dropping point of at least 575 F. The overbased oil-soluble calcium sulfonate is one of the most expensive ingredients in making calcium sulfonate grease. Therefore it is desirable to reduce the amount of this ingredient while still maintaining a desirable level of firmness in the final grease (thereby improving thickener yield).

There are several known compositions and methods that result in improved thickener yield while maintaining a sufficiently high dropping point. For example, in order to achieve a substantial reduction in the amount of overbased calcium sulfonate used, many prior art references utilize a pressure reactor. It is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295), without requiring a pressure reactor. Higher dropping points are considered desirable since the dropping point is the first and most easily determined guide as to the high temperature utility limitations of a lubricating grease.

Overbased calcium sulfonate greases requiring less than 36% overbased calcium sulfonate are also achieved using the compositions and methods described in U.S. Pat. Nos. 9,273,265 and 9,458,406. The '265 and '406 patents teach the use of added crystalline calcium carbonate and/or added calcium hydroxyapatite (either with or without added calcium hydroxide or calcium oxide) as calcium-containing bases for reaction with complexing acids in making complex overbased calcium sulfonate greases. Prior to these patents, the known prior art always taught the use of calcium oxide or calcium hydroxide as the sources of basic calcium for production of calcium sulfonate greases or as a required component for reacting with complexing acids to form calcium sulfonate complex greases. The known prior art also taught that the addition of calcium hydroxide or calcium oxide needs to be in an amount sufficient (when added to the amount of calcium hydroxide or calcium oxide present in the overbased oil-soluble calcium sulfonate) to provide a total level of calcium hydroxide or calcium oxide sufficient to fully react with the complexing acids. The known prior art also generally taught that the presence of calcium carbonate (as a separate ingredient or as an "impurity" in the calcium hydroxide or calcium oxide, other than that presence of the amorphous calcium carbonate dispersed in the calcium sulfonate after carbonation), should be avoided for at least two reasons. The first being that calcium carbonate is generally considered to be a weak base, unsuitable for reacting with complexing acids to form optimum grease structures. The second being that the presence of unreacted solid calcium compounds (including calcium carbonate, calcium hydroxide or calcium oxide) interferes with the conversion process, resulting in inferior greases if the unreacted solids are not removed prior to conversion or before conversion is completed. However, as described in the '265 and '406 patents, Applicant has found that the addition of calcium carbonate as a separate ingredient (in addition to the amount of calcium carbonate contained in the overbased calcium sulfonate), calcium hydroxyapatite, or a combination thereof, either with or without added calcium hydroxide or calcium oxide, as ingredients for reacting with complexing acids produces a superior grease In addition to the '265 and '406 patents, there are a couple of prior art references that disclose the addition of crystalline calcium carbonate as a separate ingredient (in addition to the amount of calcium carbonate contained in the overbased calcium sulfonate), but those greases have poor thickener yield (as the prior art teaches) or require nano-sized particles of calcium carbonate. For example, U.S. Pat. No. 5,126,062 discloses the addition of 5-15% calcium carbonate as a separate ingredient in forming a complex grease, but also requires the addition of calcium hydroxide to react with complexing acids. The added calcium carbonate is not the sole added calcium containing base for reacting with complexing acids in the '062 patent. In fact, the added calcium carbonate is specifically not added as a basic reactant for reaction with complexing acids. Instead, added calcium hydroxide is required as the specific calcium-containing base for reaction with all the complexing acids. Additionally, the resulting NLGI No. 2 grease contains 36%-47.4% overbased calcium sulfonate, which is a substantial amount of this expensive ingredient. In another example, Chinese publication CN101993767, discloses the addition of nano-sized particles of calcium carbonate (sized between 5-300 nm) being added to the overbased calcium sulfonate, although the reference does not indicate that the nano-sized particles of calcium carbonate are added as a reactant, or the sole separately added calcium containing base, for reacting with complexing acids. The use of nano-sized particles would add to the thickening of the grease to keep it firm, much like the fine dispersion of crystalline calcium carbonate formed by converting the amorphous calcium carbonate contained within the overbased calcium sulfonate (which can be around 20 A to 5000 A or around 2 nm to 500 nm according to the '467 patent), but would also substantially increase the costs over larger sized particles of added calcium carbonate. This Chinese patent application greatly emphasizes the absolute necessity of the added calcium carbonate having a true nano particle size. As shown in the example greases according to the invention described in U.S. Pat. No. 9,273,265, superior greases may be formed by the addition of micron sized calcium carbonate without requiring the use of the very expensive nano-sized particles when using added calcium carbonate as one of or the sole added calcium containing base for reacting with complexing acids.

There are also prior art references for using tricalcium phosphate as an additive in lubricating greases. For instance, U.S. Pat. Nos. 4,787,992; 4,830,767; 4,902,435; 4,904,399; and 4,929,371 all teach using tricalcium phosphate as an additive for lubricating greases. However, it is believed that prior to the '406 patent, no prior art references taught the use of calcium hydroxyapatite, having the formula $Ca_5(PO_4)_3OH$ or a mathematically equivalent formula with a melting point of around 1100 C, as a calcium-containing base for reaction with acids to make lubricating greases, including calcium sulfonate-based greases. There are several prior art references assigned to Showa Shell Sekiyu in Japan, including U.S. Patent Application Publication No. 2009/0305920, that describe greases containing tricalcium phosphate, $Ca_3(PO_4)_2$, and reference a "hydroxyapatite" having the formula $[Ca_3(PO_4)_2]_3.Ca(OH)_2$ as a source of tricalcium phosphate. This reference to "hydroxyapatite" is disclosed as a mixture of tricalcium phosphate and calcium hydroxide, which is not the same as the calcium hydroxyapatite disclosed and claimed in the '406 patent and herein having the formula $Ca_5(PO_4)_3OH$ or a mathematically equivalent formula with a melting point of around 1100 C. Despite the misleading nomenclature, calcium hydroxyapatite, tricalcium phosphate, and calcium hydroxide are each distinct chemical compounds with different chemical formulae, structures, and melting points. When mixed together, the two distinct crystalline compounds tricalcium phosphate ($Ca_3(PO_4)_2$) and calcium hydroxide ($Ca(OH)_2$) will not react with each other or otherwise produce the different crystalline compound calcium hydroxyapatite ($Ca_5(PO_4)_3OH$). The melting point of tricalcium phosphate (having the formula $Ca_3(PO_4)_2$) is 1670 C. Calcium hydroxide does not have a melting point, but instead loses a water molecule to form calcium oxide at 580 C. The calcium oxide thus formed has a melting point of 2580 C. Calcium hydroxyapatite (having the formula $Ca_5(PO_4)_3OH$ or a mathematically equivalent formula) has a melting point of around 1100 C. Therefore, regardless of how inaccurate the nomenclature may be, calcium hydroxyapatite is not the same chemical compound as tricalcium phosphate, and it is not a simple blend of tricalcium phosphate and calcium hydroxide.

In making overbased calcium sulfonate greases, much of the known prior art using the two step method teaches the addition of all converting agents (water and conventional non-aqueous converting agents) at the same time and usually prior to heating. However, U.S. patent application Ser. No. 14/990,473 (now U.S. Pat. No. 9,976,101), which is incorporated herein by reference, discloses a method where there is a delay between the addition of water and the addition of at least part of a conventional non-aqueous converting agent that results in improved thickener yield and dropping point. Prior to the '473 application, a few prior art references disclose a time interval (although always poorly defined or not defined at all) between the addition of water and the addition of at least part of the conventional non-aqueous converting agent(s). For example, U.S. Pat. No. 4,560,489 discloses a process (examples 1-3) where base oil and overbased calcium carbonate are heated to around 150° F., then water is added, the mixture is then heated to around 190° F. before adding acetic acid and methyl Cellosolve (a highly toxic monomethylether of ethylene glycol). The resulting grease contains greater than 38% overbased calcium sulfonate and the '489 patent points out that the ideal amount of overbased calcium sulfonate for the processes disclosed therein is around 41-45%, since according to the '489 patent using less than 38% results in a soft grease. The resulting grease of example 1 in the '489 patent has a dropping point of around only 570° F. The '489 patent does not state the duration of delay between the addition of water and the addition of the conventional non-aqueous converting agents, but indicates that the addition was immediate after a period of heating from 150 F to just 190 F. The dropping point and thickener yield in the '489 patent are not desirable.

Additionally, U.S. Pat. Nos. 5,338,467 and 5,308,514 disclose the use of a fatty acid, such as 12-hydroxystearic acid, as a converting agent used along with acetic acid and methanol, where there is no delay for the addition of the fatty acid but some interval between the addition of water and the addition of acetic acid and methanol. Example B in the '514 patent and example 1 in the '467 patent both describe a process where water and the fatty acid converting agent are added to other ingredients (including the overbased calcium sulfonate and base oil), then heated to around 140-145° F. before adding acetic acid followed by methanol. The mixture is then heated to around 150-160° F. until conversion is complete. The amount of overbased calcium sulfonate in the final grease products in both examples is 32.2, which is higher than desirable. These patents do not state the duration of delay between the addition of water and fatty acid and the addition of the acetic acid and methanol, but indicates that the addition was immediate after an unspecified period of heating. Similar processes are disclosed in example A of the '467 patent and example C of the '514 patent except all of the fatty acid was added post conversion, so the only conventional non-aqueous converting agents used were the acetic acid and methanol added after the mixture with water was heated to 140-145 F. The amount of overbased calcium sulfonate in these examples is even higher than the previous examples at 40%. In addition to not achieving ideal thickener yield results, all these processes use methanol as a converting agent, which has environmental drawbacks. The use of volatile alcohols as converting agents may result in venting these ingredients to the atmosphere as a later part of the grease-making process, which is prohibited in many parts of the world. If not vented, the alcohols must be recovered by water scrubbing or water traps, which results in hazardous material disposal costs. As such, there is a need for a process that achieves better thickener yields, preferably without requiring the use of volatile alcohols as converting agents.

Better thickener yields are achieved in example 10 of the '514 patent, but the use of excess lime is taught as a requirement to achieve those results. In that example, water and excess lime are added together with other ingredients, the mixture is heated to 180-190 F while slowly adding acetic acid during the heating period. The resulting grease contained 23% overbased calcium sulfonate. While this thickener yield is better than others, there is still room for greater improvement without requiring the use of excess lime, which the '514 patent teaches as a requirement.

The other examples in '514 and '467 patents where there are thickener yields of 23% or less either involve the use of a pressurized kettle during conversion or are like the much greater part of the other prior art where there is no "delay" between the addition of water and the conventional non-aqueous converting agents or both. These examples involve adding water and a fatty acid converting agent, mixing for 10 minutes without heating, and then adding acetic acid, either in a pressurized kettle or without pressure. Neither of these patents recognizes any benefit or advantage to the 10 minute interval for adding acetic acid, or the other heating delays in the examples discussed above, rather these patents focus the use of a fatty acid as a converting agent and the benefits of adding the fatty acid pre-conversion, post-conversion, or both as the reason for any observed yield improvements. Additionally, as discussed below, this 10 minute mixing interval without any heating is not a "converting agent delay" as that term is used herein, but is considered to be the same as adding the ingredients at the same time, recognizing that adding each ingredient takes at least some time and cannot occur instantaneously.

The addition of alkali metal hydroxides in simple calcium soap greases, such as anhydrous calcium-soap thickened greases, is also known. But prior to the disclosure in U.S. application Ser. No. 15/130,422 (now U.S. Pat. No. 9,976,102), which is incorporated herein by reference, it was not known to add an alkali metal hydroxide in a calcium sulfonate grease to provide improved thickener yield and high dropping point, because that addition would be considered unnecessary by one of ordinary skill in the art. The reason for adding an alkali metal hydroxide, such as sodium hydroxide, in simple calcium soap greases is that the usually used calcium hydroxide has poor water solubility and is a weaker base than the highly water soluble sodium hydroxide. Because of this, the small amount of sodium hydroxide dissolved in the added water is said to react quickly with the soap forming fatty acid (usually 12-hydroxystearic acid or a mixture of 12-hydroxystearic acid and a non-hydroxylated fatty acid such as oleic acid) to form the sodium soap. This quick reaction is thought to "get the ball rolling." However, the direct reaction of calcium-containing bases such as calcium hydroxide with fatty acids has never been a problem when making calcium sulfonate complex greases. The reaction occurs very easily, likely due to the high detergency/dispersancy of the large amount of calcium sulfonate present. As such, it is not known in the prior art to use an alkali metal hydroxide in a calcium sulfonate grease as a way to get the complexing acids to react with the calcium hydroxide.

It has not previously been known to make an overbased calcium sulfonate grease by adding overbased magnesium sulfonate, as an ingredient with overbased calcium sulfonate, as a method of improving thickener yield while maintaining a sufficiently high dropping point. Similarly, it has not previously been known to make a sulfonate-based grease using a delay between the addition of a facilitating acid and the addition of other ingredients as a method of improving thickener yield while maintaining a sufficiently high dropping point. It has also not previously been known to make a calcium magnesium sulfonate grease without a conventional non-aqueous converting agent. It is also not known to combine various ingredients and methodologies in making a calcium sulfonate grease with improved thickener yield and high dropping, such as combining (a) the addition of an overbased magnesium sulfonate, (b) a facilitating acid delay period, and/or (c) omission of a conventional non-aqueous converting agent with one or more of: (1) a delayed addition of magnesium sulfonate relative to the addition of water or one or more other reactive ingredients; (2) a split addition of magnesium sulfonate; (3) the addition of calcium hydroxyapatite and/or added crystalline calcium carbonate or a combination thereof (without or without added calcium hydroxide or calcium oxide) as calcium containing bases (also referred to as basic calcium compounds) for reaction with complexing acids; (4) the addition of an alkali metal hydroxide; (5) the delayed addition of conventional non-aqueous converting agents; or (6) any combination of these methods and ingredients.

SUMMARY OF THE INVENTION

This invention relates to overbased calcium sulfonate greases and methods for manufacturing such greases using added overbased magnesium sulfonate to provide improvements in both thickener yield (requiring less overbased calcium sulfonate while maintaining acceptable penetration measurements) and expected high temperature utility as demonstrated by dropping point. As used herein, a calcium sulfonate grease (or overbased calcium sulfonate grease) containing overbased magnesium sulfonate is sometimes referred to as a calcium magnesium sulfonate grease or an overbased calcium magnesium sulfonate grease As used herein a "sulfonate-based grease" refers to a calcium sulfonate (or overbased calcium sulfonate) grease and/or a calcium magnesium sulfonate (or overbased calcium magnesium sulfonate) grease. According to one preferred embodiment, an overbased calcium magnesium sulfonate grease, either a complex grease or a simple grease, is made by adding overbased magnesium sulfonate to any known composition or method for making overbased calcium sulfonate greases, so that both overbased magnesium sulfonate and overbased calcium sulfonate are used as ingredients. The addition of overbased magnesium sulfonate works with prior art methods and ingredients for making simple or complex overbased calcium sulfonate greases. Any known overbased calcium sulfonate grease composition and method for making an overbased calcium sulfonate grease can be used according to the invention to make a sulfonate-based grease by adding overbased magnesium sulfonate to the original amount of overbased calcium sulfonate (and other ingredients) called for in the known composition or known method with overbased magnesium sulfonate. According to another preferred embodiment, an overbased calcium magnesium sulfonate grease, either a complex grease or a simple grease, is made by replacing some of the overbased calcium sulfonate in any known composition and method for making an overbased calcium sulfonate grease with overbased magnesium sulfonate, so that the original amount of overbased calcium sulfonate is reduced.

According to another preferred embodiment, a calcium magnesium sulfonate complex grease composition comprises between 10%-45% overbased calcium sulfonate and 0.1%-30% overbased magnesium sulfonate. More preferably, a calcium magnesium sulfonate complex grease composition according to an embodiment of the invention comprises between 10%-30% overbased calcium sulfonate and 1%-24% overbased magnesium sulfonate. Most preferably, a calcium magnesium sulfonate complex grease composition according to an embodiment of the invention comprises between 10%-22% overbased calcium sulfonate and 1%-15% overbased magnesium sulfonate.

According to another preferred embodiment, a calcium magnesium sulfonate grease comprises overbased calcium sulfonate and overbased magnesium sulfonate as ingredients in a ratio range of 99.9:0.1 to 60:40, more preferably in a ratio range of 99:1 to 70/30, and most preferably in a ratio range of 90:10 to 80:20. Other amounts of overbased magnesium sulfonate relative to the amount of overbased calcium sulfonate may also be used.

According to another preferred embodiment, improved thickener yield and sufficiently high dropping points are achieved when overbased magnesium sulfonate is added to otherwise conventional, prior art grease compositions and methods, even when the overbased calcium sulfonate is considered to be of "poor" quality as described and defined in the '406 patent.

According to another preferred embodiment, a sulfonate-based grease is made by adding overbased magnesium sulfonate wherein all of the overbased magnesium sulfonate is added at or near the beginning of the grease making process and prior to conversion. According to another preferred embodiment, there are one or more delay periods between the addition of one or more other ingredients and all or a portion of the overbased magnesium sulfonate. Similar to the delay periods described in the '473 application, these delay periods may be a temperature adjustment delay period or a holding delay period.

According to another preferred embodiment, a sulfonate-based grease is made by adding overbased magnesium sulfonate wherein a portion of the total amount of magnesium sulfonate is added prior to conversion, and most preferably prior to conversion beginning, and the remaining portion or another portion of the total amount of magnesium sulfonate is added after conversion. According to yet another preferred embodiment, the portion added prior to conversion is smaller in quantity than the portion added after conversion. Preferably, the portion added prior to conversion is around 0.1%-20% of the total overbased magnesium sulfonate, more preferably around 0.5%-15% of the total overbased magnesium sulfonate, and most preferably around 1.0%-10% of the total overbased magnesium sulfonate added. These embodiments are generally referred to herein as a "split addition" of magnesium sulfonate. According to yet another preferred embodiment, a split addition method may be combined with a magnesium sulfonate delay period method, such that there is a magnesium sulfonate delay period prior to the addition of the first portion of the magnesium sulfonate, or the second portion of the magnesium sulfonate, or both.

This invention also relates to sulfonate-based greases, specifically overbased calcium sulfonate greases and overbased calcium magnesium sulfonate greases, and methods for manufacturing such greases using a delay between the addition of at least a portion of a facilitating acid and at least a portion of one other subsequently added ingredient to provide improvements in both thickener yield (requiring less overbased calcium sulfonate while maintaining acceptable penetration measurements) and expected high temperature utility as demonstrated by dropping point. For ease of reference, a delay period/method with respect to the addition of a conventional non-aqueous converting agent as described in the '473 application will be referred to as a converting agent delay period or converting agent delay method (or similar wording); a delay with respect to the addition of overbased magnesium sulfonate will be referred to as a magnesium sulfonate delay period or magnesium sulfonate delay method (or similar wording); and a delay with respect to a facilitating acid will be referred to as a facilitating acid delay period or facilitating acid delay method (or similar wording).

According to one preferred embodiment, a facilitating acid delay period may be a facilitating acid temperature adjustment delay, where at least a portion of a facilitating acid is added to other ingredients to form a first mixture which is then heated or cooled prior to the addition of the next ingredient or portion of an ingredient. According to another preferred embodiment, a facilitating acid delay may be a facilitating acid holding delay where the first mixture is held at a temperature or within a range of temperatures for a period of time prior to the addition of the next ingredient or portion of an ingredient. According to another preferred embodiment, a sulfonate-based grease is made using at least one facilitating acid temperature adjustment delay and at least one facilitating acid holding delay. A delay between the addition of a facilitating acid and the next ingredient of 30 minutes or more is a facilitating acid delay, regardless of which ingredient is the next added ingredient. If the next added ingredient is reactive with the facilitating acid (such as magnesium sulfonate), then a facilitating acid delay period may be less than 30 minutes, such as around 20 minutes.

According to another preferred embodiment, improved thickener yield and sufficiently high dropping points are achieved when a facilitating acid delay is used with any known method for making a sulfonate-based grease and any known compositions, even when the overbased calcium sulfonate is considered to be of "poor" quality as described and defined in the '406 patent.

This invention also relates to calcium magnesium sulfonate greases and methods for manufacturing such greases without adding a conventional non-aqueous converting agent prior to conversion to provide improvements in both thickener yield (requiring less overbased calcium sulfonate while maintaining acceptable penetration measurements) and expected high temperature utility as demonstrated by dropping point. As used herein, "conventional non-aqueous converting agents" refers to converting agents (other than water) that solely function as converting agents (rather than dual role complexing acids-converting agents) and are added to the composition prior to conversion. Such conventional non-aqueous converting agents may contain some water as a diluent or an impurity. Examples of conventional non-aqueous converting agents include alcohols, ethers, glycols, glycol ethers, glycol polyethers, and other polyhydric alcohols and their derivatives that are added prior to conversion. Such ingredients may be added after conversion, if desired, within the scope of various embodiments of the invention since they would not be acting as converting agents after conversion is complete and would not be considered "conventional non-aqueous converting agents" in that case.

According to one preferred embodiment, a sulfonate-based grease is made by mixing overbased calcium sulfonate, overbased magnesium sulfonate, an optional base oil, and water as a converting agent, without the pre-conversion addition of any conventional non-aqueous converting agents (such a hexylene glycol). The magnesium sulfonate may be added all at once, using a split addition method, a magnesium sulfonate delay addition method, or a combination of a split addition and delayed addition method as further described herein. Without being bound by theory, it appears that the magnesium sulfonate acts as a converting agent. Since magnesium sulfonate has not previously been known to be used as a converting agent, it is sometimes referred to herein as a "non-conventional" converting agent.

According to another preferred embodiment, if a complex grease is desired, one or more complexing acids are also added, either before conversion, after conversion, or both. Some complexing acids are known to also act as converting agents when added prior to conversion. Dual role converting agent-complexing acids are not considered to be conventional non-aqueous converting agents herein and may be added prior to conversion according to various embodiments of the invention, provided that magnesium sulfonate is also added and no conventional non-aqueous converting agents are added.

According to another preferred embodiment, improved thickener yield and sufficiently high dropping points are achieved when conventional non-aqueous converting agents are omitted, even when the overbased calcium sulfonate is considered to be of "poor" quality as described and defined in the '406 patent.

According to other preferred embodiments, a sulfonate-based grease is made (a) by adding overbased magnesium sulfonate to any known composition or method for making an overbased calcium sulfonate grease or using any composition according to embodiments of the invention; (b) using one or more facilitating acid delay periods; (c) without adding any conventional non-aqueous converting agents prior to conversion; or (d) a combination thereof. According to still other preferred embodiments, a sulfonate-based grease is made using one or more of the foregoing in combination with one or more of the following methods or ingredients: (1) the addition of calcium hydroxyapatite and/or added calcium carbonate as calcium-containing bases for reacting with complexing acids, either with or without separately adding added calcium hydroxide and/or added calcium oxide as calcium containing bases; (2) the addition of an alkali metal hydroxide (most preferably lithium hydroxide); (3) the delayed addition of conventional non-aqueous converting agents (except for use with (c)); (4) a magnesium sulfonate delay period method; (5) a magnesium sulfonate split addition method. These additional methods and ingredients are disclosed in U.S. patent application Ser.

No. 13/664,768 (now U.S. Pat. No. 9,458,406), Ser. No. 13/664,574 (now U.S. Pat. No. 9,273,265), Ser. No. 14/990,473 (now U.S. Pat. No. 9,976,101), and Ser. No. 15/130,422 (now U.S. Pat. No. 9,976,102), which are incorporated herein by reference. Additionally, the disclosures of U.S. application Ser. Nos. 15/593,792, 15/593,839, and 15/593,912 are incorporated herein by reference.

DESCRIPTION OF THE PREFERRED EMBODIMENTS

Sulfonate-Based Grease Compositions

According to one preferred embodiment of the invention, a calcium magnesium sulfonate grease composition is provided comprising overbased calcium sulfonate and overbased magnesium sulfonate. According to another preferred embodiment, a calcium magnesium sulfonate simple or complex grease composition further comprises base oil, one or more added calcium containing bases, water, one or more conventional non-aqueous converting agents, and optionally a facilitating acid. According to another preferred embodiment, a calcium magnesium sulfonate complex grease composition further comprises one or more complexing acids.

According to another preferred embodiment of the invention, a simple or complex sulfonate-based grease composition, either an overbased calcium sulfonate grease or an overbased calcium magnesium sulfonate grease composition, is provided comprising overbased calcium sulfonate, overbased magnesium sulfonate (optional), one or more converting agents (preferably water and one or more conventional non-aqueous converting agents), and at least one facilitating acid. According to another preferred embodiment, a sulfonate-based simple or complex grease composition further comprises base oil, one or more added calcium containing bases, and one or more complexing acids (when a complex grease is desired).

According to another preferred embodiment of the invention, a calcium magnesium sulfonate grease composition is provided comprising overbased calcium sulfonate, overbased magnesium sulfonate, water as a converting agent, and no conventional non-aqueous converting agents are added as ingredients to the composition. In other words, water, magnesium sulfonate, and optionally any dual role complexing acid-converting agents are the only converting agent ingredients added to the composition. According to another preferred embodiment, a calcium magnesium sulfonate simple or complex grease composition further comprises base oil, one or more added calcium containing bases, and optionally a facilitating acid. According to another preferred embodiment, a calcium magnesium sulfonate complex grease composition further comprises one or more complexing acids.

According to several preferred embodiments, a calcium sulfonate grease composition or a calcium magnesium sulfonate grease composition comprises the following ingredients by weight percent of the final grease product (although some ingredients, such as water, acids, and calcium containing bases, may not be in the final grease product or may not be in the concentrations indicated for addition):

TABLE 1

| Ingredient | Preferred Amount (%) | More Preferred Amount (%) | Most Preferred Amount (%) |
|---|---|---|---|
| | Preferred Compositions | | |
| Overbased Calcium Sulfonate | 10%-45% | 10%-36% | 10%-22% |

TABLE 1-continued

| Ingredient | Preferred Amount (%) | More Preferred Amount (%) | Most Preferred Amount (%) |
|---|---|---|---|
| | Preferred Compositions | | |
| Overbased Magnesium Sulfonate (Optional) | 0.1%-30 | 1%-24% | 1%-15% |
| Added Base Oil | 30%-70% | 45%-70% | 50%-70% |
| Total Added Calcium Containing Bases (Optional for a Simple Grease) | 2.7%-41.2% | 4.15% to 31% | 6.18% to 20.8% |
| Water (as a Converting Agent) | 1.5%-10% | 2.0%-5.0% | 2.2%-4.5% |
| Non-Aqueous Converting Agent (Optional) | 0.1%-5% | 0.3%-4.0% | 0.5%-2.0% |
| Facilitating Acid (Optional Unless a Facilitating Acid Delay Method is Used) | 0.5%-5.0% | 1.0%-4.0% | 1.3%-3.6% |
| Alkali Metal Hydroxide (Optional) | 0.005% to 0.5% | 0.01% to 0.4% | 0.02% to 0.2% |
| Total Complexing Acids (if complex grease is desired) | 1.25%-18% | 2.2-12% | 3.55%-8.5% |

Some or all of any particular ingredient, including converting agents and added calcium containing bases, may not be in the final finished product due to evaporation, volatilization, or reaction with other ingredients during manufacture. These amounts are when a grease is made in an open vessel. Even smaller amounts of overbased calcium sulfonate may be used when a calcium magnesium sulfonate grease is made in a pressure vessel.

According to another preferred embodiment, a calcium magnesium sulfonate grease comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20. According to another preferred embodiment, a pre-conversion sulfonate-based grease composition comprises the following ingredients: overbased calcium sulfonate, overbased magnesium sulfonate, water, and optional base oil, and wherein water is the sole conventional converting agent in the pre-conversion composition. According to another preferred embodiment, a a pre-conversion sulfonate-based grease composition comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20.

The highly overbased oil-soluble calcium sulfonate (also referred to herein as simply "calcium sulfonate" or "overbased calcium sulfonate" for brevity) used according to these embodiments of the invention can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400 or higher. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The overbased calcium sulfonate contains around 28% to 40% dispersed amorphous calcium carbonate by weight of the overbased calcium sulfonate, which is converted to crystalline calcium carbonate during the process of making the calcium sulfonate grease. The overbased calcium sulfonate also contains around 0% to 8% residual calcium oxide or calcium hydroxide by weight of the overbased calcium sulfonate. Most commercial overbased calcium sulfonates will also contain around 40% base oil as a diluent, to keep the overbased calcium sulfonate from being so thick that it is difficult to handle and process. The amount of base oil in the overbased calcium sulfonate may make it unnecessary to add additional base oil (as a separate ingredient) prior to conversion to achieve an acceptable grease.

The overbased calcium sulfonate used may be of a "good" quality or a "poor" quality as in the '406 patent and defined herein. Certain overbased oil-soluble calcium sulfonates marketed and sold for the manufacture of calcium sulfonate-based greases can provide products with unacceptably low dropping points when prior art calcium sulfonate technologies are used. Such overbased oil-soluble calcium sulfonates are referred to as "poor quality" overbased oil-soluble calcium sulfonates throughout this application. When all ingredients and methods are the same except for the commercially available batch of overbased calcium sulfonate used, overbased oil-soluble calcium sulfonates producing greases having higher dropping points (above 575 F) are considered to be "good" quality calcium sulfonates for purposes of this invention and those producing greases having lower dropping points are considered to be "poor" quality for purposes of this invention. Several examples of this are provided in the '406 patent, which is incorporated by reference. Although comparative chemical analyses of good quality and poor quality overbased oil-soluble calcium sulfonates has been performed, it is believed that the precise reason for this low dropping point problem has not been proven. While many commercially available overbased calcium sulfonates are considered to be good quality, it is desirable to achieve both improved thickener yield and higher dropping points regardless of whether a good quality or a poor quality calcium sulfonate is used. It has been found that both improved thickener yield and higher dropping point may be achieved with either a good quality or a poor quality calcium sulfonate when an alkali metal hydroxide is used, particularly in combination with the delayed converting agent addition, split magnesium sulfonate addition, and delayed magnesium sulfonate addition methods according to the invention.

Any petroleum-based naphthenic or paraffinic mineral oils commonly used and well known in the grease making art may be used as the base oil according to the invention. Base oil is added as needed, since most commercial overbased calcium sulfonates will already contain about 40% base oil as a diluent so as to prevent the overbased sulfonate from being so thick that it cannot be easily handled. Similarly, overbased magnesium sulfonate will likely contain base oil as a diluent. With the amount of base oil in the overbased calcium sulfonate and overbased magnesium sulfoante, it may be unnecessary to add additional base oil depending on the desired consistency of the grease immediately after conversion as well as the desired consistency of the final grease. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) is preferably in the ranges indicated in Table 1 above, based on the final weight of the grease. Typically, the amount of base oil added as a separate ingredient will increase as the amount of overbased calcium sulfonate decreases. Combinations of different base oils as described above may also be used in the invention, as will be understood by those with ordinary skill in the art.

The overbased magnesium sulfonate (also referred to herein as simply "magnesium sulfonate," for brevity) used according to these embodiments of the invention for a calcium magnesium sulfonate grease can be any typical to that documented or known in the prior art. The overbased magnesium sulfonate may be made in-situ or any commercially available overbased magnesium sulfonate may be used. Overbased magnesium sulfonate will typically comprise a neutral magnesium alkylbenzene sulfonate and an amount of overbasing wherein a substantial amount of that overbasing is in the form of magnesium carbonate. The magnesium carbonate is believed to typically be in an amorphous (non-crystalline) form. There may also be a portion of the overbasing that is in the form of magnesium oxide, magnesium hydroxide, or a mixture of the oxide and hydroxide. The total base number (TBN) of the overbased magnesium sulfonates is preferably at least 400 mg KOH/gram, but lower TBN values may also be acceptable and in the same ranges as indicated for the TBN values for the overbased calcium sulfonate above.

Although not required for all preferred embodiments, a small amount of a facilitating acid may optionally be added to the mixture prior to conversion. According to other preferred embodiments, a facilitating acid is required to be added to the mixture prior to conversion. Suitable facilitating acids, such as an alkyl benzene sulfonic acid, having an alkyl chain length typically between 8 to 16 carbons, may help to facilitate efficient grease structure formation. Most preferably, this alkyl benzene sulfonic acid comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used in the present invention, it is added before conversion and preferably in an amount in the ranges indicated in Table 1. If the calcium sulfonate or magnesium sulfonate is made in situ using alkyl benzene sulfonic acid, the facilitating acid added according to this embodiment is in addition to that required to produce the calcium sulfonate.

Water is added to the preferred embodiments of the invention as one converting agent. One or more conventional non-aqueous converting agents is also preferably added in certain embodiments of the invention. The conventional non-aqueous converting agents include any converting agent other than water, such as alcohols, ethers, glycols, glycol ethers, glycol polyethers, carboxylic acids, inorganic acids, organic nitrates, other polyhydric alcohols and their derivatives, and any other compounds that contain either active or tautomeric hydrogen. Conventional non-aqueous converting agents also include those agents that contain some water as a diluent or impurity. Although they may be used as conventional non-aqueous converting agents, it is preferred not to use alcohols, such as methanol or isopropyl alcohol or other low molecular weight (i.e. more volatile) alcohols, because of environmental concerns and restrictions related to venting gases during the grease manufacturing process or hazardous waste disposal of scrubbed alcohols. The total amount of water added as a converting agent, based on the final weight of the grease, is preferably in the ranges indicated in Table 1. Additional water may be added after conversion. Also, if the conversion takes place in an open vessel at a sufficiently high temperature so as to volatilize a significant portion of the water during conversion, additional water may be added to replace the water that was lost. The total amount of one or more conventional non-aqueous converting agents added, based on the final weight of the grease, is preferably in the ranged indicated in Table 1. Typically, the amount of conventional non-aqueous converting agent used will decrease as the amount of overbased calcium sulfonate decreases. Depending on the converting agents used, some or all of them may be removed by volatilization during the manufacturing process. Especially preferred are the lower molecular weight glycols such as hexylene glycol and propylene glycol. It should be noted that some converting agents may also serve as complexing acids, to produce a calcium sulfonate complex grease according to one embodiment of the invention, discussed below. Such materials will simultaneously provide both functions of converting and complexing.

According to another preferred embodiment, conventional non-aqueous converting agents, which are typically added to calcium sulfonate greases, are not used as ingredients. Such conventional non-aqueous converting agents include alcohols, ethers, glycols, glycol ethers, glycol polyethers, and other polyhydric alcohols and their derivatives. These ingredients may be added after conversion is complete, if desired, within the scope of such preferred embodiments of the invention since they will not act as converting agents if added after conversion; however, it is preferred that they be omitted altogether in these preferred embodiments.

One or more calcium containing bases are also added as ingredients in a preferred embodiment of a calcium magnesium sulfonate grease composition according to the invention. These calcium containing bases react with complexing acids to form a complex calcium magnesium sulfonate grease. The calcium containing bases may include calcium hydroxyapatite, added calcium carbonate, added calcium hydroxide, added calcium oxide, or a combination of one or more of the foregoing. Most preferably added calcium hydroxyapatite and added calcium carbonate are used together, along with a small amount of added calcium hydroxide. The preferred amounts of these three added calcium containing bases as ingredients by weight percent of the final grease product (although these bases will react with acids and will not be present in the final grease product) according to this preferred embodiment are:

TABLE 2

Preferred Added Calcium Containing Bases

| Ingredient | Preferred Amount (%) | More Preferred Amount (%) | Most Preferred Amount (%) |
|---|---|---|---|
| Calcium Hydroxyapatite | 1.0-20 | 2.0-15 | 3.0-10 |
| Added Calcium Carbonate | 1.0-20 | 2.0-15 | 3.0-10 |
| Added Calcium Hydroxide or Calcium Oxide | 0.07-1.2 | 0.15-1.00 | 0.18-0.80 |

The calcium hydroxyapatite used as a calcium containing base for reacting with complexing acids according to preferred embodiments may be added pre-conversion, post-conversion, or a portion added pre- and a portion added post-conversion. Most preferably, the calcium hydroxyapatite is finely divided with a mean particle size of around 1 to 20 microns, preferably around 1 to 10 microns, most preferably around 1 to 5 microns. Furthermore, the calcium hydroxyapatite will be of sufficient purity so as to have abrasive contaminants such as silica and alumina at a level low enough to not significantly impact the anti-wear properties of the resulting grease. Ideally, for best results, the calcium hydroxyapatite should be either food grade or U.S. Pharmacopeia grade. The amount of calcium hydroxyapatite added will preferably be in the ranges indicated in Tables 1 (total calcium containing bases) or 2, although more can be added, if desired, after conversion and all reaction with complexing acids is complete.

According to another preferred embodiment of the invention, calcium hydroxyapatite may be added in an amount that is stoichiometrically insufficient to fully react with the complexing acids. In this embodiment, finely divided calcium carbonate as an oil-insoluble, solid, added calcium-containing base may be added, preferably before conversion, in an amount sufficient to fully react with and neutralize the portion of any subsequently added complexing acids not neutralized by the calcium hydroxyapatite.

According to another preferred embodiment, calcium hydroxyapatite may be added in an amount that is stoichiometrically insufficient to fully react with the complexing acids. In this embodiment, finely divided calcium hydroxide and/or calcium oxide as an oil-insoluble solid calcium-containing base may be added, preferably before conversion, in an amount sufficient to fully react with and neutralize the portion of any subsequently added complexing acids not neutralized by the co-added calcium hydroxyapatite. According to yet another preferred embodiment, when calcium hydroxyapatite is used in combination with added calcium hydroxide as calcium containing bases for reacting with complexing acids to make a calcium magnesium sulfonate grease, a smaller amount of calcium hydroxyapatite is needed compared to the greases described in the '406 patent. In the '406 patent, the added calcium hydroxide and/or calcium oxide are preferably present in an amount not more than 75% of the hydroxide equivalent basicity provided by the total of the added calcium hydroxide and/or calcium oxide and the calcium hydroxyapatite. In other words, the calcium hydroxyapatite contributes preferably at least 25% of the total added hydroxide equivalents (from both calcium hydroxyapatite and added calcium hydroxide and/or added calcium oxide) in the greases described in the '406 patent, particularly when a poor quality overbased calcium sulfonate is used. If less than that amount of calcium hydroxyapatite is used, the dropping point of the final grease may suffer. However, with the addition of overbased magnesium sulfonate to the composition according to various embodiments of this invention, less calcium hydroxyapatite may be used while still maintaining sufficiently high dropping points. The amount of calcium hydroxyapatite used according to preferred embodiments of this invention may be less than 25%, and even less than 10% of the hydroxide equivalent basicity, even when a poor quality overbased calcium sulfonate is used. This is one indication that the presence of overbased magnesium sulfonate in the finished grease has resulted in an unexpected changed and improved chemical structure not anticipated by the prior art. Since calcium hydroxyapatite is typically much more costly compared to added calcium hydroxide, this results in a further potential cost reduction for the final grease without any significant reduction in dropping point.

In another embodiment, calcium carbonate may also be added with the calcium hydroxyapatite, calcium hydroxide and/or calcium oxide, with the calcium carbonate being added either before or after reacting with complexing acids, or added both before and after reacting with complexing acids. When the amounts of calcium hydroxyapatite, calcium hydroxide, and/or calcium oxide are not sufficient to neutralize the complexing acid or acids added, calcium carbonate is preferably added in an amount that is more than sufficient to neutralize any remaining complexing acid or acids.

The added calcium carbonate used as a calcium containing base, either alone or in combination with another calcium containing base or bases, according to these embodiments of the invention, is finely divided with a mean particle size of around 1 to 20 microns, preferably around 1 to 10 microns, most preferably around 1 to 5 microns. Furthermore, the added calcium carbonate is preferably crystalline calcium carbonate (most preferably calcite) of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of added calcium carbonate added is preferably in the ranges indicated in Tables 1 (total calcium containing bases) or 2. These amounts are added as a separate ingredient in addition to the amount of dispersed calcium carbonate contained in the overbased calcium sulfonate. According to another preferred embodiment of the invention, the added calcium carbonate is added prior to conversion as the sole added calcium-containing base ingredient for reacting with complexing acids. Additional calcium carbonate may be added to either the simple or complex grease embodiments of the invention after conversion, and after all reaction with complexing acids is complete in the case of a complex grease. However, references to added calcium carbonate herein refer to the calcium carbonate that is added prior to conversion and as one of or the sole added calcium-containing base for reaction with complexing acids when making a complex grease according to the invention.

The added calcium hydroxide and/or added calcium oxide added pre-conversion or post-conversion according to another embodiment shall be finely divided with a mean particle size of around 1 to 20 microns, preferably around 1 to 10 microns, most preferably around 1 to 5 microns. Furthermore, the calcium hydroxide and calcium oxide will be of sufficient purity so as to have abrasive contaminants such as silica and alumina at a level low enough to not significantly impact the anti-wear properties of the resulting grease. Ideally, for best results, the calcium hydroxide and calcium oxide should be either food grade or U.S. Pharmacopeia grade. The total amount of calcium hydroxide and/or calcium oxide will preferably be in the ranges indicated in Tables 1 (total calcium containing bases) or 2. These amounts are added as separate ingredients in addition to the amount of residual calcium hydroxide or calcium oxide contained in the overbased calcium sulfonate. Most preferably, an excess amount of calcium hydroxide relative to the total amount of complexing acids used is not added prior to conversion. According to yet another embodiment, it is not necessary to add any calcium hydroxide or calcium oxide for reacting with complexing acids and either added calcium carbonate or calcium hydroxyapatite (or both) may be used as the sole added calcium containing base(s) for such reaction or may be used in combination for such reaction.

One or more alkali metal hydroxides are also optionally added as ingredients in a preferred embodiment of a calcium magnesium sulfonate grease composition according to the invention. The optional added alkali metal hydroxides comprise sodium hydroxide, lithium hydroxide, potassium hydroxide, or a combination thereof. Most preferably, lithium hydroxide is the alkali hydroxide used with the overbased calcium magnesium sulfonate greases according to one embodiment of the invention. In combination with the added overbased magnesium sulfonate, lithium hydroxide may work as well as, or better than, sodium hydroxide. This is unexpected since lithium hydroxide appeared not to work as well as sodium hydroxide when only overbased calcium sulfonate is used, as disclosed in the '422 application. This is yet another indication that the presence of overbased magnesium sulfonate in the final grease has resulted in an unexpected property not anticipated by the prior art. The total amount of alkali metal hydroxide added is preferably in the ranges indicated in Table 1. As with the calcium-containing bases, the alkali metal hydroxide reacts with complexing acids resulting in an alkali metal salt of a complexing acid present in the final grease product. The preferred amounts indicated above are amounts added as raw ingredients relative to the weight of the final grease product, even though no alkali metal hydroxide will be present in the final grease.

According to one preferred embodiment of a method for making an overbased calcium magnesium sulfonate grease, the alkali metal hydroxide is dissolved in the water prior to being added to other ingredients. The water used to dissolve the alkali metal hydroxide may be water used as a converting agent or water added post-conversion. It is most preferred to dissolve the alkali metal hydroxide in water prior to adding it to the other ingredients, but it may also be directly added to the other ingredients without first dissolving it in water.

One or more complexing acids, such as long chain carboxylic acids, short chain carboxylic acids, boric acid, and phosphoric acid are also added when a complex calcium magnesium sulfonate grease is desired. A preferred range of total complexing acids is around 1.25% to 18% and preferred amounts for specific types of complexing acids as ingredients by weight percent of the final grease product (although these acids will react with bases and will not be present in the final grease product) are:

TABLE 3

| Preferred Complexing Acids | | | |
|---|---|---|---|
| Ingredient | Preferred Amount (%) | More Preferred Amount (%) | Most Preferred Amount (%) |
| Short Chain Acids | 0.05-2.0 | 0.1-1.0 | 0.15-0.5 |
| Long Chain Acids | 0.5-8.0 | 1.0-5.0 | 2.0-4.0 |
| Boric Acid | 0.3-4.0 | 0.5-3.0 | 0.6-2.0 |
| Phosphoric Acid | 0.4-4.0 | 0.6-3.0 | 0.8-2.0 |

The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid. The total amount of long chain carboxylic acid(s) is preferably in the ranges indicated in Table 3.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. The total amount of short chain carboxylic acids is preferably in the ranged indicated in Table 3. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture. Additionally, acetic acid and other carboxylic acids may be used as a converting agent or complexing acid or both, depending on when it is added. Similarly, some complexing acids (such as the 12-hydroxystearic acid in the '514 and '467 patents) may also be used as converting agents.

If boric acid is used as a complexing acid according to this embodiment, the amount is preferably in the ranges indicated in Table 3. The boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, borated epoxides, borated peroxides and the like may be used instead of boric acid. If phosphoric acid is used as a complexing acid, an amount preferably in the ranges indicated in Table 3 is added. The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention. All percentages of ingredients are based on the final weight of the finished grease unless otherwise indicated, even though that amount of the ingredient may not be in the final grease product due to reaction or volatilization.

The calcium sulfonate complex greases according to these preferred embodiments are an NLGI No. 2 grade grease having a dropping point of at least 575 F more preferably of 650 F or greater, but greases with other NLGI grades from No. 000 to No. 3 may also be made according to these embodiments with modifications as will be understood by those of ordinary skill in the art. The use of the preferred methods and ingredients according to the invention appear to improve high temperature shear stability compared to most calcium sulfonate-based greases (that are 100% based on calcium).

Methods of Making Overbased Calcium Magnesium Sulfonate Greases

Preferred calcium magnesium sulfonate grease compositions are made according to preferred methods of the invention described herein. In one preferred embodiment, the method comprises: (1) mixing overbased calcium sulfonate and a base oil; (2) adding and mixing overbased magnesium sulfonate, which may be added all at once prior to conversion, added using a split addition method, added using a magnesium sulfonate delay period, or added using a combination of split addition and magnesium sulfonate delay period(s); (3) optionally adding and mixing an alkali metal hydroxide, preferably pre-dissolved in water prior to adding to the other ingredients; (4) adding and mixing one or more calcium containing bases; (5) adding and mixing one or more conventional non-aqueous converting agents and optionally adding and mixing water as a converting agent, which may include the water from step 3 if added prior to conversion and; (6) optionally adding and mixing one or more facilitating acids; (7) adding and mixing one or more complexing acids, if a complex calcium magnesium grease is desired; and (8) heating some combination of these ingredients until conversion has occurred. Additional optional steps comprises: (9) optionally mixing additional base oil, as needed, after conversion; (10) mixing and heating to a temperature sufficiently high to insure removal of water and any volatile reaction byproducts and optimize final product quality; (11) cooling the grease while adding additional base oil as needed; (12) adding remaining desired additives as are well known in the art; and, if desired, and (13) milling the final grease as required to obtain a final smooth homogenous product.

The added magnesium sulfonate may be added all at once prior to conversion, preferably just after mixing the overbased calcium sulfonate and any added base oil. According to another preferred embodiment, there may be a delay period, further described below, between the addition of water or other reactive ingredients and at least a portion of the magnesium sulfonate added prior to conversion. According to another preferred embodiment, a portion of the magnesium sulfonate may be added prior to conversion (preferably at the beginning, just after mixing the overbased calcium sulfonate and any added base oil, or prior to conversion beginning) and another portion added after conversion (either right after conversion is complete or after post-conversion heating and/or cooling of the mixture).

Each of the ingredients in steps (3), (4) and (7) can be added prior to conversion, after conversion, or a portion added prior and another portion added after conversion. Any facilitating acid added in step 6 is preferably added prior to conversion. If a facilitating acid and alkali metal hydroxide are used, the facilitating acid is preferable added to the mixture before the alkali metal hydroxide is added. Most preferably, the specific ingredients and amounts used in the methods of the invention are according to the preferred embodiments of the compositions described herein. Although some ingredients are preferably added prior to other ingredients, the order of addition of ingredients relative to other ingredients in the preferred embodiments of the invention is not critical (other than water being added prior to a conventional non-aqueous converting agent in step 5 if a converting agent delay method is used).

Although the order and timing of these final steps 9-13 is not critical, it is preferred that water be removed quickly after conversion. Generally, the grease is heated (preferably under open conditions, not under pressure, although pressure may be used) to between 250 F and 300 F, preferably 300 F to 380 F, most preferably 380 F to 400 F, to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

Overbased Magnesium Sulfonate Delayed Addition Methods

In one preferred embodiment, there are one or more delay periods between the addition of water or other reactive ingredients (such as acids, bases, or conventional non-aqueous converting agents) and the subsequent addition of at least a portion of the overbased magnesium sulfonate. In this magnesium sulfonate delayed addition method, one or more delays may precede the addition of all of the magnesium sulfonate or, if a split addition method is also used, one or more delay periods may precede any portion of the magnesium sulfonate added or may precede each portion added. One or more of the magnesium sulfonate delay periods may be a temperature adjustment delay period or a holding delay period or both.

For example, a first magnesium sulfonate temperature adjustment delay period is the amount of time after a portion water or other reactive ingredient is added and prior to the addition of magnesium sulfonate that it takes to heat the mixture to a temperature or range of temperatures (the first magnesium sulfonate temperature). A first magnesium sulfonate holding delay period is the amount of time the mixture is held at the first magnesium sulfonate temperature before being heated or cooled to another temperature or before adding at least a portion of the magnesium sulfonate. A second magnesium sulfonate temperature adjustment delay period is the amount of time after the first holding delay period that it takes to heat or cool the mixture to another temperature or temperature range (the second magnesium sulfonate temperature). A second magnesium sulfonate holding delay period is the amount of time the mixture is held at the second magnesium sulfonate temperature before being heated or cooled to another temperature or before adding at least another portion of magnesium sulfonate. Additional magnesium sulfonate temperature adjustment delay periods or magnesium sulfonate holding delay periods (i.e. a third magnesium sulfonate temperature adjustment delay period) follow the same pattern. Generally, the duration of each magnesium sulfonate temperature adjustment delay period will be about 30 minutes to 24 hours, or more typically about 30 minutes to 5 hours. However, the duration of any magnesium sulfonate temperature adjustment delay period will vary depending on the size of the grease batch, the equipment used to mix and heat the batch, and the temperature differential between the starting temperature and final temperature, as will be understood by those of ordinary skill in the art.

Generally, a magnesium sulfonate holding delay period will be followed or preceded by a temperature adjustment delay period and vice versa, but there may be two holding delay periods back to back or two temperature adjustment periods back to back. For example, the mixture may be held at ambient temperature for 30 minutes prior to adding a portion of magnesium sulfonate and after adding water or a reactive ingredient (a first magnesium sulfonate holding delay period) and may continue to be held at ambient temperature for another hour prior to adding more magnesium sulfonate (a second magnesium sulfonate holding delay period). Additionally, the mixture may be heated or cooled to a first temperature prior to adding at least a portion of the magnesium sulfonate and after adding water or another reactive ingredient (a first magnesium sulfonate temperature adjustment period) and then the mixture is heated or cooled to a second temperature after which more magnesium sulfonate is added (a second magnesium sulfonate temperature adjustment period, without any interim holding period). Additionally, a portion of magnesium sulfonate need not be added after every delay period, but may skip delay periods prior to addition or between additions. For example, prior to adding a portion of the magnesium sulfonate, the mixture may be heated to a temperature (first magnesium sulfonate temperature adjustment delay period) and then held at that temperature for a period of time (a first magnesium sulfonate holding delay period) before a subsequent addition of magnesium sulfonate.

According to one preferred embodiment, the first magnesium sulfonate temperature may be ambient temperature or another temperature. Any subsequent magnesium sulfonate temperature may be higher or lower than the previous temperature. If a portion of magnesium sulfonate is added to a mixture including water or other reactive ingredients immediately after the mixture reaches a temperature or range of temperatures, then there is no magnesium sulfonate holding time delay for that particular temperature and that portion of the magnesium sulfonate; but if another portion of magnesium sulfonate is added after holding at that temperature or range of temperatures for a period of time then there is a magnesium sulfonate holding time delay for that temperature and that portion of the magnesium sulfonate. A portion of magnesium sulfonate may be added after any magnesium sulfonate temperature adjustment delay period or magnesium sulfonate holding delay period and another portion of magnesium sulfonate may be added after another magnesium sulfonate temperature adjustment delay period or magnesium sulfonate holding delay period. Additionally, the addition of water, one reactive ingredient or a portion thereof may be a starting point for one magnesium sulfonate delay period and a subsequent addition of water, the same reactive ingredient, a different reactive ingredient, or portion thereof may be a starting point for another magnesium sulfonate delay period.

Overbased Magnesium Sulfonate Split Addition Methods

In another preferred embodiment, the total amount of overbased magnesium sulfonate is added in two parts (a split addition method). The first portion being added at or near the beginning of the process (before conversion is complete, and preferably before conversion begins), and the second part being added later after the grease structure has formed (after conversion is complete or after post-conversion heating and/or cooling of the mixture). When a split addition method is used, it is preferred to add around 0.1-20% magnesium sulfonate (based on the final weight of the grease) in the first part added prior to conversion, more preferably around 0.5-15%, and most preferably around 1.0-10% in the first part. The remainder of the magnesium sulfonate, preferably to provide total amounts in the ranges indicated in Table 1, would be added after conversion. Preferably around 0.25 to 95% of the total magnesium sulfonate is added in the first part, more preferably around 1.0-75% of the total magnesium sulfonate, and most preferably around 10-50% of the total magnesium sulfonate is added in the first part.

A split overbased magnesium sulfonate addition method may also be combined with a delayed magnesium sulfonate addition method. In a preferred combined method, a first portion of the overbased magnesium sulfonate is not added at the very beginning, but after the addition water or one or more reactive components, and before conversion begins—with one or more magnesium sulfonate temperature adjustment delay period and/or magnesium sulfonate holding delay periods between the addition of water or other reactive ingredients and the addition of the first portion of the magnesium sulfonate. The second portion is then added after conversion is complete either before further addition of water or additional reactive ingredient(s) (with no additional magnesium sulfonate delay periods) or after the addition of additional water or other reactive components (another magnesium sulfonate delay period, which may include one or more magnesium sulfonate temperature adjustment delay period and/or magnesium sulfonate holding delay periods).

In other preferred embodiments, the addition of magnesium sulfonate is combined with one or more of the (1) the addition of calcium hydroxyapatite and/or added calcium carbonate as calcium-containing bases for reacting with complexing acids, either with or without separately adding added calcium hydroxide and/or added calcium oxide as calcium containing bases as described in the '265 and '406 patents and herein; (2) the delayed addition of conventional non-aqueous converting agents, as described in the '473 application and herein; (3) the addition of an alkali metal hydroxide (most preferably lithium hydroxide), as described in the '422 application and herein; or (4) and combination thereof. According to still other preferred embodiments, the magnesium sulfonate delay period method and/or the split addition method may also be combined with one or more of the foregoing methods.

Methods of Making Sulfonate-Based Greases with a Facilitating Acid Delay

Preferred sulfonate-based grease compositions are made according to preferred methods of the invention described herein. In one preferred embodiment, the method comprises: (1) mixing overbased calcium sulfonate and a base oil; (2) optionally adding and mixing overbased magnesium sulfonate, which may be added all at once prior to conversion, using a split addition method, using a magnesium sulfonate delay period, or a combination of split addition and magnesium sulfonate delay period(s); (3) optionally adding and mixing an alkali metal hydroxide, preferably pre-dissolved in water prior to adding to the other ingredients; (4) adding and mixing one or more calcium containing bases; (5) adding and mixing one or more conventional non-aqueous converting agents and optionally adding and mixing water as a converting agent, which may include the water from step 3 if added prior to conversion and; (6) adding and mixing one or more facilitating acids, wherein there is one or more facilitating acid delay periods between the addition of the facilitating acid(s) and at least a portion of another ingredient; (7) adding and mixing one or more complexing acids, if a complex calcium magnesium grease is desired; and (8) heating some combination of these ingredients until conversion has occurred. Additional optional steps comprises: (9) optionally mixing additional base oil, as needed after conversion; (10) mixing and heating to a temperature sufficiently high to insure removal of water and any volatile reaction byproducts and optimize final product quality; (11) cooling the grease while adding additional base oil as needed; (12) adding remaining desired additives as are well known in the art; and, if desired, and (13) milling the final grease as required to obtain a final smooth homogenous product.

Each of the ingredients in steps (3), (4) and (7) can be added prior to conversion, after conversion, or a portion added prior and another portion added after conversion. Any facilitating acid added in step 6 is preferably added prior to conversion and with a facilitating acid delay period between the addition of the facilitating acid and the addition of the next ingredient. If a facilitating acid and alkali metal hydroxide are used, the facilitating acid is preferable added to the mixture before the alkali metal hydroxide is added. Most preferably, the specific ingredients and amounts used in the methods of the invention are according to the preferred embodiments of the compositions described herein. Although some ingredients are preferably added prior to other ingredients, the order of addition of ingredients relative to other ingredients in the preferred embodiments of the invention is not critical (other than water being added prior to a conventional non-aqueous converting agent in step 5 if a converting agent delay method is used).

Although the order and timing of these final steps 9-13 is not critical, it is preferred that water be removed quickly after conversion. Generally, the grease is heated (preferably under open conditions, not under pressure, although pressure may be used) to between 250 F and 300 F, preferably 300 F to 380 F, most preferably 380 F to 400 F, to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

According to one preferred embodiment, there are one or more delay periods between the addition of one or more facilitating acids and the subsequent addition of one or more other ingredients (or a portion thereof). Similar to the delay periods described in the '473 and 792 applications, these delay periods may be a temperature adjustment delay period or a holding delay period and there may be multiple delay periods. In this facilitating acid delayed addition method, a delay may follow the addition of all of the facilitating acid or a delay may follow the addition of a portion of a facilitating acid.

For example, a first facilitating acid temperature adjustment delay period is the amount of time after one or more facilitating acids is added and prior to the addition of the next ingredient (or portion thereof) that it takes to heat the mixture to a temperature or range of temperatures (the first facilitating acid temperature). A first facilitating acid holding delay period is the amount of time the mixture is held at the first facilitating acid temperature (which may be ambient temperature) before being heated or cooled to another temperature or before adding the next ingredient or next portion of a facilitating acid. A second facilitating acid temperature adjustment delay period is the amount of time after the first holding delay period that it takes to heat or cool the mixture to another temperature or temperature range (the second facilitating acid temperature). A second facilitating acid holding delay period is the amount of time the mixture is held at the second facilitating acid temperature before being heated or cooled to another temperature or before adding at least another portion of magnesium sulfonate. Additional facilitating acid temperature adjustment delay periods or facilitating acid holding delay periods (i.e. a third facilitating acid temperature adjustment delay period) follow the same pattern. Generally, the duration of each facilitating acid temperature adjustment delay period will be about 30 minutes to 24 hours, or more typically about 30 minutes to 5 hours. However, the duration of any facilitating acid temperature adjustment delay period will vary depending on the size of the grease batch, the equipment used to mix and heat the batch, and the temperature differential between the starting temperature and final temperature, as will be understood by those of ordinary skill in the art.

A delay between the addition of a facilitating acid and the next ingredient of 30 minutes or more is a facilitating acid delay, regardless of which ingredient is the next added ingredient. A delay may be shorter than 30 minutes if there is a temperature adjustment between the addition of the facilitating acid and the next added ingredient. Additionally, if the next added ingredient is reactive with the facilitating acid (such as magnesium sulfonate), then a facilitating acid delay period may be less than 30 minutes, such as around 20 minutes, even without any heating. If a reactive ingredient is added after the facilitating acid and there is a temperature adjustment between the addition of the facilitating acid and the reactive ingredient, then there is a facilitating acid delay period even if the reactive ingredient is not the immediately next added ingredient (that is the reactive ingredient is added as the second, third, fourth, etc. ingredient added after the facilitating acid) and even if there is no delay period between the facilitating acid and the next added ingredient (the ingredient first added after the facilitating acid) because it is added less than 30 minutes after the facilitating acid without any interim temperature adjustment. If the reactive ingredient is magnesium sulfonate, then there is also a magnesium sulfonate delay period as described below.

All facilitating acid delay periods end upon the addition of the next added ingredient, unless an ingredient reactive to the facilitating acid (such as magnesium sulfonate) is to be added at a later point in the process (as the second, third, etc. ingredient added after the facilitating acid), then the facilitating acid delay continues until the addition of the magnesium sulfonate. In that case, the delay or delays are determined by whether there is a temperature adjustment or the time held at a temperature between the addition of the facilitating acid and the magnesium sulfonate. For example, if you add the facilitating acid and then immediately add three other ingredients without a temperature change and then add magnesium sulfonate, there is a single facilitating acid holding delay, which is the amount of time between the addition of the facilitating acid and the magnesium sulfonate, even though the magnesium sulfonate was the fourth added ingredient. When magnesium sulfonate is the later added reactive ingredient, there will also be a magnesium sulfonate delay (as discussed further below), that overlaps the facilitating acid delay period.

Most preferably, a facilitating acid delay period occurs between the addition of a facilitating acid and the addition of magnesium sulfonate, calcium hydroxyapatite, or calcium carbonate (as the next subsequently added ingredient). Other ingredients may also serve at the next subsequently added ingredient following a facilitating acid delay. According to another preferred embodiment, water as a converting agent is not present in a mixture of other ingredients during a facilitating acid delay period. Most preferably, water is not added as the next subsequent ingredient after a facilitating acid delay period, but is added sometime after the next subsequent ingredient.

According to another preferred embodiment, a simultaneous facilitating acid delay and a magnesium sulfonate delay are used. In this embodiment, there is no magnesium sulfonate present when the facilitating acid is added to an initial mixture of overbased calcium sulfonate and base oil. The initial mixture of base oil, overbased calcium sulfonate, and facilitating acid are sufficiently mixed to allow the facilitating acid to react with the overbased calcium sulfonate prior to adding any magnesium sulfonate. After this delay period, which is both a facilitating acid delay period and a magnesium sulfonate delay period, at least a portion of the magnesium sulfonate is added. The various types and combinations of delays previously described are equally applicable in this embodiment regarding the delay or delays between the addition of the facilitating acid and the addition of the magnesium sulfonate. If the magnesium sulfonate that is added is only the first of two portions of magnesium sulfonate to be added, with the second portion being added later, then a split magnesium sulfonate addition method would also be employed, as previously discussed. Most preferably, when a facilitating acid delay and magnesium sulfonate delay are simultaneous, water is not added as a converting agent until after at least the first portion (or all) of the magnesium sulfonate is added. The importance of this specific combined use of the delayed facilitating acid method and the delayed magnesium sulfonate method is that such a combined use of these methods allows the facilitating acid to react with the calcium sulfonate, but not with the magnesium sulfonate. The delay between the addition of the facilitating acid and the first portion of the magnesium sulfonate may be 20-30 minutes, or longer. A shorter delay, such as 20 minutes, would still qualify as a true delay period herein, even without any temperature adjustment. This is because the reaction of facilitating acid with the calcium sulfonate (or magnesium sulfonate, if a portion of the magnesium sulfonate is added prior to the facilitating acid according to another preferred embodiment) will typically be very facile, and will be expected to occur rapidly upon mixing, even at normal ambient temperatures. Any intentional delay between the addition of the facilitating acid and a first portion (or all) of the magnesium sulfonate as herein described that sufficiently allows reaction of the facilitating acid with the already present calcium sulfonate qualifies as a facilitating acid delay period and a magnesium sulfonate delay period.

In other preferred embodiments, a facilitating acid delay method is combined with one or more of the following ingredients and/or methods: (1) addition of magnesium sulfonate, all at once or using a split addition method, or using a delayed magnesium sulfonate addition method, or a combination of split and delayed magnesium sulfonate addition methods as described herein; (2) the addition of calcium hydroxyapatite and/or added calcium carbonate as calcium-containing bases for reacting with complexing acids, either with or without separately adding added calcium hydroxide and/or added calcium oxide as calcium containing bases as described in the '265 and '406 patents and herein; (3) the delayed addition of conventional non-aqueous converting agents, as described in the '473 application and herein; (4) the addition of an alkali metal hydroxide (most preferably lithium hydroxide), as described in the '422 application and herein; or (5) and combination thereof.

Methods of Making Sulfonate-Based Greases without a Pre-Conversion Addition of a Conventional Non-Aqueous Converting Agent Preferred calcium magnesium sulfonate grease compositions are made according to preferred methods of the invention described herein. In one preferred embodiment, the method comprises: (1) mixing overbased calcium sulfonate and a base oil; (2) adding and mixing overbased magnesium sulfonate, which may be added all at once prior to conversion, added using a split addition method, added using a magnesium sulfonate delay period, or added using a combination of split addition and magnesium sulfonate delay period(s); (3) optionally adding and mixing an alkali metal hydroxide, preferably pre-dissolved in water prior to adding to the other ingredients; (4) adding and mixing one or more calcium containing bases; (5) adding and mixing water as a converting agent, which may include the water from step 3 if added prior to conversion, and omitting any pre-conversion addition of conventional non-aqueous converting agents; (6) optionally adding and mixing one or more facilitating acids; (7) adding and mixing one or more complexing acids, if a complex calcium magnesium grease is desired; and (8) heating some combination of these ingredients until conversion has occurred. Additional optional steps comprises: (9) optionally mixing additional base oil, as needed, after conversion; (10) mixing and heating to a temperature sufficiently high to insure removal of water and any volatile reaction byproducts and optimize final product quality; (11) cooling the grease while adding additional base oil as needed; (12) adding remaining desired additives as are well known in the art; and, if desired, (13) milling the final grease as required to obtain a final smooth homogenous product.

The added magnesium sulfonate may be added all at once prior to conversion, preferably just after mixing the overbased calcium sulfonate and any added base oil. According to another preferred embodiment, there may be a magnesium sulfonate delay period, as described above, between the addition of water or other reactive ingredients and at least a portion of the magnesium sulfonate added prior to conversion. According to another preferred embodiment, a portion of the magnesium sulfonate may be added prior to conversion (preferably at the beginning, just after mixing the overbased calcium sulfonate and any added base oil, or prior to conversion beginning) and another portion added after conversion (either right after conversion is complete or after post-conversion heating and/or cooling of the mixture). The addition of magnesium sulfonate as an ingredient prior to conversion appears to act as a new, non-conventional converting agent, resulting in greases with improved thickener yield and excellent dropping point.

Each of the ingredients in steps (3), (4) and (7) can be added prior to conversion, after conversion, or a portion added prior and another portion added after conversion. Any facilitating acid added in step (6) is preferably added prior to conversion. If a facilitating acid and alkali metal hydroxide are used, the facilitating acid is preferable added to the mixture before the alkali metal hydroxide is added. Most preferably, the specific ingredients and amounts used in the methods of the invention are according to the preferred embodiments of the compositions described herein. Although some ingredients are preferably added prior to other ingredients, the order of addition of ingredients relative to other ingredients in the preferred embodiments of the invention is not critical.

Although the order and timing of these final steps 9-13 is not critical, it is preferred that water be removed quickly after conversion. Generally, the grease is heated (preferably under open conditions, not under pressure, although pressure may be used) to between 250 F and 300 F, preferably 300 F to 380 F, most preferably 380 F to 400 F, to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

Methods for Adding Calcium Containing Bases

According to several preferred embodiments, the step(s) of adding one or more calcium containing base(s)) involves one of the following: (a) admixing finely divided calcium hydroxyapatite prior to conversion as the only calcium containing base added; (b) admixing finely divided calcium hydroxyapatite and calcium carbonate in an amount sufficient to fully react with and neutralize subsequently added complexing acids, according to one embodiment; (c) admixing finely divided calcium hydroxyapatite and calcium hydroxide and/or calcium oxide in an amount sufficient to fully react with and neutralize subsequently added complexing acids, with the added calcium hydroxide and/or calcium oxide preferably being present in an amount not more than 90% of the hydroxide equivalent basicity provided by the total of the added calcium hydroxide and/or calcium oxide and the calcium hydroxyapatite, according to another embodiment of the invention; (d) admixing added calcium carbonate after conversion, according to another embodiment of the invention; (e) admixing calcium hydroxyapatite after conversion and in an amount sufficient to completely react with and neutralize any complexing acids added post-conversion, according to yet another embodiment of the invention; (f) admixing finely divided calcium carbonate as an oil-insoluble solid calcium-containing base prior to conversion and admixing finely divided calcium hydroxyapatite and calcium hydroxide and/or calcium oxide in an amount insufficient to fully react with and neutralize subsequently added complexing acids, with the added calcium hydroxide and/or calcium oxide preferably being present in an amount not more than 90% of the hydroxide equivalent basicity provided by the total of the added calcium hydroxide and/or calcium oxide and the calcium hydroxyapatite, with the previously added calcium carbonate being added in an amount sufficient to fully react with and neutralize the portion of any subsequently added complexing acids not neutralized by the calcium hydroxyapatite and calcium hydroxide and/or calcium oxide. These embodiments may be combined with a converting agent delay method, the addition of magnesium sulfonate (all at once, with a split magnesium sulfonate addition method, a magnesium sulfonate delayed method, or a combination thereof), an alkali metal hydroxide addition method, or any combination thereof.

Converting Agent Delay Methods

In one preferred embodiment, which may be used in combination with any overbased magnesium sulfonate addition and other methods herein (other than the methods wherein a conventional non-aqueous converting agent is not used), a converting agent delay method is used. In this embodiment, the method comprises these same steps described above, except that the converting agents comprise water and at least one conventional non-aqueous converting agent and there are one or more delay periods between the pre-conversion addition of the water and the addition of at least a portion of the one or more other conventional non-aqueous converting agents (a converting agent delay method). Similar to a magnesium sulfonate delay method, a converting agent delay method may include a converting agent temperature adjustment delay period or a converting agent holding delay period or both. If additional water is added pre-conversion to make up for evaporation losses during the manufacturing process, those additions are not used in re-starting or determining delay periods, and only the first addition of water is used as the starting point in determining delay periods.

The converting agent delay periods may involve multiple temperature adjustment delay periods and/or multiple holding delay periods. For example, a first converting agent temperature adjustment delay period is the amount of time after water is added that it takes to heat the mixture to a temperature or range of temperatures (the converting agent first temperature). A first converting agent holding delay period is the amount of time the mixture is held at the first converting agent temperature before being heated or cooled to another temperature or before adding at least a portion of a conventional non-aqueous converting agent. A second converting agent temperature adjustment delay period is the amount of time after the first converting agent holding delay period that it takes to heat or cool the mixture to another temperature or temperature range (the second converting agent temperature). A second converting agent holding delay period is the amount of time the mixture is held at the second converting agent temperature before being heated or cooled to another temperature or before adding at least a portion of a conventional non-aqueous converting agent. Additional converting agent temperature adjustment delay periods or converting agent holding delay periods (i.e. a third converting agent temperature adjustment delay period) follow the same pattern. Generally, the duration of each converting agent temperature adjustment delay period will be about 30 minutes to 24 hours, or more typically about 30 minutes to 5 hours. However, the duration of any converting agent temperature adjustment delay period will vary depending on the size of the grease batch, the equipment used to mix and heat the batch, and the temperature differential between the starting temperature and final temperature, as will be understood by those of ordinary skill in the art.

Generally, a converting agent holding delay period will be followed or preceded by a converting agent temperature adjustment delay period and vice versa, but there may be two converting agent holding delay periods back to back or two converting agent temperature adjustment periods back to back. For example, the mixture may be held at ambient temperature for 30 minutes prior to adding one conventional non-aqueous converting agent (a first converting agent holding delay period) and may continue to be held at ambient temperature for another hour prior to adding the same or a different conventional non-aqueous converting agent (a second converting agent holding delay period). Additionally, the mixture may be heated or cooled to a first converting agent temperature after which a conventional non-aqueous converting agent is added (a first converting agent temperature adjustment period) and then the mixture is heated or cooled to a second converting agent temperature after which the same or a different conventional non-aqueous converting agent is added (a second converting agent temperature adjustment period, without any interim holding period). Additionally, a portion of a conventional non-aqueous converting agent need not be added after every delay period, but may skip delay periods prior to addition or between additions. For example, the mixture may be heated to a temperature (first converting agent temperature adjustment delay period) and then held at that temperature for a period of time (a converting agent first holding delay period) before adding any conventional non-aqueous converting agent.

According to one preferred embodiment, the first converting agent temperature may be ambient temperature or another temperature. Any subsequent temperature may be higher or lower than the previous temperature. The final pre-conversion temperature (for non-pressurized production) will be between about 190° F. and 220° F. or up to 230° F., as the temperature at which conversion in an open kettle typically occurs. Final pre-conversion temperatures can be below 190 F, however such process conditions will usually result in significantly longer conversion times, and thickener yields may also be diminished. If a portion of a conventional non-aqueous converting agent is added immediately after reaching a temperature or range of temperatures, then there is no converting agent holding time delay for that particular temperature and that portion of the conventional non-aqueous converting agent; but if another portion is added after holding at that temperature or range of temperatures for a period of time then there is a converting agent holding time delay for that temperature and that portion of the conventional non-aqueous converting agent. A portion of one or more conventional non-aqueous converting agents may be added after any converting agent temperature adjustment delay period or converting agent holding delay period and another portion of the same or a different conventional non-aqueous converting agent may be added after another converting agent temperature adjustment delay period or converting agent holding delay period.

According to another preferred embodiment, at least a portion of a conventional non-aqueous converting agent is added after the mixture is heated to the final pre-conversion temperature range between about 190 F and 230 F. According to another preferred embodiment, no amount of conventional non-aqueous converting agent is added at substantially the same time as the water and there is at least one converting agent delay period prior to the addition of any conventional non-aqueous converting agent. According to another preferred embodiment, when at least one of the conventional non-aqueous converting agents is a glycol (e.g. propylene glycol or hexylene glycol) or other non-acidic conventional non-aqueous converting agent as described earlier, a portion of that conventional non-aqueous converting agent is added at substantially the same time as the water and another portion of conventional non-aqueous converting agent and all of any other conventional non-aqueous converting agents are added after at least one converting agent delay period. According to another preferred embodiment, when acetic acid is added pre-conversion, it is added at substantially the same time as the water, and another (different) conventional non-aqueous converting agent is added after a converting agent delay period. According to another preferred embodiment, alcohols are not used as conventional non-aqueous converting agents.

According to one preferred embodiment, all or a portion of the conventional non-aqueous converting agents are added in a batch manner (all at once, en masse, as opposed to a continuous addition over the course of a delay period, described below) after a delay period. It is noted, however, that in large or commercial scale operations, it will take some time to complete the batch addition of such conventional non-aqueous converting agents to the grease batch because of the volume of materials involved. In batch addition, the amount of time it takes to add the conventional non-aqueous converting agent to the grease mixture is not considered a converting agent delay period. In that case, any delay prior to the addition of that conventional non-aqueous converting agent or portion thereof ends at the start time of the batch addition of the conventional non-aqueous converting agent. According to another preferred embodiment, at least one or a portion of one conventional non-aqueous converting agent is added in a continuous manner during the course of a converting agent delay period (either a converting agent temperature adjustment delay period or a converting agent holding delay period). Such continuous addition may be by slowly adding the conventional non-aqueous converting agent at a substantially steady flow rate or by repeated, discrete, incremental additions during a converting agent temperature adjustment delay period, a converting agent holding delay period, or both. In that case, the time it takes to fully add the conventional non-aqueous converting agent is included in the converting agent delay period, which ends when the addition of conventional non-aqueous converting agent is complete. According to yet another preferred embodiment at least a portion of one conventional non-aqueous converting agent is added in a batch manner after a converting agent delay period and at least another portion of the same or a different conventional non-aqueous converting agent is added in a continuous manner during a converting agent delay period.

Although a converting agent delay period within the scope of this invention may involve a holding delay period that does not involve heating (e.g. where the mixture was held at ambient temperature for a first holding delay period prior to heating), a short period of time of less than 15 minutes between the addition of water as a converting agent and the addition of all of the conventional non-aqueous converting agent(s) without any heating during that time period is not a "converting agent delay" or "converting agent delay period" as used herein. A delay for the addition of any or all of the conventional non-aqueous converting agent(s) without heating during the delay period, for purposes of this invention, should be at least about 20 minutes and more preferably at least about 30 minutes. An interval of less than 20 minutes between the addition of water and a portion of a conventional non-aqueous converting agent, without heating during the 20 minutes, but with a subsequent longer holding delay period or subsequent heating prior to the addition of another portion of the same, or a portion or all of a different, conventional non-aqueous converting agent(s) does involve a "converting agent delay period" within the scope of the invention. In that case, the initial short interval is not a "converting agent delay period," but the subsequent longer holding delay or temperature adjustment delay prior to addition of a conventional non-aqueous converting agent is a holding delay period or temperature adjustment delay period for purposes of this invention. With respect to a magnesium sulfonate delay period, a delay without heating may be shorter than 20 minutes, particularly if the previously added ingredient is an acid (a reactive ingredient as previously described), which will react with the overbased calcium sulfonate (or with the overbased calcium sulfonate and a previously added portion of magnesium sulfonate) without requiring any heating. In such cases, the delay in the addition of the magnesium sulfonate will be with respect to that reactive ingredient if water has not yet been added.

Additionally, when acetic acid or 12-hydroxystearic acid are added pre-conversion, these acids acid will have a dual role as both converting agent and complexing acid. When these acids are added along with another more active conventional non-aqueous converting agent (such as a glycol), the acid may be considered to act primarily in the role of complexing acid, with the more active agent taking on the primary role of converting agent. As such, when acetic acid or 12-hydroxystearic acid is added pre-conversion along with a more active converting agent, any elapsed time between the addition of water and any portion of the acetic acid or 12-hydroxystearic acid is not considered a converting agent delay as that term is used herein. In that case, only converting agent temperature adjustment delay periods or converting agent holding delay periods between the pre-conversion addition of water and the pre-conversion addition of any portion of the other conventional non-aqueous converting agent are considered delays for purposes of this invention. If acetic acid or 12-hydroxystearic acid or a combination thereof is/are the only conventional non-aqueous converting agent(s) used, then a converting agent temperature adjustment delay period or converting agent holding delay period between the pre-conversion addition of water and the pre-conversion addition of any portion of the acetic acid or 12-hydroxystearic acid would be a delay for purposes of this invention.

These embodiments may be combined with any calcium base addition method, the addition of magnesium sulfonate (all at once, with a split magnesium sulfonate addition method, a magnesium sulfonate delayed method, or a combination thereof), an alkali metal hydroxide addition method, or any combination thereof Added Alkali Metal Hydroxide Methods According to yet another preferred embodiment, a calcium magnesium sulfonate grease is made with added alkali metal hydroxide. The alkali metal hydroxide is preferably dissolved in water and the solution added to the other ingredients. According to other preferred embodiments, when an alkali metal hydroxide is added, one or more of the following steps are included: (a) alkali metal hydroxide is dissolved in the water to be added as a converting agent and the water with dissolved alkali metal hydroxide is added all at once prior to conversion (with additional water added later in the process to make-up for evaporative losses, as needed); (b) (i) a first portion of water is added as a converting agent prior to conversion and a second portion of water is added after conversion and (ii) the alkali metal hydroxide is dissolved in the first portion of water or the second portion of water or both; (c) water is added in at least two separate pre-conversion steps as a converting agent, with one or more temperature adjustment steps, addition of another ingredient(s) steps or a combination thereof between the first addition of water as a converting agent and the second addition of water as a converting agent, and the alkali metal hydroxide is dissolved in the initial or first addition of water as a converting agent, or the second or subsequent addition of water as a converting agent, or both; (d) at least part of the complexing acids are added prior to heating; (e) all of the complexing acid(s) are added prior to heating; (f) when added calcium carbonate is used as the added calcium containing base for reacting with complexing acids, it added before any complexing acid(s); (g) calcium hydroxyapatite, added calcium hydroxide and added calcium carbonate are all used as calcium containing bases for reacting with complexing acids; (h) the water with dissolved alkali metal hydroxide is added after the calcium containing base(s) are added and/or after a portion of the pre-conversion complexing acid(s) are added; and/or (i) the water with dissolved alkali metal hydroxide (or alkali metal hydroxide added separately) are added before adding a least a portion of one or more complexing acids. These embodiments may be combined with any calcium containing base addition, any converting agent delay method, the addition of magnesium sulfonate (all at one, with a split magnesium sulfonate addition method, a magnesium sulfonate delayed method, or any combination thereof), or any combination thereof. It should be noted that while adding the alkali metal hydroxide pre-dissolved in water is the preferred method of adding the alkali metal hydroxide, it is possible to add the solid alkali metal hydroxide and water separately and in either order preferably with sufficient mixing time to allow the alkali metal hydroxide to completely dissolve in the added and dispersed water before proceeding to the next step in the manufacturing process. If this is done, the mixing time allowed for the alkali metal hydroxide is not considered a delay period herein.

Combined Alkali Metal Hydroxide Addition and Converting Agent Delay Methods

According to various preferred embodiments when a converting agent delay method is combined with an alkali metal hydroxide addition method, different variations on the delay period may also be used to make a calcium magnesium sulfonate grease. For example, each of the following are separate preferred embodiments: (a) at least a portion of a conventional non-aqueous converting agent is added with the first addition of water (at substantially the same time) and another portion of the same conventional non-aqueous converting agent and/or a different conventional non-aqueous converting agent is added after at least one delay period; (b) no amount of conventional non-aqueous converting agent is added at substantially the same time as the water and there is at least one delay period prior to the addition of any conventional non-aqueous converting agent: (c) at least a portion of a conventional non-aqueous converting agent is added after the mixture is heated to the final pre-conversion temperature range between about 190 F and 230 F (as the temperature range at which conversion occurs in an open vessel, or heated to an appropriate temperature range at which conversion occurs if made in a closed vessel); (d) when at least one of the conventional non-aqueous converting agents is a glycol (e.g. propylene glycol or hexylene glycol), a portion of the glycol is added at substantially the same time as the water and another portion of glycol and all of any other conventional non-aqueous converting agents are added after at least one delay period; (e) when acetic acid is added pre-conversion, it is added at substantially the same time as the water, and another (different) conventional non-aqueous converting agent is added after a delay period; (f) at least a portion of one or more conventional non-aqueous converting agents is added at the end of a final of the one or more delay periods and another portion of the same and/or a different conventional non-aqueous converting agent is added after one or more prior delay periods; or (g) all of the one or more conventional non-aqueous converting agents are added at the end of a final of the one or more delay periods.

Another preferred embodiment combining the magnesium sulfonate addition with a converting agent delay method and alkali metal hydroxide addition method comprises: (1) admixing in a suitable grease manufacturing vessel the following ingredients: water as a converting agent, a highly overbased oil-soluble calcium sulfonate containing dispersed amorphous calcium carbonate, optionally an appropriate amount of a suitable base oil (if needed), one or more alkali metal hydroxides, and optionally at least a portion of one or more conventional non-aqueous converting agents to form a first mixture; (2) mixing or stirring the first mixture while maintaining it at a temperature or within a range of temperatures and/or adjusting the temperature of the first mixture to heat or cool it to another temperature(s) or range of temperatures during one or more converting agent delay periods; (3) optionally admixing at least a portion of one or more conventional non-aqueous converting agents with the first mixture after or during one or more converting agent delay periods to form a second mixture; (4) heating the first mixture (or second mixture if conventional non-aqueous converting agents are added in step 3) to a conversion temperature (preferably in the range of 190 F to 230 F, higher than the typical range of 190 F to 220 F, for an open vessel) to form a third mixture during the final of the one or more converting agent delay periods; (5) after or during step 4, admixing all or any remaining portion (if any) of the one or more conventional non-aqueous converting agents; and (6) converting the third mixture by continuing to mix while maintaining the temperature in the conversion temperature range (preferably 190 F to 230 F, for an open vessel) until conversion of the amorphous calcium carbonate contained in the overbased calcium sulfonate to very finely divided crystalline calcium carbonate is complete; (7) admixing one or more calcium containing bases; (8) optionally admixing a facilitating acid; (9) admixing one or more of suitable complexing acids; and (10) admixing overbased magnesium sulfonate, (i) all at once with the overbased calcium sulfonate; (ii) using a magnesium sulfonate delay method; or (iii) using a split addition method, preferably by adding at least a portion of the total overbased magnesium sulfonate to the first mixture prior to step 3. This process results in a preferred complex calcium magnesium sulfonate grease.

Step (7) may be carried out prior to conversion or after conversion, or some portion or all of one or more calcium containing bases may be added prior to conversion and some portion or all of one or more calcium containing bases may be added after conversion. Step (8) may be carried out at any time prior to conversion. Step (9) may be carried out prior to conversion or after conversion, or some portion or all of one or more of the complexing acids may be added prior to conversion and some portion or all of one or more of the complexing acids added after conversion. Most preferably, this combined alkali/converting agent delayed addition method is carried out in an open vessel, but may also be carried out in a pressurized vessel. Most preferably, the one or more alkali metal hydroxides are dissolved in the water to be used as a converting agent prior to adding them in step (1). Alternatively, the alkali metal hydroxide may be omitted from step (1) and may be dissolved in water and the solution added at a later step prior to conversion or after conversion.

For any of the preferred embodiments of the combined alkali/converting agent delayed addition method described herein, any portion of a conventional non-aqueous converting agent added in steps 1, 3, and/or 5 may be the same conventional non-aqueous converting agent as that added in another step or steps or different from any conventional non-aqueous converting agent added in another step or steps. Provided that at least a portion of at least one conventional non-aqueous converting agent is added after a converting agent delay period (in step 3 or step 5), another portion of the same and/or at least a portion of a different conventional non-aqueous converting agent or agents may be added in any combination of steps 1, 3, and/or 5. According to other preferred embodiments of the combined alkali/converting agent delayed addition method, the steps further comprise: (a) all of the one or more of the conventional non-aqueous converting agents are admixed after the final delay period in step 5, with none being added during steps 1 or 3; (b) at least a portion of one or more conventional non-aqueous converting agents is added with the first mixture in step 1 prior to any delay and at least a portion of the same or a different conventional non-aqueous converting agent is added in step 3 and/or in step 5; (c) no conventional non-aqueous converting agents are added with the first mixture and at least a portion of one or more conventional non-aqueous converting agents is added is added in step 3 and in step 5; (d) at least a portion of one or more conventional non-aqueous converting agents is added after or during one converting agent delay period in step 3 and at least a portion of the same or a different conventional non-aqueous converting agent is added after or during another converting agent delay period (a second converting agent delay period in step 3 and/or a final delay period in step 5); and/or (e) at least a portion of one or more conventional non-aqueous converting agents is added after one or more converting agent delays in step 3, but no conventional non-aqueous converting agents are added after the final converting agent delay period in step 5.

The order of steps (2)-(6) for making a complex grease are important aspects of the invention with respect to embodiments including the combined alkali/delayed addition method. Certain other aspects of the process are not critical to obtaining a preferred calcium magnesium sulfonate grease compositions according to the invention. For instance, the order that the calcium containing bases are added relative to each other is not critical. Also, the temperature at which the water as a converting agent and calcium containing bases are added is not critical in order to obtain an acceptable grease, but it is preferred that they be added before the temperature reaches 190 F to 200 F (or other temperature range at which conversion occurs when made in a closed vessel). When more than one complexing acid is used, the order in which they are added either before or after conversion is also not generally critical.

Another preferred embodiment of the alkali/delayed addition method comprises the steps of: admixing in a suitable grease manufacturing vessel a highly overbased oil-soluble calcium sulfonate containing dispersed amorphous calcium carbonate and an amount of suitable base oil (if needed) and begin mixing. Then one or more facilitating acids are added and mixed, preferably for about 20-30 minutes. Then all of the calcium hydroxyapatite is added, followed by a portion of the calcium hydroxide, and then all of the calcium carbonate, which is mixed for another 20-30 minutes. Next a portion of the acetic acid and a portion of the 12-hydroxystearic acid are added and mixed for another 20-30 minutes (it is noted that these ingredients may be converting agents, but since they are added before the water there is no converting agent delay period with respect to them). Then water used as a converting agent, with a small amount of an alkali metal hydroxide having been dissolved in the water, is added and mixed while heating to a temperature between 190° F. and 230° F. (a first temperature adjustment delay period and the final delay period). Then all of the hexylene glycol is added as a conventional non-aqueous converting agent. The mixture is converted by continuing to mix while maintaining the temperature in the conversion temperature range (preferably 190 F to 230 F, for an open vessel) until conversion of the amorphous calcium carbonate contained in the overbased calcium sulfonate to very finely divided crystalline calcium carbonate is complete. After conversion, the remaining calcium hydroxide is added and mixed for about 20-30 minutes. Then the remaining acetic acid and remaining 12-hydroxystearic acid are added and mixed for around 30 minutes. Next boric acid dispersed in water is added followed by the slow, gradual addition of phosphoric acid. The mixture is then heated to remove water and volatiles, cooled, more base oil is added as needed, and the grease is milled as described below. Overbased magnesium sulfonate is also added, either all at once with the overbased calcium sulfonate and base oil at the beginning, using a magnesium sulfonate delayed addition method, a split addition method, or a combination of a magnesium sulfonate delayed addition and split addition method. Additional additives may be added during the final heating or cooling steps.

According to another preferred embodiment of the alkali/delayed addition method, the steps and ingredients are the same as outlined above except that after adding the water as a converting agent and before adding all of the hexylene glycol as a conventional non-aqueous converting agent, the mixture is heated to around 160° F. (a first converting agent temperature adjustment delay period) and held at that temperature for around 30 minutes (a first converting agent holding delay period) before continuing to heat to between 190° F. and 230° F. (a converting agent second temperature adjustment delay period and the final delay period).

These embodiments of the combined alkali metal hydroxide addition and converting agent delay method may be combined with any calcium base addition method and/or the addition of magnesium sulfonate (all at once, with a split magnesium sulfonate addition method, a magnesium sulfonate delayed method, or any combination thereof) and/or a facilitating acid delay method.

The preferred embodiments of the methods herein may occur in either an open or closed kettle as is commonly used for grease manufacturing. The conversion process can be achieved at normal atmospheric pressure or under pressure in a closed kettle. Manufacturing in open kettles (vessels not under pressure) is preferred since such grease manufacturing equipment is commonly available. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium magnesium sulfonate greases, as will be understood by those with ordinary skill in the art. Manufacturing in pressurized kettles may also be used and may result in even greater improvement in thickener yield, but the pressurized processes may be more complicated and difficult to control. Additionally, manufacturing calcium magnesium sulfonate greases in pressurized kettles may result in productivity issues. The use of pressurized reactions can be important for certain types of greases (such as polyurea greases) and most grease plants will only have a limited number of pressurized kettles available. Using a pressurized kettle to make calcium magnesium sulfonate greases, where pressurized reactions are not as important, may limit a plant's ability to make other greases where those reactions are important. These issues are avoided with open vessels.

The sulfonate-based grease compositions and methods for making such compositions according to various embodiments the invention are further described and explained in relation to the following examples. The overbased calcium sulfonate used in Examples 24, 27, 35, 38, and 41-48 was a good quality overbased calcium sulfonate. The overbased calcium sulfonate used in all other examples was a poor quality calcium sulfonate similar to that used in Examples 10 and 11 of the '406 patent.

Example 1—(Baseline Example—No Magnesium Sulfonate Addition, No Facilitating Acid Delay, Conventional Non-Aqueous Converting Agent Used)

A calcium sulfonate complex grease was made using a calcium hydroxyapatite composition as described in the '406 patent. No overbased magnesium sulfonate was added in this example. Additionally, neither the delayed non-aqueous converting agent method nor the alkali metal hydroxide addition method was used. This example is the same as Example 8 from the '473 application.

The grease was made as follows: 264.98 grams of 400 TBN overbased oil-soluble calcium sulfonate were added to an open mixing vessel followed by 378.68 grams of a solvent neutral group 1 paraffinic base oil having a viscosity of about 600 SUS at 100 F, and 11.10 grams of PAO having a viscosity of 4 cSt at 100 C. The 400 TBN overbased oil-soluble calcium sulfonate was a poor quality calcium sulfonate similar to the one previously described and used in Examples 10 and 11 of the '406 patent. Mixing without heat began using a planetary mixing paddle. Then 23.96 grams of a primarily C12 alkylbenzene sulfonic acid were added. After mixing for 20 minutes, 50.62 grams of calcium hydroxyapatite with a mean particle size below 5 microns and 3.68 grams of food grade purity calcium hydroxide having a mean particle size below 5 microns were added and allowed to mix in for 30 minutes. Then 0.84 grams of glacial acetic acid and 10.56 grams of 12-hydroxystearic acid were added and allowed to mix in for 10 minutes. Then 55.05 grams of finely divided calcium carbonate with a mean particle size below 5 microns were added and allowed to mix in for 5 minutes. Then 13.34 grams of hexylene glycol and 39.27 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Then 7.34 grams of the same calcium hydroxide were added and allowed to mix in for 10 minutes. Then 1.59 grams of glacial acetic acid were added followed by 27.22 grams of 12-hydroxystearic acid. After the 12-hyroxystearic acid melted and mixed into the grease, 9.37 grams of boric acid was mixed in 50 grams of hot water and the mixture was added to the grease.

Due to the heaviness of the grease, another 62.29 grams of the same paraffinic base oil were added. Then 17.99 grams of a 75% solution of phosphoric acid in water was added and allowed to mix in and react. Another 46.90 grams of paraffinic base oil were added. The mixture was then heated with an electric heating mantle while continuing to stir. When the grease reached 300 F, 22.17 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.30 grams of food grade anhydrous calcium sulfate having a mean particle size below 5 microns were added. When the temperature of the grease cooled to 200 F, 2.27 grams of an aryl amine antioxidant and 4.46 grams of a polyisobutylene polymer were added. An additional 55.77 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 281. The percent overbased oil-soluble calcium sulfonate in the final grease was 24.01%. The dropping point was >650 F.

Example 2—(Baseline Example—No Magnesium Sulfonate Addition, No Facilitating Acid Delay, Conventional Non-Aqueous Converting Agent Used, but Converting Agent Delay Method Used)

A calcium sulfonate complex grease was made using a calcium hydroxyapatite composition as described in the '406 patent and similar to Example 1, except that a delayed converting agent method, where there was a delay between the addition of water as a converting agent and the addition of a non-aqueous converting agent, as described in U.S. application Ser. No. 14/990,473 (incorporated herein by reference), was used. The addition of the hexylene glycol was delayed until the grease had been heated to about 190 F to 200 F and held at that temperature for 30 minutes. No overbased magnesium sulfonate was added to replace part of the overbased calcium sulfonate in this example. The alkali metal hydroxide addition method was not used. This example is the same as Example 9 from the '473 application.

The grease was made as follows: 264.04 grams of 400 TBN overbased oil-soluble calcium sulfonate were added to an open mixing vessel followed by 378.21 grams of a solvent neutral group 1 paraffinic base oil having a viscosity of about 600 SUS at 100 F, and 11.15 grams of PAO having a viscosity of 4 cSt at 100 C. The 400 TBN overbased oil-soluble calcium sulfonate was the same as what was used in the previous Example 1 grease, i.e., a poor quality calcium sulfonate similar to the one previously described and used in Examples 10 and 11 the '406 patent. Mixing without heat began using a planetary mixing paddle. Then 23.91 grams of a primarily C12 alkylbenzene sulfonic acid were added. After mixing for 20 minutes, 50.60 grams of calcium hydroxyapatite with a mean particle size below 5 microns and 3.61 grams of food grade purity calcium hydroxide having a mean particle size below 5 microns were added and allowed to mix in for 30 minutes. Then 0.83 grams of glacial acetic acid and 10.56 grams of 12-hydroxystearic acid were added and allowed to mix in for 10 minutes. Then 55.05 grams of finely divided calcium carbonate with a mean particle size below 5 microns were added and allowed to mix in for 5 minutes. Then 38.18 grams water was added. The mixture was heated until the temperature reached 190 F. This represents a converting agent temperature adjustment delay as described in the '473 application. The temperature was held between 190 F and 200 F for 30 minutes. This represents a converting agent holding delay as described in the '473 application. Then 13.31 grams of hexylene glycol was added. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. An additional 16 ml of water was added to replace water that had been lost due to evaporation. Then 7.39 grams of the same calcium hydroxide were added and allowed to mix in for 10 minutes. Then 1.65 grams of glacial acetic acid were added followed by 27.22 grams of 12-hydroxystearic acid. After the 12-hyroxystearic acid melted and mixed into the grease, an additional 54.58 grams of the same paraffinic base oil was added due to the grease becoming heavier. Then 9.36 grams of boric acid was mixed in 50 grams of hot water and the mixture was added to the grease.

Due to the heaviness of the grease, another 59.05 grams of the same paraffinic base oil were added. Then 18.50 grams of a 75% solution of phosphoric acid in water was added and allowed to mix in and react. Another 52.79 grams of paraffinic base oil were added. The mixture was then heated with an electric heating mantle while continuing to stir. When the grease reached 300 F, 22.25 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.15 grams of food grade anhydrous calcium sulfate having a mean particle size below 5 microns were added. When the temperature of the grease cooled to 200 F, 2.29 grams of an aryl amine antioxidant and 4.79 grams of a polyisobutylene polymer were added. An additional 108.11 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 272. The percent overbased oil-soluble calcium sulfonate in the final grease was 21.78%. The dropping point was >650 F. As can be seen, this grease had an improved thickener yield compared to the grease of Example 1. The greases of Examples 1 and 2 serve as baseline greases for subsequent grease examples that include overbased magnesium sulfonate.

Overbased Calcium Magnesium Sulfonate Grease Examples

Example 3—(Magnesium Sulfonate Addition)

A calcium magnesium sulfonate complex grease was made similar to the grease of Example 1. However, this grease included an overbased magnesium sulfonate. The weight/weight ratio of overbased calcium sulfonate to overbased magnesium sulfonate was about 90/10 (rounded to whole multiples of 10 for simplicity and clarity. This rounding is done in this and all subsequent examples except wherein the relative amount of the magnesium sulfonate is less than 10 parts per 100. In such cases, the rounding is to ratios such as 95/5 or 99/1 or 99.9/0.1). All the overbased magnesium sulfonate was added at the beginning before conversion began.

The grease was made as follows: 264.58 grams of 400 TBN overbased oil-soluble calcium sulfonate were added to an open mixing vessel followed by 358.85 grams of a solvent neutral group 1 paraffinic base oil having a viscosity of about 600 SUS at 100 F, and 11.08 grams of PAO having a viscosity of 4 cSt at 100 C. The 400 TBN overbased oil-soluble calcium sulfonate was a poor quality calcium sulfonate similar to the one previously described and used in Examples 10 and 11 of the '406 patent. Then 26.72 grams of a 400 TBN overbased magnesium sulfonate was added. Mixing without heat began using a planetary mixing paddle. Then 23.29 grams of a primarily C12 alkylbenzene sulfonic acid were added. After mixing for 20 minutes, 50.62 grams of calcium hydroxyapatite with a mean particle size below 5 microns and 3.68 grams of food grade purity calcium hydroxide having a mean particle size below 5 microns were added and allowed to mix in for 30 minutes. Then 0.92 grams of glacial acetic acid and 10.60 grams of 12-hydroxystearic acid were added and allowed to mix in for 10 minutes. Then 55.15 grams of finely divided calcium carbonate with a mean particle size below 5 microns were added and allowed to mix in for 5 minutes. Then 42.47 grams water were added to the mixture. This was followed by the addition of 14.61 grams of hexylene glycol. It was observed that before the hexylene glycol was added, the batch began to thicken.

The mixture was heated until the temperature reached 190 F-200 F. It was observed that as the batch was heated to the 190 F-200 F target range, the batch appeared to have taken on the appearance of a grease when the temperature reached 170 F. The temperature was held between 190 F and 200 F for about 60 minutes until Fourier Transform Infrared (FTIR) spectroscopy indicated that the conversion of the amorphous calcium carbonate to crystalline calcium carbonate (calcite) had occurred. During that time 20 ml water was added to replace water that was lost due to evaporation. Then 7.31 grams of the same calcium hydroxide were added and allowed to mix in for 10 minutes. Then 1.80 grams of glacial acetic acid were added followed by 27.12 grams of 12-hydroxystearic acid. The grease was mixed for 10 minutes until the 12-hyroxystearic acid melted and mixed into the grease. Then 9.36 grams of boric acid was mixed in 50 grams of hot water and the mixture was added to the grease. Then 17.60 grams of a 75% solution of phosphoric acid in water was added and allowed to mix in and react.

Due to the heaviness of the batch, another 52.19 grams of paraffinic base oil were added. This was followed by another 25.20 grams of the same base oil. The mixture was then heated with an electric heating mantle while continuing to stir. When the grease reached 300 F, 22.38 grams of a styrene-alkylene copolymer were added as a crumb-formed solid. The grease was further heated to about 398 F at which time all the polymer was melted and fully dissolved in the grease mixture. The heating mantle was removed and the grease was allowed to cool by continuing to stir in open air. When the grease cooled to 300 F, 33.00 grams of food grade anhydrous calcium sulfate having a mean particle size below 5 microns were added. When the temperature of the grease cooled to 170 F, another 28.59 grams of the same paraffinic base oil was added followed by 2.33 grams of an aryl amine antioxidant and 4.53 grams of a polyisobutylene polymer were added. Three more portions of the same paraffinic base oil totaling 109.24 grams were added. The grease was then removed from the mixer and given three passes through a three-roll mill to achieve a final smooth homogenous texture. The grease had a worked 60 stroke penetration of 287. The percent overbased oil-soluble calcium sulfonate in the final grease was 23.31%. The dropping point was >650 F. As can be seen, there was a slight improvement in thickener yield of this grease compared to the corresponding baseline grease of Example 1, where no overbased magnesium sulfonate was used.

Example 4—(Magnesium Sulfonate Addition and Converting Agent Delay Method)

Another calcium magnesium sulfonate complex grease was made similar to the grease of the previous Example 3 in that it included the same overbased magnesium sulfonate. The weight/weight ratio of overbased calcium sulfonate to overbased magnesium sulfonate was again about 90/10. However, this grease also used the same converting agent delay method used in Example 2. All the overbased magnesium sulfonate was added at the beginning before conversion began.

The grease was made as follows: 264.53 grams of 400 TBN overbased oil-soluble calcium sulfonate were added to an open mixing vessel followed by 364.22 grams of a solvent neutral group 1 paraffinic base oil having a viscosity of about 600 SUS at 100 F, and 11.32 grams of PAO having a viscosity of 4 cSt at 100 C. The 400 TBN overbased oil-soluble calcium sulfonate was again a poor quality calcium sulfonate. Then 26.99 grams of a 400 TBN overbased magnesium sulfonate was added. This was the same overbased magnesium sulfonate used in the previous Example 3 grease. Mixing without heat began using a planetary mixing paddle. Then 26.43 grams of a primarily C12 alkylbenzene sulfonic acid were added. After mixing for 20 minutes, 50.60 grams of calcium hydroxyapatite with a mean particle size below 5 microns and 3.65 grams of food grade purity calcium hydroxide having a mean particle size below 5 microns were added and allowed to mix in for 30 minutes. Then 0.94 grams of glacial acetic acid and 10.58 grams of 12-hydroxystearic acid were added and allowed to mix in for 10 minutes. Then 55.08 grams of finely divided calcium carbonate with a mean particle size below 5 microns were added and allowed to mix in for 5 minutes. Then 42.76 grams water were added to the mixture. The mixture was heated until the temperature reached 190 F-200 F (a converting agent temperature adjustment delay period). The batch was then mixed at this temperature range for 30 minutes (a converting agent holding delay period). This was followed by the addition of 15.25 grams of hexylene glycol. Within one minute of addition of the hexylene glycol, the batch began to visibly thicken. Within only a few minutes the batch had thickened to the point where 133.71 grams of the same paraffinic base oil was added.

The batch was then held between 190 F and 200 F for 30 minutes until Fourier Transform Infrared (FTIR) spectroscopy indicated that the conversion of the amorphous calcium carbonate to crystalline calcium carbonate (calcite) had occurred. During that time 25 ml water was added to replace water that was lost due to evaporation. Then 7.48 grams of the same calcium hydroxide were added and allowed to mix in for 10 minutes. Then 1.73 grams of glacial acetic acid were added followed by 27.18 grams of 12-hydroxystearic acid. The grease was mixed for 15 minutes until the 12-hydroxystearic acid melted and mixed into the grease. Then 9.35 grams of boric acid was mixed in 50 grams of hot water and the mixture was added to the grease.

Due to the increased heaviness of the batch, another 79.74 grams of the paraffinic base oil was added. Then 17.75 grams of a 75% solution of phosphoric acid in water was added and allowed to mix in and react. Due to the heaviness of the batch, another 106.98 grams of paraffinic base oil were added. The mixture was then heated with an electric heating mantle while continuing to stir. When the grease reached 300 F, 22.08 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.13 grams of food grade anhydrous calcium sulfate having a mean particle size below 5 microns were added. When the batch was cooled to 170 F, 2.35 grams of an aryl amine antioxidant and 4.63 grams of a polyisobutylene polymer were added. Another 36.34 grams of the same paraffinic base oil were added. The grease was then removed from the mixer and given three passes through a three-roll mill to achieve a final smooth homogenous texture. The grease had a worked 60 stroke penetration of 272. The percent overbased oil-soluble calcium sulfonate in the final grease was 20.16%. The dropping point was >650 F. As can be seen, this grease had an improved thickener yield compared to the corresponding baseline grease of Example 2 where the same converting agent delay method used but where no overbased magnesium sulfonate was used. In fact, this Example 4 grease had the best thickener yield of Examples 1-4. By comparing the improvement of Example 2 relative to Example 1 with the improvement of Example 4 relative to Example 3, it appears that the converting agent delay method works better when a highly overbased magnesium sulfonate is present than when only overbased calcium sulfonate is used.

Example 5—(Magnesium Sulfonate Addition and Converting Agent Delay Method)

Another calcium magnesium sulfonate complex grease was made similar to the grease of Example 4. The only significant difference was that the amount of overbased magnesium sulfonate was doubled so that the weight/weight ratio of overbased calcium sulfonate to overbased magnesium sulfonate was about 80/20. All the overbased magnesium sulfonate was added at the beginning before conversion began.

The grease was made as follows: 264.22 grams of 400 TBN overbased oil-soluble calcium sulfonate were added to an open mixing vessel followed by 364.22 grams of a solvent neutral group 1 paraffinic base oil having a viscosity of about 600 SUS at 100 F, and 11.22 grams of PAO having a viscosity of 4 cSt at 100 C. The 400 TBN overbased oil-soluble calcium sulfonate was a poor quality calcium sulfonate. Then 52.83 grams of a 400 TBN overbased magnesium sulfonate was added. This was the same overbased magnesium sulfonate used in the previous Example 4 grease. Mixing without heat began using a planetary mixing paddle. Then 26.69 grams of a primarily C12 alkylbenzene sulfonic acid were added. After mixing for 20 minutes, 50.61 grams of calcium hydroxyapatite with a mean particle size below 5 microns and 3.67 grams of food grade purity calcium hydroxide having a mean particle size below 5 microns were added and allowed to mix in for 30 minutes. Then 0.94 grams of glacial acetic acid and 10.57 grams of 12-hydroxystearic acid were added and allowed to mix in for 10 minutes. Then 55.12 grams of finely divided calcium carbonate with a mean particle size below 5 microns were added and allowed to mix in for 5 minutes. Then 42.22 grams water were added to the mixture. The mixture was heated until the temperature reached 190 F-200 F (a converting agent temperature adjustment delay period). The batch was then mixed at this temperature range for 30 minutes (a converting agent holding delay period). This was followed by the addition of 21.57 grams water and 14.63 grams of hexylene glycol. Within one minute of addition of the hexylene glycol, the batch began to visibly thicken. Within only a few minutes the batch had thickened to the point where 50.69 grams of the same paraffinic base oil was added.

The batch was then held between 190 F and 200 F for 45 minutes until Fourier Transform Infrared (FTIR) spectroscopy indicated that the conversion of the amorphous calcium carbonate to crystalline calcium carbonate (calcite) had occurred. During that time two portions of water totaling 50 ml was added to replace water that was lost due to evaporation. Then 7.34 grams of the same calcium hydroxide were added and allowed to mix in for 10 minutes. Then 1.72 grams of glacial acetic acid were added followed by 27.17 grams of 12-hydroxystearic acid. The grease was mixed for 15 minutes until the 12-hydroxystearic acid melted and mixed into the grease. An additional 50.55 grams of the same paraffinic base oil was added due to the grease continuing to thicken. Then 9.35 grams of boric acid was mixed in 50 grams of hot water and the mixture was added to the grease. Then 17.74 grams of a 75% solution of phosphoric acid in water was added and allowed to mix in and react. Due to the increased heaviness of the batch, another 57.23 grams of the paraffinic base oil was added. This was followed by the addition of another 27.12 grams of paraffinic base oil. The mixture was then heated with an electric heating mantle while continuing to stir. When the grease reached 300 F, 22.08 grams of a styrene-alkylene copolymer were added as a crumb-formed solid.

The grease was further heated to about 390 F at which time all the polymer was melted and fully dissolved in the grease mixture. The heating mantle was removed and the grease was allowed to cool by continuing to stir in open air. When the grease cooled to 300 F, 33.67 grams of food grade anhydrous calcium sulfate having a mean particle size below 5 microns were added. When the batch was cooled to 170 F, 2.67 grams of an aryl amine antioxidant and 4.68 grams of a polyisobutylene polymer were added. Another 99.56 grams of the same paraffinic base oil were added. The grease was then removed from the mixer and given three passes through a three-roll mill to achieve a final smooth homogenous texture. The grease had a worked 60 stroke penetration of 254. The percent overbased oil-soluble calcium sulfonate in the final grease was 21.25%. The dropping point was >650 F. Using the customary inverse linear relationship between worked penetration and percent overbased calcium sulfonate concentration, this example grease would have had a percent overbased calcium sulfonate concentration of 19.84% if additional base oil had been added to bring the worked penetration to the same value as the previous Example 4 grease. Therefore, the effect of doubling the amount of overbased magnesium sulfonate from a ratio of 90/10 to 80/20 was to slightly improve the thickener yield.

Example 6—(Magnesium Sulfonate Addition and Converting Agent Delay Method)

Another calcium magnesium sulfonate complex grease was made similar to the grease of Example 4. The only significant difference was that the amount of overbased magnesium sulfonate was increased so that the weight/weight ratio of overbased calcium sulfonate to overbased magnesium sulfonate was about 50/50. All the overbased magnesium sulfonate was added at the beginning before conversion began.

The grease was made as follows: 145.14 grams of 400 TBN overbased oil-soluble calcium sulfonate were added to an open mixing vessel followed by 364.13 grams of a solvent neutral group 1 paraffinic base oil having a viscosity of about 600 SUS at 100 F, and 11.35 grams of PAO having a viscosity of 4 cSt at 100 C. The 400 TBN overbased oil-soluble calcium sulfonate was a poor quality calcium sulfonate. Then 145.15 grams of a 400 TBN overbased magnesium sulfonate was added. This was the same overbased magnesium sulfonate used in the previous Example 4 grease. Mixing without heat began using a planetary mixing paddle. Then 26.45 grams of a primarily C12 alkylbenzene sulfonic acid were added. After mixing for 20 minutes, 50.61 grams of calcium hydroxyapatite with a mean particle size below 5 microns and 3.75 grams of food grade purity calcium hydroxide having a mean particle size below 5 microns were added and allowed to mix in for 30 minutes. Then 0.98 grams of glacial acetic acid and 10.62 grams of 12-hydroxystearic acid were added and allowed to mix in for 10 minutes. Then 55.13 grams of finely divided calcium carbonate with a mean particle size below 5 microns were added and allowed to mix in for 5 minutes.

Then 42.01 grams water were added to the mixture. The mixture was heated until the temperature reached 190 F-200 F (a converting agent temperature adjustment delay period). The batch was then mixed at this temperature range for 30 minutes (a converting agent holding delay period). Then 14.60 grams of hexylene glycol were added. Additional water was added as needed to replace water lost due to evaporation. However, after several hours the batch had not converted to a grease structure. It remained completely a liquid in appearance. The batch was terminated. Apparently, if too much overbased magnesium sulfonate relative to overbased calcium sulfonate is initially added, a stable grease structure will not form when made under open atmospheric conditions.

Example 7—(Magnesium Sulfonate Addition, Converting Agent Delay Method, and Alkali Metal Hydroxide Addition)

Another calcium magnesium sulfonate complex grease was made similar to the grease of Example 4. The weight/weight ratio of overbased calcium sulfonate to overbased magnesium sulfonate was about 90/10. However, in this grease both the converting agent delay and alkali metal hydroxide addition methods were used. The alkali metal hydroxide used was sodium hydroxide, and its concentration in the final grease was 0.04% (wt). It should be noted that for all greases prepared and discussed in this document, the concentration of the alkali metal hydroxide in the final grease is calculated based on the amount added as an ingredient and the weight of the final grease as if the hydroxide had not reacted. This is simply a convenient way of keeping track of the concentration of the alkali metal hydroxide, even though the strongly basic alkali metal hydroxide will fully react with a small portion of complexing acids to generate the corresponding alkali metal salt and the alkali metal hydroxide will not be present in the final grease product. All the overbased magnesium sulfonate was added at the beginning before conversion began.

The grease was made as follows: 264.22 grams of 400 TBN overbased oil-soluble calcium sulfonate were added to an open mixing vessel followed by 351.86 grams of a solvent neutral group 1 paraffinic base oil having a viscosity of about 600 SUS at 100 F, and 11.12 grams of PAO having a viscosity of 4 cSt at 100 C. The 400 TBN overbased oil-soluble calcium sulfonate was again a poor quality calcium sulfonate. Then 26.72 grams of a 400 TBN overbased magnesium sulfonate was added. This was the same overbased magnesium sulfonate used in the previous two example greases. Mixing without heat began using a planetary mixing paddle. Then 26.35 grams of a primarily C12 alkylbenzene sulfonic acid were added. After mixing for 20 minutes, 50.60 grams of calcium hydroxyapatite with a mean particle size below 5 microns and 3.66 grams of food grade purity calcium hydroxide having a mean particle size below 5 microns were added and allowed to mix in for 30 minutes Then 0.91 grams of glacial acetic acid and 10.56 grams of 12-hydroxystearic acid were added and allowed to mix in for 10 minutes. Then 50.65 grams of finely divided calcium carbonate with a mean particle size below 5 microns were added and allowed to mix in for 5 minutes. Then 0.45 grams of sodium hydroxide powder was dissolved in 42 grams water, and the solution was added to the batch. The mixture was heated until the temperature reached about 190 F-200 F. This represents a temperature adjustment delay. The batch had already begun to take on a somewhat grease-like consistency by the time the batch reached 200 F. Then, 20 ml water and 29.08 grams of hexylene glycol were added. It should be noted that the amount of non-aqueous converting agent (hexylene glycol) added to this batch is about twice the amount added in the previous Example 4. This is in accordance with what was disclosed in the application Ser. No. 15/130,422 wherein more of the non-aqueous converting agent is typically required when the alkali metal hydroxide technique is employed. It should also be noted that this grease had no holding delay, whereas the previous Example 4 grease had a 30 minute holding delay. Initially, the batch appeared to become thinner in consistency. However, after about 25 minutes, it began to thicken again as conversion visibly began. The batch was then held between 190 F and 200 F for about 30 minutes until Fourier Transform Infrared (FTIR) spectroscopy indicated that the conversion of the amorphous calcium carbonate to crystalline calcium carbonate (calcite) had occurred. Then 30 ml water was added to replace water that had been lost due to evaporation. Then 7.43 grams of the same calcium hydroxide were added and allowed to mix in for 10 minutes. Then 1.79 grams of glacial acetic acid were added followed by 27.43 grams of 12-hydroxystearic acid. The grease was mixed for 15 minutes until the 12-hydroxystearic acid melted and mixed into the grease. Then 9.35 grams of boric acid was mixed in 50 grams of hot water and the mixture was added to the grease. Due to the increased heaviness of the batch, another 64.65 grams of the paraffinic base oil was added. Then 17.65 grams of a 75% solution of phosphoric acid in water was added and allowed to mix in and react. The mixture was then heated with an electric heating mantle while continuing to stir. When the grease reached 300 F, 22.42 grams of a styrene-alkylene copolymer were added as a crumb-formed solid. The grease was further heated to about 390 F at which time all the polymer was melted and fully dissolved in the grease mixture. Unfortunately, the heating mantle was inadvertently turned to an excessively high setting during the heating to 390 F. The batch experienced significant localized heating in the bottom of the mixer resulting in obviously overheated grease. The heating mantle was removed and the grease was allowed to cool by continuing to stir in open air. When the grease cooled to 300 F, 33.27 grams of food grade anhydrous calcium sulfate having a mean particle size below 5 microns were added. When the batch was cooled to 170 F, 2.24 grams of an aryl amine antioxidant and 4.58 grams of a polyisobutylene polymer were added. Another 129.58 grams of the same paraffinic base oil were added. The grease was then removed from the mixer and given three passes through a three-roll mill to achieve a final smooth homogenous texture. The grease had a worked 60 stroke penetration of 282. The percent overbased oil-soluble calcium sulfonate in the final grease was 23.04%. The dropping point was >650 F. As can be seen, the thickener yield of this grease was not as good as the previous Example 4 grease where only the delayed non-aqueous converting agent technique was used. However, the overheating of this batch makes the comparison of it to previous example greases uncertain.

Example 8—(Magnesium Sulfonate Addition, Converting Agent Delay Method, and Alkali Metal Hydroxide Addition)

The grease of Example 7 was remade using the same composition and processing steps. However, the heating of the grease to its top temperature of 390 F was done in a more typical controlled way to avoid any localized overheating. The sodium hydroxide concentration in the final grease was 0.03% (wt). The final grease had a worked 60 stroke penetration of 291. The percent overbased oil-soluble calcium sulfonate in the final grease was 19.99%. The dropping point was >650 F. As can be seen, the thickener yield of this grease was much improved over the previous Example 7 grease. This confirmed that the overheating of that previous grease had damaged the thickener structure resulting in a loss of thickener yield. This Example 8 grease had a thickener yield superior to the greases of Examples 1-3, and comparable to the grease of Example 4. Thus the additional use of the alkali metal hydroxide technique did not appear to provide significant improved thickener yield in this grease compared to the Example 4 grease where only the delayed non-aqueous converting agent technique was used.

Example 9—(Magnesium Sulfonate Addition, Converting Agent Delay Method, and Alkali Metal Hydroxide Addition)

Another grease similar to the Example 8 grease was made. There was only one significant difference: after conversion was complete, this grease had the second portion of 12-hydroxystearic acid added before the second portion of calcium hydroxide was added. The sodium hydroxide concentration in the final grease was 0.04% (wt).

The grease was made as follows: 264.05 grams of 400 TBN overbased oil-soluble calcium sulfonate were added to an open mixing vessel followed by 359.76 grams of a solvent neutral group 1 paraffinic base oil having a viscosity of about 600 SUS at 100 F, and 11.02 grams of PAO having a viscosity of 4 cSt at 100 C. The 400 TBN overbased oil-soluble calcium sulfonate was a poor quality calcium sulfonate. Then 26.46 grams of a 400 TBN overbased magnesium sulfonate was added. This was the same overbased magnesium sulfonate used in the previous example greases. Mixing without heat began using a planetary mixing paddle. Then 26.34 grams of a primarily C12 alkylbenzene sulfonic acid were added. After mixing for 20 minutes, 50.67 grams of calcium hydroxyapatite with a mean particle size below 5 microns and 3.67 grams of food grade purity calcium hydroxide having a mean particle size below 5 microns were added and allowed to mix in for 30 minutes. Then 0.92 grams of glacial acetic acid and 10.60 grams of 12-hydroxystearic acid were added and allowed to mix in for 10 minutes. Then 55.08 grams of finely divided calcium carbonate with a mean particle size below 5 microns were added and allowed to mix in for 5 minutes. Then 0.44 grams of sodium hydroxide powder was dissolved in 42 grams water, and the solution was added to the batch. The mixture was heated until the temperature reached 190 F-200 F (a converting agent temperature adjustment delay period). Then, 29.05 grams of hexylene glycol were added. It should be noted that this grease had no converting agent holding delay period. Within 5 minutes of adding the hexylene glycol, the batch began to thicken as conversion visibly began. An additional 27.82 grams of the same paraffinic base oil was added. After 30 minutes, 30 ml water was added to replace water that had been lost due to evaporation.

The batch was then held between 190 F and 200 F for about 30 additional minutes until Fourier Transform Infrared (FTIR) spectroscopy indicated that the conversion of the amorphous calcium carbonate to crystalline calcium carbonate (calcite) had occurred. Then 20 ml water was added to replace water that had been lost due to evaporation. Then 1.75 grams of glacial acetic acid were added followed by 27.23 grams of 12-hydroxystearic acid. The grease was mixed for 15 minutes until the 12-hydroxystearic acid melted and mixed into the grease. Then 7.40 grams of the same calcium hydroxide were added and allowed to mix into the grease. Due to the heaviness of the batch, another 51.56 grams of the same paraffinic base oil was added. Then 9.34 grams of boric acid was mixed in 50 grams of hot water and the mixture was added to the grease. Due to the increased heaviness of the batch, another 24.76 grams of the paraffinic base oil was added. Then 17.61 grams of a 75% solution of phosphoric acid in water was added and allowed to mix in and react. The mixture was then heated with an electric heating mantle while continuing to stir. When the grease reached 300 F, 22.19 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air.

When the grease cooled to 300 F, 33.47 grams of food grade anhydrous calcium sulfate having a mean particle size below 5 microns were added. When the batch was cooled to 170 F, 2.32 grams of an aryl amine antioxidant and 4.89 grams of a polyisobutylene polymer were added. Another 185.91 grams of the same paraffinic base oil were added. The grease was then removed from the mixer and given three passes through a three-roll mill to achieve a final smooth homogenous texture. The grease had a worked 60 stroke penetration of 282. The percent overbased oil-soluble calcium sulfonate in the final grease was 21.48%. The dropping point was >650 F. As can be seen, the thickener yield of this grease was not quite as good as the previous Example 8 grease. This shows that for best results, it may be preferred to have sufficient hydroxide basicity present when adding the second portion of complexing acids after conversion is complete. The results of Examples 1-9 are summarized in Table 4 below. The amounts of overbased calcium sulfonate indicated in parenthesis are the amounts of overbased calcium sulfonate estimated when additional base oil is added to dilute the sample grease to achieve the same penetration as in the example number indicated after the dash, and as described above. When a holding delay was employed, the number in parentheses is the duration of the holding delay in hours. All temperatures are understood to be in degrees Fahrenheit.

TABLE 4

Summary of Examples 1-9

| EX | Ratio of Cal. Sulfonate to Mag. Sulfonate | Converting Agent Delay Method | Alkali Metal Hydroxide Addition | Overbased Calcium Sulfonate % | 60 Stroke Pen. | DP (F) |
|---|---|---|---|---|---|---|
| 1 | NA - no Mag. Sulfonate | No | No | 24.01 | 281 | >650 |
| 2 | NA - no Mag. Sulfonate | First Temp Adj (190-200); First Holding Delay (.5) | No | 21.78 | 272 | >650 |
| 3 | 90/10 | No | No | 23.31 | 287 | >650 |
| 4 | 90/10 | First Temp Adj (190-200); First Holding Delay (.5) | No | 20.16 | 272 | >650 |
| 5 | 80/20 | First Temp Adj (190-200); First Holding Delay (.5) | No | 21.25 (19.84 - Ex 4) | 254 | >650 |
| 6 | 50/50 | First Temp Adj (190-200); First Holding Delay (.5) | No | NA - no grease formed | NA - no grease formed | NA - no grease formed |
| 7 | 90/10 | First Temp Adj (190-200) | Sodium Hydroxide, 0.04% | 23.04 Note: This Example had a heating issue | 282 | >650 |
| 8 | 90/10 | First Temp Adj (190-200) | Sodium Hydroxide, 0.04% | 19.99 | 291 | >650 |
| 9 | 90/10 | First Temp Adj (190-200) | Sodium Hydroxide, 0.04% | 21.48 | 282 | >650 |

Examples 10-13—(Magnesium Sulfonate Addition, Converting Agent Delay Method, and Alkali Metal Hydroxide Addition)

A series of four greases were made similar to the previous Example 8 wherein both the converting agent delay method and alkali metal hydroxide addition method were used. However, instead of sodium hydroxide, powdered lithium hydroxide monohydrate was used at varying concentrations. Final concentrations of the lithium hydroxide was determined as the anhydrous form. Results for these four greases are provided in Table 5.

TABLE 5

Summary of Examples 10-13

| | Example | | | |
|---|---|---|---|---|
| | 10 | 11 | 12 | 13 |
| % Overbased Calcium Sulfonate | 20.68 | 20.75 | 20.8 | 19.98 |
| % Overbased Magnesium Sulfonate | 2.08 | 2.07 | 2.09 | 2.02 |
| Ratio of Ca Sulfonate to Mg Sulfonate | 90/10 | 90/10 | 90/10 | 90/10 |
| Converting Agent Delay Method Used | Yes | Yes | Yes | Yes |
| Converting Agent Holding Delay Temperature, F. | 190-200 | 190-200 | 190-200 | 190-200 |
| Converting Agent Holding Delay Time, minutes | 30 | 30 | 30 | 30 |
| Alkali Metal Hydroxide Added | Yes - Lithium Hydroxide | Yes - Lithium Hydroxide | Yes - Lithium Hydroxide | Yes - Lithium Hydroxide |
| Concentration of MOH based on Weight of Final Grease | 0.03 | 0.07 | 0.02 | 0.10 |
| Worked Penetration | 271 | 283 | 287 | 273 |
| Dropping Point, F. | >650 | >650 | >650 | >650 |
| Four Ball EP, Weld Load, kg | 800 | 620 | 620 | 800 |
| Four Ball Wear | ND | 0.42 | 0.45 | 0.43 |
| Roll Stability at 25 C., 2 hrs: | | | | |
| Initial worked Penetration | 271 | 279 | 287 | 273 |
| Final Worked Penetration | 275 | 277 | 285 | 279 |
| % Change | 1.5 | −0.7 | −0.7 | 2.2 |
| Roll Stability at 150 C., 2 hrs: | | | | |
| Initial worked Penetration | 271 | 279 | 287 | 273 |
| Final Worked Penetration | 283 | 265 | 275 | 281 |
| % Change | 4.4 | −5.0 | −4.2 | 2.9 |

By comparing the test results in Table 5 to the results of Examples 3, 4, and 8 (Table 4), it appears that: (1) lithium seems to provide the same effect on thickener yield as sodium hydroxide; (2) the effect of the lithium hydroxide seems essentially the same regardless of the concentration range spanned in these samples, i.e. 0.02% (wt) to 0.10% (wt); (3) the use of both the converting agent delay method and alkali metal hydroxide addition method provide about the same thickener yield benefit as the use of the converting agent delay method alone (as previously noted in comparing the greases of Examples 8 and 4 where sodium hydroxide was used). Nonetheless, excellent thickener yields are consistently provided when using both the converting agent delay method and alkali metal hydroxide addition method in making calcium magnesium sulfonate complex greases as provided in these examples. Excellent extreme pressure and anti-wear properties are also provided. The shear stability of these calcium magnesium sulfonate complex greases, as measured by the roll stability test, are also excellent, regardless of whether the shearing was done at ambient temperature or at much a higher temperature.

Example 14—(Magnesium Sulfonate Addition, Converting Agent Delay Method, and Alkali Metal Hydroxide Addition)

Another grease was made similar to the previous Example 13 grease. However, the amount of overbased magnesium sulfonate was increased so that the weight/weight ratio of overbased calcium sulfonate to overbased magnesium sulfonate was about 70/30. The concentration of lithium hydroxide in the final grease was 0.13% (wt). All the overbased magnesium sulfonate was added at the beginning before conversion began.

The grease was made as follows: 264.27 grams of 400 TBN overbased oil-soluble calcium sulfonate were added to an open mixing vessel followed by 351.86 grams of a solvent neutral group 1 paraffinic base oil having a viscosity of about 600 SUS at 100 F, and 11.16 grams of PAO having a viscosity of 4 cSt at 100 C. The 400 TBN overbased oil-soluble calcium sulfonate was a poor quality calcium sulfonate. Then 113.22 grams of a 400 TBN overbased magnesium sulfonate was added. This was the same overbased magnesium sulfonate used in the previous example greases. Mixing without heat began using a planetary mixing paddle. After 15 minutes, 26.34 grams of a primarily C12 alkylbenzene sulfonic acid were added. After mixing for 20 minutes, 50.61 grams of calcium hydroxyapatite with a mean particle size below 5 microns and 3.65 grams of food grade purity calcium hydroxide having a mean particle size below 5 microns were added and allowed to mix in for 30 minutes. Then 0.93 grams of glacial acetic acid and 10.57 grams of 12-hydroxystearic acid were added and allowed to mix in for 10 minutes. Then 50.00 grams of finely divided calcium carbonate with a mean particle size below 5 microns were added and allowed to mix in for 5 minutes. Then 1.32 grams of lithium hydroxide monohydrate powder was dissolved in 42 grams water, and the solution was added to the batch. The mixture was heated until the temperature reached 190 F-200 F (a converting agent temperature adjustment delay period). The batch was mixed at this temperature for 30 minutes (a converting agent holding delay period). Then, 10 ml water and 29.07 grams of hexylene glycol were added.

After 35 minutes, 20 ml water was added to replace water that was lost due to evaporation. Fourier Transform Infrared (FTIR) spectroscopy indicated that the conversion of the amorphous calcium carbonate to crystalline calcium carbonate (calcite) had only partially occurred. After another 10 minutes, 10 ml water and another 15.15 grams of hexylene glycol was added. FTIR showed that conversion had progressed but was still not complete. After another 35 minutes, 30 ml water and 15.23 grams hexylene glycol was added. Over the next three hours, an additional 50 ml water was added as conversion only slowly progressed. The batch was stopped and allowed to cool overnight. The next morning the batch was mixed and heated back to 190 F-200 F. Over the next two hours an additional 90 ml water was added to the batch. Then FTIR showed that all the amorphous calcium carbonate had been converted to a crystalline form. A 7.35 gram portion of the same calcium hydroxide were added and allowed to mix in for about 10 minutes. Then 1.79 grams of glacial acetic acid were added followed by 27.21 grams of 12-hydroxystearic acid. The grease was mixed for 15 minutes until the 12-hydroxystearic acid melted and mixed into the grease. Then 9.35 grams of boric acid was mixed in 50 grams of hot water and the mixture was added to the grease. Then 17.63 grams of a 75% solution of phosphoric acid in water was added and allowed to mix in and react.

The mixture was then heated with an electric heating mantle while continuing to stir. When the grease reached 300 F, 22.25 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.11 grams of food grade anhydrous calcium sulfate having a mean particle size below 5 microns were added. When the batch was cooled to 170 F, 2.80 grams of an aryl amine antioxidant and 4.68 grams of a polyisobutylene polymer were added. Another 20.02 grams of the same paraffinic base oil were added. The grease was then removed from the mixer and given three passes through a three-roll mill to achieve a final smooth homogenous texture.

The grease had a worked 60 stroke penetration of 287. The percent overbased oil-soluble calcium sulfonate in the final grease was 25.64%. The dropping point was 637 F. Roll Stability testing at 25 C and 150 C (for the usual 2 hour duration) gave a worked penetration change of −2.1% and −4.2%, respectively. The Four Ball Wear scar was 0.44 mm. As can be seen, the thickener yield of this grease was not as good as the previous four greases where lithium hydroxide was used. The extremely long conversion time for this grease appears to indicate that the much higher relative amount of overbased magnesium sulfonate had a detrimental effect on the conversion process. However, this did not seem to have a significant detrimental effect on the shear stability or anti-wear properties of the grease as indicated by the data in Table 6 below. An important question raised by this example is whether the long and apparently inferior conversion process is caused by the total amount of overbased magnesium sulfonate irrespective of when it is added, or is it caused only by the amount of overbased sulfonate present during conversion. The next example was designed to address that question.

Example 15—(Magnesium Sulfonate Split Addition, Converting Agent Delay Method, and Alkali Metal Hydroxide Addition)

A grease was made similar to the previous Example 14 grease with the one significant difference being that a split overbased magnesium sulfonate addition method was used. Specifically, this grease had only 23.3% of the total overbased magnesium sulfonate added at the beginning before conversion. The remaining overbased magnesium sulfonate was added after conversion, specifically after the batch had reached top processing temperature and was then cooled to about 250 F. This resulted in the initial ratio of overbased calcium sulfonate to overbased magnesium sulfonate to be about 90/10, i.e., the same value as Examples 3-4 and 7-13. Like Examples 10-13, this grease used both the converting agent delay and the alkali metal hydroxide addition methods. The concentration of lithium hydroxide in the final grease was 0.11% (wt).

The grease was made as follows: 264.20 grams of 400 TBN overbased oil-soluble calcium sulfonate were added to an open mixing vessel followed by 348.22 grams of a solvent neutral group 1 paraffinic base oil having a viscosity of about 600 SUS at 100 F, and 11.65 grams of PAO having a viscosity of 4 cSt at 100 C. The 400 TBN overbased oil-soluble calcium sulfonate was a poor quality calcium sulfonate. Then 27.01 grams of a 400 TBN overbased magnesium sulfonate was added (a first portion of magnesium sulfonate added prior to conversion). This was the same overbased magnesium sulfonate used in the previous example greases. Mixing without heat began using a planetary mixing paddle. After 15 minutes, 26.56 grams of a primarily C12 alkylbenzene sulfonic acid were added. After mixing for 20 minutes, 50.64 grams of calcium hydroxyapatite with a mean particle size below 5 microns and 3.68 grams of food grade purity calcium hydroxide having a mean particle size below 5 microns were added and allowed to mix in for 30 minutes. Then 0.91 grams of glacial acetic acid and 10.61 grams of 12-hydroxystearic acid were added and allowed to mix in for 10 minutes. Then 55.09 grams of finely divided calcium carbonate with a mean particle size below 5 microns were added and allowed to mix in for 5 minutes. Then 1.32 grams of lithium hydroxide monohydrate powder was dissolved in 42.19 grams water, and the solution was added to the batch. The mixture was heated until the temperature reached 190 F-200 F (a converting agent temperature adjustment delay period). The batch was mixed at this temperature for 30 minutes (a converting agent holding delay period). Then, 30 ml water and 29.28 grams of hexylene glycol were added.

After 20 minutes, the batch began to visibly thicken. During the next 45 minutes an additional 70 ml water was added to replace water lost due to evaporation. Fourier Transform Infrared (FTIR) spectroscopy then indicated that the conversion of the amorphous calcium carbonate to crystalline calcium carbonate (calcite) had occurred. A 7.44 gram portion of the same calcium hydroxide were added and allowed to mix in for about 10 minutes. Then 1.74 grams of glacial acetic acid were added followed by 27.14 grams of 12-hydroxystearic acid. The grease was mixed for 15 minutes until the 12-hydroxystearic acid melted and mixed into the grease. During that time, 40.79 grams of the same paraffinic base oil was added as the grease continued to become heavier. Then 9.35 grams of boric acid was mixed in 50 grams of hot water and the mixture was added to the grease. Then 17.72 grams of a 75% solution of phosphoric acid in water was added and allowed to mix in and react. An additional 22.76 grams of the same paraffinic base oil was added. The mixture was then heated with an electric heating mantle while continuing to stir. When the grease reached 300 F, 22.22 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.35 grams of food grade anhydrous calcium sulfate having a mean particle size below 5 microns were added.

When the batch had cooled to 200 F, 86.56 grams of the same overbased magnesium sulfonate was added (a second portion of magnesium sulfonate added after conversion). When the batch was cooled to 170 F, 2.50 grams of an aryl amine antioxidant and 4.85 grams of a polyisobutylene polymer were added. Another 102.08 grams of the same paraffinic base oil were added. The grease was then removed from the mixer and given three passes through a three-roll mill to achieve a final smooth homogenous texture. The grease had a worked 60 stroke penetration of 267. The percent overbased oil-soluble calcium sulfonate in the final grease was 21.88%. The dropping point was 595 F.

Example 16—(Magnesium Sulfonate Split Addition, Converting Agent Delay Method, and Alkali Metal Hydroxide Addition)

Another grease was made essentially the same as the previous Example 15 grease. Once again a split overbased magnesium sulfonate addition method was used. The only significant difference was when the second portion of the overbased magnesium sulfonate was added. In this grease, the second portion of overbased magnesium sulfonate was added after conversion, after reaction of all remaining complexing acids, but just before heating the batch to its top processing temperature of 390 F. After being given three passes through a three-roll mill, the final grease had a worked 60 stroke penetration of 275. The percent overbased oil-soluble calcium sulfonate in the final grease was 20.68%. The dropping point was 637 F. Test results for Examples 13-16 are summarized below in Table 6.

TABLE 6

Summary of Examples 13-16

| | Example | | | |
|---|---|---|---|---|
| | 13 | 14 | 15 | 16 |
| % Overbased Calcium Sulfonate | 19.98 | 25.64 | 21.88 | 20.68 |
| % Overbased Magnesium Sulfonate | 2.02 | 10.99 | 9.4 | 8.87 |
| Ratio of Ca Sulfonate to Mg Sulfonate in Final Grease | 90/10 | 70/30 | 70/30 | 70/30 |
| Ratio of Ca Sulfonate to Mg Sulfonate in Pre-Conversion Grease | 90/10 | 70/30 | 90/10 | 90/10 |
| Converting Agent Delay Method Used | Yes | Yes | Yes | Yes |
| Converting Agent Holding Delay Temperature, F. | 190-200 | 190-200 | 190-200 | 190-200 |
| Converting Agent Holding Delay Time, minutes | 30 | 30 | 30 | 30 |
| Alkali Metal Hydroxide Added | Yes - Lithium Hydroxide | Yes - Lithium Hydroxide | Yes - Lithium Hydroxide | Yes - Lithium Hydroxide |
| Concentration of MOH based on Weight of Final Grease | 0.10 | 0.13 | 0.11 | 0.10 |

TABLE 6-continued

| Summary of Examples 13-16 | | | | |
|---|---|---|---|---|
| | Example | | | |
| | 13 | 14 | 15 | 16 |
| Worked Penetration | 273 | 287 | 267 | 275 |
| Dropping Point, F. | >650 | 637 | 595 | 637 |
| Four Ball EP, Weld Load, kg | 800 | 800 | 620 | 620 |
| Four Ball Wear | 0.43 | 0.42 | 0.48 | 0.40 |
| Cone Oil Separation, 100 C. 24 hrs, % | ND | ND | 0.8 | 0.4 |
| Cone Oil Separation, 150 C., 24 hrs, % | ND | ND | 3.6 | 2.7 |
| Roll Stability at 25 C., 2 hrs: | | | | |
| Initial worked Penetration | 273 | 287 | 257 | 269 |
| Final Worked Penetration | 279 | 281 | 261 | 285 |
| % Change | 2.2 | −2.1 | 1.6 | 5.9 |
| Dropping Pt after Test, F | ND | ND | 634 | >650 |
| Roll Stability at 150 C., 2 hrs: | | | | |
| Initial worked Penetration | 273 | 287 | 257 | 269 |
| Final Worked Penetration | 281 | 275 | 267 | 279 |
| % Change | 2.9 | −4.2 | 3.9 | 3.7 |
| Dropping Point after Test, F. | ND | ND | 627 | 644 |

As can be seen, it is the ratio of overbased calcium sulfonate to magnesium sulfonate present during the conversion process that is an important factor relating to thickener yield. Providing additional overbased magnesium sulfonate to the grease after conversion is complete has minimal positive effect on thickener yield compared to providing that additional amount before conversion. Other test properties of all four greases are excellent. Although the dropping point of the Example 15 grease was lower than the other three greases in Table 6, it was nonetheless well above the minimum desirable value of 575 F. Also, the dropping point after the two roll stability tests actually improved for the Example 15 grease. This may indicate that the grease may actually improve in its structural stability under actual usage conditions of shearing over a wide temperature range.

Example 17—(Magnesium Sulfonate Addition, Converting Agent Delay Method, and Alkali Metal Hydroxide Addition)

Another grease was made that was similar to the grease of Example 13. The only significant difference was that this grease had the amount of overbased magnesium sulfonate decreased so that the ratio of overbased calcium sulfonate to overbased magnesium sulfonate is about 99/1. The concentration of lithium hydroxide in the final grease was 0.11%. All the overbased magnesium sulfonate was added at the beginning before conversion began (no split addition method used).

The grease was made as follows: 264.49 grams of 400 TBN overbased oil-soluble calcium sulfonate were added to an open mixing vessel followed by 384.82 grams of a solvent neutral group 1 paraffinic base oil having a viscosity of about 600 SUS at 100 F, and 11.15 grams of PAO having a viscosity of 4 cSt at 100 C. The 400 TBN overbased oil-soluble calcium sulfonate was a poor quality calcium sulfonate. Then 2.73 grams of a 400 TBN overbased magnesium sulfonate was added. This was the same overbased magnesium sulfonate used in the previous example greases. Mixing without heat began using a planetary mixing paddle. After 15 minutes, 27.62 grams of a primarily C12 alkylbenzene sulfonic acid were added. After mixing for 20 minutes, 50.62 grams of calcium hydroxyapatite with a mean particle size below 5 microns and 3.60 grams of food grade purity calcium hydroxide having a mean particle size below 5 microns were added and allowed to mix in for 30 minutes. Then 0.92 grams of glacial acetic acid and 10.65 grams of 12-hydroxystearic acid were added and allowed to mix in for 10 minutes. Then 50.00 grams of finely divided calcium carbonate with a mean particle size below 5 microns were added and allowed to mix in for 5 minutes. Then 1.32 grams of lithium hydroxide monohydrate powder was dissolved in 42.25 grams water, and the solution was added to the batch. The mixture was heated until the temperature reached 190 F-200 F (a converting agent temperature adjustment delay period). The batch was mixed at this temperature for 30 minutes (a converting agent holding delay period). Then 29.34 grams of hexylene glycol were added.

For the next four hours the batch was held at 190 F-200 F with seven different additions of water totaling 190 ml being added to replace water that was lost due to evaporation. Fourier Transform Infrared (FTIR) spectroscopy indicated that the conversion of the amorphous calcium carbonate to crystalline calcium carbonate (calcite) had only partially occurred. The batch was stopped and allowed to cool overnight. The next morning the batch was mixed and heated back to 190 F-200 F. Over the hours an additional 60 ml water was added to the batch. Then FTIR showed that all the amorphous calcium carbonate had been converted to a crystalline form, and the mixture had become a grease. A 7.89 gram portion of the same calcium hydroxide were added and allowed to mix in for about 10 minutes. Then 1.72 grams of glacial acetic acid were added followed by 27.08 grams of 12-hydroxystearic acid. The grease was mixed for 15 minutes until the 12-hydroxystearic acid melted and mixed into the grease. Another 104.50 grams of the same paraffinic base oil was added as the batch had continued to thicken. Then boric acid in water was added. The target amount of boric acid to be added was about 9.35 grams. However, an error in weighing occurred, and only 2.65 grams of boric acid was added. The 2.65 grams of boric acid was mixed in 50 grams of hot water and the mixture was added to the grease. Then 18.01 grams of a 75% solution of phosphoric acid in water was added and allowed to mix in and react.

The mixture was then heated with an electric heating mantle while continuing to stir. When the grease reached 300 F, 22.08 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.49 grams of food grade anhydrous calcium sulfate having a mean particle size below 5 microns were added. When the batch was cooled to 170 F, 2.33 grams of an aryl amine antioxidant and 5.19 grams of a polyisobutylene polymer were added. Another 94.36 grams of the same paraffinic base oil were added. The grease was then removed from the mixer and given three passes through a three-roll mill to achieve a final smooth homogenous texture. The grease had a worked 60 stroke penetration of 261. The percent overbased oil-soluble calcium sulfonate in the final grease was 22.76%. The dropping point was 646 F.

Example 18—(Magnesium Sulfonate Addition and Converting Agent Delay Method)

Another grease was made using essentially the same component amounts and processing conditions. There were only three significant differences between this grease and the Example 17 grease: (1) an alkali metal hydroxide method was not used; (2) the correct target amount of boric acid, 9.35 grams, was added after conversion; (3) the batch was inadvertently overheated to 440 F. This batch behaved much differently than the previous batch. Instead of conversion to a grease taking about 6 hours, it took less than two hours. The final milled grease had a worked 60 stroke penetration of 263. The percent overbased oil-soluble calcium sulfonate in the final grease was 21.57%. The dropping point was 647 F.

Example 19—(Magnesium Sulfonate Addition and Converting Agent Delay Method)

Due to the significant overheating of the previous Example 18 grease, the same grease was made again with care taken to avoid any overheating. This batch began to visibly convert in 25 minutes. The final milled grease had a worked 60 stroke penetration of 273. The percent overbased oil-soluble calcium sulfonate in the final grease was 20.84%. The dropping point was >650 F. Roll Stability testing at 25 C and 150 C (for the usual 2 hour duration) gave a worked penetration change of 0.7% and 4.2%, respectively. The Four Ball Wear scar was 0.47 mm. Cone oil separation (24 hr, 100 C) was 0.7%; cone oil separation (24 hr, 150 C) was 4.2%.

As can be seen from the previous three examples, the beneficial effect of overbased magnesium sulfonate is preserved even when only present at only 1% of the total overbased sulfonate (calcium and magnesium). It also appears that when the initial concentration of overbased magnesium sulfonate is too low, the use of the alkali metal hydroxide technique may slow the conversion process and decrease thickener yield. As such, if an alkali metal hydroxide it added, it is preferred that the ratio of overbased calcium sulfonate to overbased magnesium sulfonate be at least _95/5 and more preferably at least _90/10 A summary of Example 17-19 is included in Table 7 below. Holding delay duration is in hours. All temperature values are in degrees Fahrenheit.

TABLE 7

Summary of Examples 17-19

| Example | Ratio of Cal. Sulf. to Mag. Sulf. | Delay Non-Aq. Converting Agent | Alkali Metal Hydroxide | Overbased Calcium Sulfonate % | 60 Stroke Pen. | DP (F) |
|---|---|---|---|---|---|---|
| 17 | 99/1 | First Temp Adj (190-200); First Holding Delay (.5) | Lithium Hydroxide 0.11% | 22.76 | 261 | 646 |
| 18 | 99/1 | First Temp Adj (190-200); First Holding Delay (.5) | No | 21.57 | 263 | 647 |
| 19 | 99/1 | First Temp Adj (190-200); First Holding Delay (.5) | No | 20.84 | 273 | >650 |

Example 20—(Magnesium Sulfonate Addition, Higher TBN Sulfonate, and Converting Agent Delay Method)

All previous example greases have used a 400 TBN overbased calcium sulfonate. In this example, a calcium magnesium sulfonate complex grease was made using a 500

TBN overbased calcium sulfonate. It is not known whether this overbased calcium sulfonate would be considered of good or bad quality. The converting agent delay method was used, but no alkali metal hydroxide was added. The ratio of overbased calcium sulfonate to overbased magnesium sulfonate was about 90/10. All the overbased magnesium sulfonate was added at the beginning before conversion began.

The grease was made as follows: 360.36 grams of 500 TBN overbased oil-soluble calcium sulfonate were added to an open mixing vessel followed by 488.09 grams of a solvent neutral group 1 paraffinic base oil having a viscosity of about 600 SUS at 100 F, and 16.54 grams of PAO having a viscosity of 4 cSt at 100 C. Then 36.03 grams of a 500 TBN overbased magnesium sulfonate was added. This was the same overbased magnesium sulfonate used in the previous example greases. Mixing without heat began using a planetary mixing paddle. After 15 minutes, 36.00 grams of a primarily C12 alkylbenzene sulfonic acid were added. The batch was mixed for 20 minutes. Then 69.15 grams of calcium hydroxyapatite with a mean particle size below 5 microns and 4.97 grams of food grade purity calcium hydroxide having a mean particle size below 5 microns were added and allowed to mix in for 30 minutes. Then 1.26 grams of glacial acetic acid and 14.41 grams of 12-hydroxystearic acid were added and allowed to mix in for 10 minutes. Then 75.24 grams of finely divided calcium carbonate with a mean particle size below 5 microns were added and allowed to mix in for 5 minutes. Then 60.98 grams water was added, and the mixture was heated until the temperature reached 190 F-200 F (a converting agent temperature adjustment delay). The batch was mixed at this temperature for 30 minutes (a converting agent holding delay).

Then, 20 ml water and 20.21 grams of hexylene glycol were added. After 45 minutes, the batch began to visibly thicken. During the next 45 minutes an additional 30 ml water was added to replace water lost due to evaporation. Fourier Transform Infrared (FTIR) spectroscopy then indicated that the conversion of the amorphous calcium carbonate to crystalline calcium carbonate (calcite) had occurred. A 10.08 gram portion of the same calcium hydroxide were added and allowed to mix in for about 10 minutes. Then 2.34 grams of glacial acetic acid were added followed by 37.09 grams of 12-hydroxystearic acid. The grease was mixed for 15 minutes until the 12-hydroxystearic acid melted and mixed into the grease. Then 12.75 grams of boric acid was mixed in 50 grams of hot water and the mixture was added to the grease. Then 24.09 grams of a 75% solution of phosphoric acid in water was added and allowed to mix in and react. The mixture was then heated with an electric heating mantle while continuing to stir. When the grease reached 300 F, 30.17 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air.

When the grease cooled to 300 F, 45.35 grams of food grade anhydrous calcium sulfate having a mean particle size below 5 microns were added. When the batch was cooled to 170 F, 3.66 grams of an aryl amine antioxidant and 11.40 grams of a polyisobutylene polymer were added. The grease was then removed from the mixer and given three passes through a three-roll mill to achieve a final smooth homogenous texture. The grease had a worked 60 stroke penetration of 275. The percent overbased oil-soluble calcium sulfonate in the final grease was 27.74%. The dropping point was >650 F. As can be seen by comparison, the thickener yield of this grease was not as good as the previous example greases wherein the ratio of overbased calcium sulfonate to overbased magnesium sulfonate was about 90/10. Nonetheless, the thickener yield is still a significant improvement of many prior art compositions and methods requiring at least 36% overbased calcium sulfonate. The dropping point of this Example 23 grease was excellent. This example shows that overbased calcium sulfonates with TBN values higher than 400 can be used to make calcium/magnesium sulfonate greases. It also shows that higher TBN values for an overbased calcium sulfonate do not necessarily translate to higher thickener yields for calcium sulfonate greases.

Examples 21-24 (Magnesium Sulfonate Addition and Converting Agent Delay Method)

Four calcium-magnesium sulfonate complex greases were made similar to the grease of Example 4. In the first three of these greases, Examples 21-23, the only significant difference was the source of the 400 TBN overbased magnesium sulfonate that was used. In all the previous example greases where a 400 TBN overbased magnesium sulfonate was used, the same magnesium sulfonate from the same source was used and is referred to herein as overbased magnesium sulfonate "A." In each of the first three of these next greases, a different 400 TBN overbased magnesium sulfonate from a different source was use, referred to herein as overbased magnesium sulfonates "B," "C," and "D, respectively." For the grease of Example 24, the 400 TBN overbased calcium sulfonate was a good quality calcium sulfonate as described in the '406 patent. Example 24 also used overbased magnesium sulfonate D. Table 8 provides a summary of compositional information and test data for the next four greases along with the grease of Example 4 for comparison.

TABLE 8

Summary of Examples 21-24

| | Example | | | | |
|---|---|---|---|---|---|
| | 4 | 21 | 22 | 23 | 24 |
| % Overbased Calcium Sulfonate | 20.16 | 22.72 | 21.64 | 20.34 | 20.99 |
| % Overbased Magnesium Sulfonate | 2.06 | 2.46 | 2.19 | 2.20 | 2.12 |
| Quality of Overbased Cal. Sulfonate | Poor | Poor | Poor | Poor | Good |
| Source of Overbased Mag. Sulfonate | A | B | C | D | D |
| Ratio of Ca Sulfonate to Mg Sulfonate in Final Grease | 90/10 | 90/10 | 90/10 | 90/10 | 90/10 |
| Ratio of Ca Sulfonate to Mg Sulfonate in Pre-Conversion Grease | 90/10 | 90/10 | 90/10 | 90/10 | 90/10 |
| Converting Agent Delay Method Used | Yes | Yes | Yes | Yes | Yes |

TABLE 8-continued

| Summary of Examples 21-24 | | | | | |
|---|---|---|---|---|---|
| | Example | | | | |
| | 4 | 21 | 22 | 23 | 24 |
| Converting Agent Holding Delay Temperature, F. | 190-200 | 190-200 | 190-200 | 190-200 | 190-200 |
| Converting Agent Holding Delay Time, minutes | 30 | 30 | 30 | 30 | 30 |
| Alkali Metal Hydroxide Added | No | No | No | No | No |
| Worked Penetration | 272 | 257 | 281 | 278 | 279 |
| Dropping Point, F. | >650 | >650 | >650 | >650 | >650 |
| Four Ball EP, Weld Load, kg | ND | 500 | 500 | 500 | 620 |
| Four Ball Wear | 0.47 | 0.38 | 0.38 | 0.35 | 0.51 |
| Roll Stability at 25 C., 2 hrs: | | | | | |
| Initial worked Penetration | 285 | 263 | 271 | 265 | 287 |
| Final Worked Penetration | 291 | 266 | 277 | 281 | 311 |
| % Change | 2.1 | 1.1 | 2.2 | 6.0 | 8.4 |
| Dropping Pt after Test, F. | ND | >650 | ND | >650 | >650 |
| Roll Stability at 150 C., 2 hrs: | | | | | |
| Initial worked Penetration | 285 | 263 | 271 | 265 | 287 |
| Final Worked Penetration | 287 | 268 | 273 | 245 | 331 |
| % Change | 0.7 | 1.9 | 0.7 | −7.5 | 15.3 |
| Dropping Point after Test, F. | ND | >650 | >650 | >650 | 630 |

As can be seen, there are some small variations in thickener yield. This may be due to the different overbased magnesium sulfonates used since that was a significant difference in these five greases. However, overall the five greases all gave good thickener yield. Other test properties are also typically good. The one exception is the shear stability as indicated by the roll stability tests at 25 C and 150 C. The greases of Examples 23 and 24 (using overbased magnesium sulfonate D) appeared to be inferior to the others in these tests. This may also be due to some difference in overbased magnesium sulfonate D relative to the other overbased magnesium sulfonates.

The next six examples show some further variations on converting agent delay and split overbased magnesium sulfonate addition methods.

Example 25—(Magnesium Sulfonate Addition and Converting Agent Delay Method)

A calcium magnesium sulfonate complex grease identical to the grease of Example 23 was made to serve as a baseline for the next greases. Like the Example 23 grease, the ratio of overbased calcium sulfonate to overbased magnesium sulfonate was about 90/10. Similarly, a converting agent delay method was used. The split overbased magnesium sulfonate addition technique was not used. Instead, all the overbased magnesium sulfonate was added at the beginning before conversion began.

The grease was made as follows: 360.28 grams of 400 TBN overbased oil-soluble calcium sulfonate were added to an open mixing vessel followed by 489.74 grams of a solvent neutral group 1 paraffinic base oil having a viscosity of about 600 SUS at 100 F, and 15.58 grams of PAO having a viscosity of 4 cSt at 100 C. The 400 TBN overbased oil-soluble calcium sulfonate was a poor quality calcium sulfonate. Then 36.87 grams of the 400 TBN overbased magnesium sulfonate D was added. Mixing without heat began using a planetary mixing paddle. Then 36.50 grams of a primarily C12 alkylbenzene sulfonic acid were added. After mixing for 20 minutes, 69.40 grams of calcium hydroxyapatite with a mean particle size below 5 microns and 4.98 grams of food grade purity calcium hydroxide having a mean particle size below 5 microns were added and allowed to mix in for 30 minutes. Then 1.28 grams of glacial acetic acid and 14.38 grams of 12-hydroxystearic acid were added and allowed to mix in for 10 minutes. Then 75.25 grams of finely divided calcium carbonate with a mean particle size below 5 microns were added and allowed to mix in for 5 minutes. Then 58.06 grams water were added to the mixture. The mixture was heated until the temperature reached 190 F-200 F (a converting agent temperature adjustment delay). The batch was then mixed at this temperature range for 30 minutes (a converting agent holding delay). It was noted that the mixture appeared to be thickening during the 30 minute holding delay.

Then an additional 50 ml water was added to replace water lost due to evaporation. This was followed by the addition of 20.85 grams of hexylene glycol. Within only a few minutes the batch had thickened to the point where 178.57 grams of the same paraffinic base oil was added. The batch was then held between 190 F and 200 F for 45 minutes until Fourier Transform Infrared (FTIR) spectroscopy indicated that the conversion of the amorphous calcium carbonate to crystalline calcium carbonate (calcite) had occurred. During that time 30 ml water was added to replace water that was lost due to evaporation. Then 10.37 grams of the same calcium hydroxide were added and allowed to mix in for 10 minutes. Then 2.40 grams of glacial acetic acid were added followed by 37.35 grams of 12-hydroxystearic acid. The grease was mixed for 15 minutes until the 12-hydroxystearic acid melted and mixed into the grease. Then 12.75 grams of boric acid was mixed in 50 grams of hot water and the mixture was added to the grease. Then 24.38 grams of a 75% solution of phosphoric acid in water was added and allowed to mix in and react.

The mixture was then heated with an electric heating mantle while continuing to stir. When the grease reached 300 F, 30.39 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 45.46 grams of food grade anhydrous calcium sulfate having a mean particle size below 5 microns were added. When the batch was cooled to 170 F, 3.02 grams of an aryl amine antioxidant and 6.71 grams of a polyisobutylene polymer were added. Another 266.07 grams of the same paraffinic base oil were added. The grease was then removed from the mixer and given three passes through a three-roll mill to achieve a final smooth homogenous texture. The grease had a worked 60 stroke penetration of 265. The percent overbased oil-soluble calcium sulfonate in the final grease was 20.68%. The dropping point was >650 F.

Example 26—(Magnesium Sulfonate Split Addition and Converting Agent Delay Method)

Another grease was made similar to the previous Example 25 grease. The ratio of overbased calcium sulfonate to overbased magnesium sulfonate was about 90/10. Similarly, the delayed non-aqueous converting agent technique was used. The only significant difference between this grease and the previous Example 25 grease was a split overbased magnesium sulfonate addition method was used. Only 10% of the total overbased magnesium sulfonate was added at the beginning before conversion began. The initial ratio of overbased calcium sulfonate to overbased magnesium sulfonate was about 100/1. The remaining overbased magnesium sulfonate was added after the grease had reached its top temperature and cooled to below 250 F. The final milled grease had a worked 60 stroke penetration of 265. The percent overbased oil-soluble calcium sulfonate in the final grease was 20.19%. The dropping point was >650 F. As can be seen, the split overbased magnesium sulfonate addition technique provided little if any improvement in thickener yield in this grease compared to the baseline Example 25 grease.

Example 27—(Magnesium Sulfonate Addition and Converting Agent Delay Method)

A calcium magnesium sulfonate complex grease was made based on the calcium carbonate-based calcium sulfonate grease technology of the '265 patent. The ratio of overbased calcium sulfonate to overbased magnesium sulfonate was about 90/10. The converting agent delay method was also used. All the overbased magnesium sulfonate was added at the beginning.

The grease was made as follows: 310.14 grams of 400 TBN overbased oil-soluble calcium sulfonate were added to an open mixing vessel followed by 345.89 grams of a solvent neutral group 1 paraffinic base oil having a viscosity of about 600 SUS at 100 F. The 400 TBN overbased oil-soluble calcium sulfonate was a good quality calcium. Mixing without heat began using a planetary mixing paddle. Then 31.60 grams of overbased magnesium sulfonate A was added and allowed to mix in for 15 minutes. Then 31.20 grams of a primarily C12 alkylbenzene sulfonic acid were added. After mixing for 20 minutes, 75.12 grams of finely divided calcium carbonate with a mean particle size below 5 microns were added and allowed to mix in for 20 minutes. Then 0.84 grams of glacial acetic acid and 8.18 grams of 12-hydroxystearic acid were added. The mixture was stirred for 10 minutes. Then 40.08 grams water were added, and the mixture was heated with continued mixing to a temperature of 190 F to 200 F. This represents a temperature adjustment delay. The mixture was mixed at this temperature range for 30 minutes. This represents a holding delay. During that time, significant thickening had occurred, with a grease structure having formed.

Fourier Transform Infrared (FTIR) spectroscopy indicated that water was being lost due to evaporation. Another 70 ml water were added. FTIR spectroscopy also indicated that conversion had partially occurred even though no hexylene glycol (conventional non-aqueous converting agent) had yet been added. After the 30 minutes holding delay at 190 to 200 F, 15.76 grams of hexylene glycol were added. Shortly after this, FTIR spectroscopy indicating that the conversion of the amorphous calcium carbonate to crystalline calcium carbonate (calcite) had occurred. However, the batch seemed to soften somewhat after the glycol was added. Another 20 ml water were added followed by 2.57 grams of glacial acetic acid and 16.36 grams of 12-hydroxystearic acid. These two complexing acids were allowed to react for 10 minutes. Then 16.60 grams of a 75% solution of phosphoric acid in water were slowly added and allowed to mix in and react.

The grease was then heated to 390 to 400 F. As the mixture was heated, the grease continued to become increasingly thin and fluid. The heating mantle was removed from the mixer and the grease was allowed to cool while continuing to be mixed. The mixture was very thin and had no significant grease texture. When the temperature was below 170 F, a sample was removed from the mixer and given passes through a three-roll mill. The milled grease had an unworked penetration of 189. This result was extremely surprising and indicated that a very unusual and highly rheopectic structure had formed. Three more portions of the same base oil totaling 116.02 grams were added. The grease was then removed from the mixer and given three passes through a three-roll mill to achieve a final smooth homogenous texture. The grease had a worked 60 stroke penetration of 290. The percent overbased oil-soluble calcium sulfonate in the final grease was 31.96%. The dropping point was 617 F. Before milling, this Example 27 grease had an extremely fluid texture. This very unusual property could have multiple applications where a very fluid and pumpable lubricant is needed until it is delivered to the equipment to be lubricated. If either the equipment dispensing the lubricant to the equipment or the equipment itself (or both) can adequately shear the lubricant so as to simulate milling, then a firm grease could be generated. The advantage of such a lubricant is that it would have the pumpability and mobility of a fluid but the texture of a grease in the equipment to be lubricated.

Facilitating Acid Delay Examples

Example 28—(Facilitating Acid Delayed Addition; Magnesium Sulfonate Split Addition; Delayed Converting Agent Addition; Alkali Metal Hydroxide Addition)

A calcium magnesium sulfonate complex grease was using a facilitating acid delay method in combination with a magnesium sulfonate split addition method, delayed converting agent addition, and alkali metal hydroxide addition. This grease is similar to the grease in Example 16, except that a facilitating acid delay method was used. The ratio of the total amounts of overbased calcium sulfonate to overbased magnesium sulfonate was about 70/30, with the initial pre-conversion ratio of overbased magnesium sulfonate to overbased calcium sulfonate was about 90/10 using a split addition method. The second portion of overbased magnesium sulfonate was added after all the complexing acids had been added and had reacted, but just before heating the batch to its top temperature. After the DDBSA (facilitating acid) was added, the initial mixture was allowed to sit undisturbed for 16 hours before proceeding to the next step and addition of the next ingredient.

The grease was made as follows: 264.22 grams of 400 TBN overbased oil-soluble calcium sulfonate were added to an open mixing vessel followed by 348.81 grams of a solvent neutral group 1 paraffinic base oil having a viscosity of about 600 SUS at 100 F, and 11.14 grams of PAO having a viscosity of 4 cSt at 100 C. The 400 TBN overbased oil-soluble calcium sulfonate was a poor quality calcium sulfonate. Then 26.41 grams of a 400 TBN overbased magnesium sulfonate was added. This was the same overbased magnesium sulfonate used in the previous Example 16 grease, magnesium sulfonate "A." Mixing without heat began using a planetary mixing paddle. After 15 minutes, 26.79 grams of a primarily C12 alkylbenzene sulfonic acid were added. The batch was mixed for 30 minutes. Then mixing was stopped, and nothing further was done to the batch for 16 hours (a first facilitating acid holding delay. The next morning, mixing of the batch began. Then 50.60 grams of calcium hydroxyapatite with a mean particle size below 5 microns and 3.61 grams of food grade purity calcium hydroxide having a mean particle size below 5 microns were added and allowed to mix in for 30 minutes. Then 0.91 grams of glacial acetic acid and 10.68 grams of 12-hydroxystearic acid were added and allowed to mix in for 10 minutes. Then 55.04 grams of finely divided calcium carbonate with a mean particle size below 5 microns were added and allowed to mix in for 5 minutes.

Then 1.32 grams of lithium hydroxide monohydrate powder was dissolved in 42.25 grams water, and the solution was added to the batch. The mixture was heated until the temperature reached 190 F-200 F (a first converting agent temperature adjustment delay). The batch was mixed at this temperature for 30 minutes (a first converting agent holding delay period). Then, 30 ml water and 29.59 grams of hexylene glycol were added. After 25 minutes, the batch began to visibly thicken. During the next 45 minutes an additional 50 ml water was added to replace water lost due to evaporation. Fourier Transform Infrared (FTIR) spectroscopy then indicated that the conversion of the amorphous calcium carbonate to crystalline calcium carbonate (calcite) had occurred. A 7.46 gram portion of the same calcium hydroxide were added and allowed to mix in for about 10 minutes. Then 1.73 grams of glacial acetic acid were added followed by 27.06 grams of 12-hydroxystearic acid. The grease was mixed for 10 minutes until the 12-hydroxystearic acid melted and mixed into the grease. Then 9.36 grams of boric acid was mixed in 50 grams of hot water and the mixture was added to the grease. Another 70.03 grams of the same paraffinic base oil was added as the grease continued to become heavier. Then 17.66 grams of a 75% solution of phosphoric acid in water was added and allowed to mix in and react. Then another 86.77 grams of the same overbased magnesium sulfonate was added.

The mixture was then heated with an electric heating mantle while continuing to stir. When the grease reached 300 F, 22.60 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.00 grams of food grade anhydrous calcium sulfate having a mean particle size below 5 microns were added. When the batch was cooled to 170 F, 2.22 grams of an aryl amine antioxidant and 4.59 grams of a polyisobutylene polymer were added. Another 188.39 grams of the same paraffinic base oil were added. The grease was then removed from the mixer and given three passes through a three-roll mill to achieve a final smooth homogenous texture. The grease had a worked 60 stroke penetration of 283.

The percent overbased oil-soluble calcium sulfonate in the final grease was 20.32%. The dropping point was >650 F.

Example 29—(Facilitating Acid Delayed Addition; Magnesium Sulfonate Split Addition; Delayed Converting Agent Addition; Alkali Metal Hydroxide Addition)

Another grease was made similar to the previous Example 28 grease. The only significant difference was that the delay between the addition of the DDBSA and the addition of the next ingredient was 13 days. During that time, the batch remained covered and quiescent in the mixer at ambient laboratory temperature. The final milled grease had a worked 60 stroke penetration of 265. The percent overbased oil-soluble calcium sulfonate in the final grease was 19.37%. Using the customary inverse linear relationship between worked penetration and percent overbased calcium sulfonate concentration, this example grease would have had a percent overbased calcium sulfonate concentration of 18.7% if additional base oil had been added to bring the worked penetration to the same value as the previous Example 16 grease where a facilitating acid delay method was not used. The dropping point was 635 F. As can be seen, this extreme delay at ambient laboratory temperature (without any heating during that delay) resulted in a further improvement of thickener yield compared to the greases of Examples 16 and 28. The dropping point remained excellent.

Example 30—(Facilitating Acid Delayed Addition; and Delayed Converting Agent Addition)

To further examine a facilitating acid delay method, a calcium sulfonate complex grease made without any overbased magnesium sulfonate. This grease was made according to a composition taught in the '406 patent. A converting agent delayed method was also used. A 48 hour ambient temperature delay between the initial addition of the DDBSA and the subsequent addition of the next ingredient was used.

The grease was made as follows: 112.55 grams of 400 TBN overbased oil-soluble calcium sulfonate were added to an open mixing vessel followed by 180.95 grams of a solvent neutral group 1 paraffinic base oil having a viscosity of about 600 SUS at 100 F, and 10.15 grams of PAO having a viscosity of 4 cSt at 100 C. The 400 TBN overbased oil-soluble calcium sulfonate was a poor quality calcium sulfonate. Then 21.85 grams of a primarily C12 alkylbenzene sulfonic acid (a facilitating acid) were added. The batch was mixed for 30 minutes. Then mixing was stopped, and nothing further was done to the batch for 48 hours (a first facilitating acid holding delay period). After this delay, mixing of the batch began. Then 46.01 grams of calcium hydroxyapatite with a mean particle size below 5 microns and 3.62 grams of food grade purity calcium hydroxide having a mean particle size below 5 microns were added and allowed to mix in for 30 minutes. Then 0.99 grams of glacial acetic acid and 10.86 grams of 12-hydroxystearic acid were added and allowed to mix in for 15 minutes. Then 50.02 grams of finely divided calcium carbonate with a mean particle size below 5 microns were added and allowed to mix in for 5 minutes.

Then 30.0 grams water was added to the batch, and the mixture was heated until the temperature reached 190 F-200 F (a first converting agent temperature adjustment delay). The batch was mixed at this temperature for 30 minutes (a first converting agent holding delay). Then, 10 ml water and 12.30 grams of hexylene glycol were added. During the next 45 minutes six portions of water totaling 160 ml water was added to replace water lost due to evaporation. At the end of this period the temperature of the batch had increased to 240 F. Fourier Transform Infrared (FTIR) spectroscopy then indicated that the conversion of the amorphous calcium carbonate to crystalline calcium carbonate (calcite) had occurred. A 7.35 gram portion of the same calcium hydroxide were added and allowed to mix in for about 10 minutes. Then 1.25 grams of glacial acetic acid were added followed by 22.75 grams of 12-hydroxystearic acid. The grease was mixed for 15 minutes until the 12-hydroxystearic acid melted and mixed into the grease. Then 8.53 grams of boric acid was mixed in 40 ml of hot water and the mixture was added to the grease. Then 16.79 grams of a 75% solution of phosphoric acid in water was added and allowed to mix in and react.

Another 26.40 grams of the same paraffinic base oil was added due to the increased heaviness of the batch. The mixture was then heated with an electric heating mantle while continuing to stir. When the grease reached 300 F, 20.05 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 30.14 grams of food grade anhydrous calcium sulfate having a mean particle size below 5 microns were added. When the batch was cooled to 170 F, 2.40 grams of an aryl amine antioxidant and 5.01 grams of a polyisobutylene polymer were added. Another 149.99 grams of the same paraffinic base oil were added. The grease was then removed from the mixer and given three passes through a three-roll mill to achieve a final smooth homogenous texture. The grease had a worked 60 stroke penetration of 287. The percent overbased oil-soluble calcium sulfonate in the final grease was 15.21%. The dropping point was >650 F. It should be noted that this grease had a thickener yield that was significantly superior to any other grease described in the '265 or '406 patents or the '473 or '422 applications. Furthermore, there is no known calcium sulfonate grease described in any prior art made under open atmospheric pressure having a better thickener yield than that in this Example 29. Thus facilitating acid delay method provides an improvement in thickener yield.

Example 31—(Facilitating Acid Delayed Addition; Magnesium Sulfonate Split Addition; and Delayed Converting Agent Addition)

Another grease was made similar to Example 25, except that a split magnesium sulfonate addition method and a facilitating acid delay were used. The final ratio of overbased calcium sulfonate to overbased magnesium sulfonate was about 90/10. Only 10% of the total overbased magnesium sulfonate was added at the beginning before conversion began. The initial ratio (pre-conversion) of overbased calcium sulfonate to overbased magnesium sulfonate was about 100/1. In this example, after the initial paraffinic base oil, PAO, overbased calcium sulfonate, initial portion of the overbased magnesium sulfonate, and facilitating acid was added, the batch was heated to 190 F-200 F and held at that temperature range before proceeding to the next step.

The grease was made as follows: 360.72 grams of 400 TBN overbased oil-soluble calcium sulfonate were added to an open mixing vessel followed by 489.48 grams of a solvent neutral group 1 paraffinic base oil having a viscosity of about 600 SUS at 100 F, and 15.13 grams of PAO having a viscosity of 4 cSt at 100 C. The 400 TBN overbased oil-soluble calcium sulfonate was a poor quality calcium sulfonate. Then 3.80 grams of the 400 TBN overbased magnesium sulfonate D was added. Mixing without heat began using a planetary mixing paddle. Then 36.00 grams of a primarily C12 alkylbenzene sulfonic acid (a facilitating acid) were added. The mixture was heated until the temperature reached 190 F-200 F (a first facilitating acid temperature adjustment delay). The batch was mixed at this temperature for 30 minutes (a first facilitating acid holding delay). Then 69.61 grams of calcium hydroxyapatite with a mean particle size below 5 microns and 4.23 grams of food grade purity calcium hydroxide having a mean particle size below 5 microns were added and allowed to mix in for 30 minutes. Then 1.26 grams of glacial acetic acid and 14.40 grams of 12-hydroxystearic acid were added and allowed to mix in for 20 minutes. Then 75.70 grams of finely divided calcium carbonate with a mean particle size below 5 microns were added and allowed to mix in for 5 minutes.

Then 58.04 grams water were added to the mixture. The batch was then mixed at this temperature range for 30 minutes (a first converting agent holding delay period). This was followed by the addition of 20.47 grams of hexylene glycol. Within ten minutes the batch had begun to thicken. An additional 30 ml water was added to replace water lost due to evaporation. The batch was then held between 190 F and 200 F for 45 minutes until Fourier Transform Infrared (FTIR) spectroscopy indicated that the conversion of the amorphous calcium carbonate to crystalline calcium carbonate (calcite) had occurred. During that time 292.56 grams of the same paraffinic base oil was added as the batch continued to become increasingly heavy. Another 40 ml water and 10.02 grams of the same calcium hydroxide were added and allowed to mix in for 10 minutes. Then 2.34 grams of glacial acetic acid were added followed by 37.06 grams of 12-hydroxystearic acid. The grease was mixed for 10 minutes until the 12-hydroxystearic acid melted and mixed into the grease. Then 12.77 grams of boric acid was mixed in 50 grams of hot water and the mixture was added to the grease. Then 24.19 grams of a 75% solution of phosphoric acid in water was added and allowed to mix in and react. Another 70.71 grams of base oil was added due the increased heaviness of the grease.

The mixture was then heated with an electric heating mantle while continuing to stir. When the grease reached 300 F, 30.57 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 45.10 grams of food grade anhydrous calcium sulfate having a mean particle size below 5 microns were added. When the batch was cooled to 250 F, 32.20 grams of overbased magnesium sulfonate D was added. When the batch was cooled to 200 F, 3.24 grams of an aryl amine antioxidant and 6.56 grams of a polyisobutylene polymer were added. Another 111.01 grams of the same paraffinic base oil were added. The grease was then removed from the mixer and given three passes through a three-roll mill to achieve a final smooth homogenous texture. The grease had a worked 60 stroke penetration of 272. The percent overbased oil-soluble calcium sulfonate in the final grease was 20.38%. The dropping point was >650 F. As can be seen, the combination of delayed conventional non-aqueous converting agent method, the split overbased magnesium sulfonate addition method, and facilitating acid delay method provided little if any improvement in thickener yield in this grease compared to the baseline Example 7 grease.

Example 32—(Facilitating Acid Delayed Addition; Magnesium Sulfonate Split Addition; and Delayed Converting Agent Addition)

It should be noted that in the previous Example 31 grease, only a very small amount of overbased magnesium sulfonate was present at the beginning when conversion occurred. In order to determine if this is a factor in the final grease thickener yield, another grease was made. This grease was similar to the previous Example 25 grease in that it used the same techniques. However, there were several differences. First, half of the total overbased magnesium sulfonate (same as magnesium sulfonate from source D described above) was added at the beginning instead of only 10% of the total amount. This resulted in a much higher concentration of the overbased magnesium sulfonate in the grease as it was initially formed (although the total concentration in the final grease would be about the same). Second, the amount of 12-hydroxstearic acid was increased. Third, no phosphoric acid (post-conversion complexing acid) was used. Instead, the amount of boric acid (post-conversion complexing acid) was increased. Fourth, the amounts of calcium hydroxyapatite and added calcium hydroxide were increased so as to stoichiometrically compensate for the higher level of 12-hydroxystearic acid. Finally, the amount of anhydrous calcium sulfate was increased to equal the amount of added calcium carbonate.

The grease was made as follows: 360.27 grams of 400 TBN overbased oil-soluble calcium sulfonate were added to an open mixing vessel followed by 421.77 grams of a solvent neutral group 1 paraffinic base oil having a viscosity of about 600 SUS at 100 F, and 15.00 grams of PAO having a viscosity of 4 cSt at 100 C. The 400 TBN overbased oil-soluble calcium sulfonate was a poor quality calcium sulfonate. Then 18.15 grams of the 400 TBN overbased magnesium sulfonate D was added. Mixing without heat began using a planetary mixing paddle. Then 36.34 grams of a primarily C12 alkylbenzene sulfonic acid (a facilitating acid) were added. The mixture was stirred for 20 minutes and then heated until the temperature reached 190 F-200 F (a first facilitating acid temperature adjustment delay). The batch was mixed at this temperature for 30 minutes (a first facilitating acid holding delay period). Then 90.07 grams of calcium hydroxyapatite with a mean particle size below 5 microns and 6.44 grams of food grade purity calcium hydroxide having a mean particle size below 5 microns were added and allowed to mix in for 30 minutes. Then 1.28 grams of glacial acetic acid and 29.71 grams of 12-hydroxystearic acid were added and allowed to mix in for 20 minutes. Then 75.42 grams of finely divided calcium carbonate with a mean particle size below 5 microns were added and allowed to mix in for 5 minutes.

Then 57.25 grams water were added to the mixture. The batch was then mixed at this temperature range for 30 minutes (a first converting agent holding delay). This was followed by the addition of 20 ml water and 20.47 grams of hexylene glycol. The batch thickened to a grease in 25 minutes. The batch was then held between 190 F and 200 F for 45 minutes until Fourier Transform Infrared (FTIR) spectroscopy indicated that the conversion of the amorphous calcium carbonate to crystalline calcium carbonate (calcite) had occurred. During that time 128.75 grams of the same paraffinic base oil was added as the batch continued to become increasingly heavy. Another 30 ml water and 13.07 grams of the same calcium hydroxide were added and allowed to mix in for 10 minutes. Then 2.35 grams of glacial acetic acid were added followed by 75.23 grams of 12-hydroxystearic acid. The grease was mixed for 10 minutes until the 12-hydroxystearic acid melted and mixed into the grease. Another 124.19 grams of the same paraffinic base oil was added due to the grease continuing to become heavier. Then 24.00 grams of boric acid was mixed in 50 grams of hot water and the mixture was added to the grease. Another 61.67 grams of base oil was added.

The mixture was then heated with an electric heating mantle while continuing to stir. When the grease reached 300 F, 30.85 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 75.03 grams of food grade anhydrous calcium sulfate having a mean particle size below 5 microns were added. When the batch was cooled to 250 F, 18.14 grams of overbased magnesium sulfonate D was added. When the batch was cooled to 200 F, 3.16 grams of an aryl amine antioxidant and 6.62 grams of a polyisobutylene polymer were added. Another 277.05 grams of the same paraffinic base oil were added. The grease was then removed from the mixer and given three passes through a three-roll mill to achieve a final smooth homogenous texture. The grease had a worked 60 stroke penetration of 277. The percent overbased oil-soluble calcium sulfonate in the final grease was 18.83%. The dropping point was >650 F. As can be seen, this combination of delayed conventional non-aqueous converting agent method, the split overbased magnesium sulfonate addition method, and facilitating acid delay method provided significant improvement in thickener yield in this grease compared to the baseline Example 30 grease.

Example 33—(Facilitating Acid Delayed Addition; Magnesium Sulfonate Split Addition; and Delayed Converting Agent Addition)

Another grease was made similar to Example 32, with two significant differences. First, the total amount of 12-hydroxystearic acid was increased while keeping the pre-conversion amount added the same. Second, the amount of calcium hydroxyapatite was reduced and the post-conversion amount of added calcium hydroxide was increased. This was done so as to provide additional hydroxide basicity for the increased post-conversion 12-hydroxystearic acid. Also, the amount of calcium hydroxide equivalents from calcium hydroxyapatite relative to that from added calcium hydroxide was at a ratio of 18.5/81.5. In all previous examples, that ratio was 25/75.

The grease was made as follows: 360.28 grams of 400 TBN overbased oil-soluble calcium sulfonate were added to an open mixing vessel followed by 422.50 grams of a solvent neutral group 1 paraffinic base oil having a viscosity of about 600 SUS at 100 F, and 15.42 grams of PAO having a viscosity of 4 cSt at 100 C. The 400 TBN overbased oil-soluble calcium sulfonate was a poor quality calcium sulfonate. Then 18.39 grams of the 400 TBN overbased magnesium sulfonate D was added. Mixing without heat began using a planetary mixing paddle. Then 36.10 grams of a primarily C12 alkylbenzene sulfonic acid were added. The mixture stirred for 20 minutes and then was heated until the temperature reached 190 F-200 F (a first facilitating acid temperature adjustment delay period). The batch was mixed at this temperature for 30 minutes (a first facilitating acid holding delay period). Then 75.28 grams of calcium hydroxyapatite with a mean particle size below 5 microns and 6.46 grams of food grade purity calcium hydroxide having a mean particle size below 5 microns were added and allowed to mix in for 30 minutes. Then 1.29 grams of glacial acetic acid and 29.43 grams of 12-hydroxystearic acid were added and allowed to mix in for 20 minutes. Then 75.09 grams of finely divided calcium carbonate with a mean particle size below 5 microns were added and allowed to mix in for 5 minutes.

Then 57.28 grams water were added to the mixture. The batch was then mixed at this temperature range for 30 minutes (a first converting agent holding delay period). This was followed by the addition of 25 ml water and 19.93 grams of hexylene glycol. The batch thickened to a grease in 48 minutes. The batch was then held between 190 F and 200 F for 45 minutes until Fourier Transform Infrared (FTIR) spectroscopy indicated that the conversion of the amorphous calcium carbonate to crystalline calcium carbonate (calcite) had occurred. During that time 173.50 grams of the same paraffinic base oil and 55 ml water were added as the batch continued to become increasingly heavy. Another 20 ml water and 11.43 grams of the same calcium hydroxide were added and allowed to mix in for 10 minutes. Then 2.39 grams of glacial acetic acid were added followed by 105.55 grams of 12-hydroxystearic acid.

The grease was mixed for 20 minutes until the 12-hydroxystearic acid melted and mixed into the grease. During this time, another 302.29 grams of the same paraffinic base oil was added due to the grease continuing to become heavier. Then 24.04 grams of boric acid was mixed in 50 grams of hot water and the mixture was added to the grease. The mixture was then heated with an electric heating mantle while continuing to stir. When the grease reached 300 F, 30.00 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 96.02 grams of food grade anhydrous calcium sulfate having a mean particle size below 5 microns and another 20.90 grams of the same powdered calcium carbonate were added. When the batch was cooled to 250 F, 18.38 grams of overbased magnesium sulfonate D was added. When the batch was cooled to 200 F, 3.05 grams of an aryl amine antioxidant and 6.80 grams of a polyisobutylene polymer were added. Another 137.54 grams of the same paraffinic base oil were added. The grease was then removed from the mixer and given three passes through a three-roll mill to achieve a final smooth homogenous texture. The grease had a worked 60 stroke penetration of 272. The percent overbased oil-soluble calcium sulfonate in the final grease was 18.09%. The dropping point was >650 F. Once again, this combination of a facilitating acid delay method, a converting agent delay method, and a magnesium sulfonate split addition method provided significant improvement in thickener yield in this grease compared to the Example 25 grease, where no facilitating acid delay was used.

Example 34—(Facilitating Acid Delayed Addition; Magnesium Sulfonate Split Addition; and Delayed Converting Agent Addition)

Another grease was made similar to Example 33. The only significant difference was that the amount of post-conversion calcium hydroxide was increased so that the amount of calcium hydroxide equivalents from calcium hydroxyapatite relative to that from added calcium hydroxide was at a ratio of 10/90. The final milled grease had a worked 60 stroke penetration of 287. The percent overbased oil-soluble calcium sulfonate in the final grease was 17.35%. The dropping point was 633 F. Once again, this combination of a facilitating acid delay method, a converting agent delay method, and a magnesium sulfonate split addition method provided significant improvement in thickener yield in this grease compared to the Example 25 grease, where no facilitating acid delay was used.

Perhaps even more significant than the thickener yield improvement in this example is that the dropping point was excellent even though the amount of calcium hydroxide equivalents from calcium hydroxyapatite relative to that from added calcium hydroxide was at a ratio of 10/90 and a poor quality overbased calcium sulfonate was used. As described in the '406 patent, the added calcium hydroxide and/or calcium oxide are preferably present in an amounts such that the calcium hydroxyapatite contributes at least 25% of the total added hydroxide equivalents (from both calcium hydroxyapatite and added calcium hydroxide and/or added calcium oxide) in the greases described in the '406 patent, particularly when a poor quality overbased calcium sulfonate is used. If less than that amount of calcium hydroxyapatite is used, the dropping point of the final grease may suffer. However, with the addition of overbased magnesium sulfonate to the composition according to various embodiments of this invention, less calcium hydroxyapatite may be used while still maintaining sufficiently high dropping points. In the previous Example 33 grease, the calcium hydroxide equivalents from calcium hydroxyapatite was 18.5%. In this Example 34 grease, that value was only 10%. In both of these two greases, the dropping point was excellent. Thus the use of overbased magnesium sulfonate according to the invention of this document allows for a reduction in the amount of calcium hydroxyapatite used to provide an excellent dropping point, particularly when a poor quality calcium sulfonate is used.

TABLE 9

Summary of Examples 25, 31-34

| | Example | | | | |
|---|---|---|---|---|---|
| | 25 | 31 | 32 | 33 | 34 |
| % Overbased Calcium Sulfonate | 20.68 | 20.38 | 18.83 | 18.09 | 17.35 |
| Quality of Overbased Cal. Sulfonate | Poor | Poor | Poor | Poor | Poor |
| Source of Overbased Mag. Sulfonate | D | D | D | D | D |
| Split magnesium sulfonate Addition Used | No | Yes | Yes | Yes | Yes |
| % initial magnesium sulfonate added relative to total magnesium sulfonate | 100 | 10 | 50 | 50 | 50 |
| Ratio of Ca Sulfonate to Mg Sulfonate in Final Grease | 90/10 | 90/10 | 90/10 | 90/10 | 90/10 |
| Ratio of Ca Sulfonate to Mg Sulfonate in Pre-Conversion Grease | 90/10 | 100/1 | 20/1 | 20/1 | 20/1 |
| Facilitating acid delay Method Used | No | Yes | Yes | Yes | Yes |
| Converting Agent Delay Method Used | Yes | Yes | Yes | Yes | Yes |

TABLE 9-continued

Summary of Examples 25, 31-34

| | Example | | | | |
|---|---|---|---|---|---|
| | 25 | 31 | 32 | 33 | 34 |
| Converting Agent Holding Delay Temperature, F. | 190-200 | 190-200 | 190-200 | 190-200 | 190-200 |
| Converting Agent Holding Delay Time, minutes | 30 | 30 | 30 | 30 | 30 |
| Alkali Metal Hydroxide Added | No | No | No | No | No |
| Worked Penetration | 265 | 272 | 277 | 272 | 287 |
| Dropping Point, F. | >650 | >650 | >650 | >650 | 633 |

Example 32 (Facilitating Acid Delayed Addition; Magnesium Sulfonate Delayed Addition; and Delayed Converting Agent Addition)

Another grease was made similar to Example 27. Like the Example 27 grease, the ratio of overbased calcium sulfonate to overbased magnesium sulfonate was about 90/10, and all the overbased magnesium sulfonate was added before conversion, and the delayed conventional non-aqueous converting agent technique was used. However, there were several significant changes concerning other aspects of this grease compared to the Example 27 grease. The overbased magnesium sulfonate was added not at the very beginning, but after the primarily C12 alkylbenzene sulfonic acid (facilitating acid) was added and mixed in for an intentional 20 minute delay prior to adding magnesium sulfonate (a simultaneous facilitating acid delay period and magnesium sulfonate delay period). A second portion of powdered calcium carbonate was added after conversion but before the second portion of complexing acids was added. Also, this grease used a higher post-conversion level of 12-hydroxystearic acid. Finally, phosphoric acid was not used as a post-conversion complexing acid. Instead, boric acid was used.

The grease was made as follows: 310.79 grams of 400 TBN overbased oil-soluble calcium sulfonate were added to an open mixing vessel followed by 310.47 grams of a solvent neutral group 1 paraffinic base oil having a viscosity of about 600 SUS at 100 F. The 400 TBN overbased oil-soluble calcium sulfonate was a good quality calcium sulfonate. Mixing without heat began using a planetary mixing paddle. Then 31.53 grams of a primarily C12 alkylbenzene sulfonic acid were added and allowed to mix in for 20 minutes (a simultaneous facilitating acid delay and magnesium sulfonate delay period). Then 31.24 grams of overbased magnesium sulfonate A was added and allowed to mix in. After mixing for 20 minutes, 75.08 grams of finely divided calcium carbonate with a mean particle size below 5 microns were added and allowed to mix in for 20 minutes. Then 0.91 grams of glacial acetic acid and 8.09 grams of 12-hydroxystearic acid were added. The mixture was stirred for 10 minutes. Then 40.51 grams water were added, and the mixture was heated with continued mixing to a temperature of 190 F to 200 F (a first converting agent temperature adjustment delay period). The mixture was mixed at this temperature range for 30 minutes (a first converting agent holding delay period). During that time, significant thickening had occurred, with a grease structure having formed. Fourier Transform Infrared (FTIR) spectroscopy indicated that conversion had partially occurred even though no hexylene glycol (conventional non-aqueous converting agent) had yet been added.

After the 30 minutes holding delay at 190 to 200 F, 30 ml water and 15.50 grams of hexylene glycol were added. Shortly after this, FTIR spectroscopy indicating that the conversion of the amorphous calcium carbonate to crystalline calcium carbonate (calcite) had occurred. The batch was stirred for 45 minutes. During that time the batch did not soften but actually became somewhat harder. Another 40 ml water were added followed by another 25.02 grams of the same calcium carbonate. After mixing for 20 minutes, 1.57 grams of glacial acetic acid, 31.94 grams of 12-hydroxystearic acid, and 10 ml water were added. These two complexing acids were allowed to react for 10 minutes. Then 25.0 grams of boric acid in 50 ml of hot water were slowly added and allowed to mix in and react. The grease was then heated to 340 F. As the mixture was heated, the grease did not significantly soften. The heating mantle was removed from the mixer and the grease was allowed to cool while continuing to be mixed. The batch retained a grease texture as it was cooled. This was an obvious difference in behavior between this grease and the previous Example 27 grease. When the grease was cooled to 200 F, 2.20 grams of an aryl amine antioxidant was added. When the temperature was below 170 F, a sample was removed from the mixer and given passes through a three-roll mill. The milled grease had an unworked penetration of 219. Again, this result was extremely surprising when compared to the behavior of the previous Example 27 grease. Even though the previous Example 27 grease was very fluid at this point in the procedure, it milled to a much harder consistency. This indicates that the structure of this Example 35 grease is significantly less rheopectic than the structure of the Example 27 grease.

Four more portions of the same base oil totaling 133.53 grams were added. The grease was then removed from the mixer and given three passes through a three-roll mill to achieve a final smooth homogenous texture. The grease had a worked 60 stroke penetration of 283. The percent overbased oil-soluble calcium sulfonate in the final grease was 30.27%. The dropping point was >650 F. Using the customary inverse linear relationship between worked penetration and percent overbased calcium sulfonate concentration, this example grease would have had a percent overbased calcium sulfonate concentration of 29.5% if additional base oil had been added to bring the worked penetration to the same value as the previous Example 27 grease. As can be seen, this grease had an improved thickener yield compared to the previous grease. This shows yet another surprising and unexpected effect of using this embodiment of the delayed facilitating acid addition method (which is simultaneously a delayed magnesium sulfonate addition method). When the method of this example is used, a superior thickener yield is obtained. When this delayed addition method is not used (as in Example 27), the thickener yield is not as good, but a potentially useful extreme rheopectic property is imparted. Depending on the application that the grease is to be used in, either of these aspects could be useful. Thus the judicious use of the delay methods described within this application provide the grease formulator with performance possibilities not anticipated by anything within the prior art Example 36 (Facilitating Acid Delayed Addition; Magnesium Sulfonate Delayed Addition; and Delayed Converting Agent Addition)

Another grease was made similar to Example 27, with a few differences. First, this grease used a poor quality overbased calcium sulfonate. Second, the overbased magnesium sulfonate was intentionally not added until the initial base oil, overbased calcium sulfonate, and facilitating acid had been added and mixed for 20 minutes without any applied heat (a facilitating acid delay period and a magnesium sulfonate holding delay period). Although such a short period without heating would not be considered a delay with respect to a converting agent delay method, it is a delay with respect to a facilitating acid delay method and with respect to a magnesium sulfonate delay method. A magnesium sulfonate delay without heating may be shorter than 20 minutes, particularly if the previously added ingredient is an acid (a reactive ingredient as previously described), which will react with the overbased calcium sulfonate (or with the overbased calcium sulfonate and a previously added portion of magnesium sulfonate) without requiring any heating. Similarly, a facilitating acid delay without heating may be shorter than 20 minutes if the ingredient added after the facilitating acid is one that will react with the facilitating acid (such as the calcium sulfonate, magnesium sulfonate, or both). Third, this grease used a 16.52 gram addition of a 75% solution of phosphoric acid in water instead of the addition of boric acid in water.

The final milled Example 36 grease had a worked 60 stroke penetration of 293. The percent overbased oil-soluble calcium sulfonate in the final grease was 26.78%. However, the dropping point was 520 F. It should be noted that both this grease and the Example 27 grease had a composition that was essentially the same as the greases of Examples 6-9 of the '406 patent, as found therein in Table 1. Those four greases also used the same poor quality overbased calcium sulfonate. The dropping points of those four greases were 496, 483, 490, and 509; the average value was 495 F. Although the dropping point of this Example 36 grease was low, it was somewhat higher than those four greases from the '406 patent. This is consistent with the beneficial effect on dropping point that overbased magnesium sulfonates imparted in the greases of Examples 33 and 34. As summary of the Example 27, 35-36 greases is provided below in Table 10.

TABLE 10

Summary of Examples 27, 35-36

| | Example | | |
|---|---|---|---|
| | 27 | 35 | 36 |
| % Overbased Calcium Sulfonate | 31.96 | 30.27 | 26.78 |
| Quality of Overbased Cal. Sulfonate | Good | Good | Poor |
| Source of Overbased Mag. Sulfonate | A | A | A |
| Split magnesium sulfonate Addition Used | No | No | No |
| % initial magnesium sulfonate added relative to total magnesium sulfonate | 100 | 100 | 100 |
| Ratio of Ca Sulfonate to Mg Sulfonate in Final Grease | 90/10 | 90/10 | 90/10 |
| Facilitating acid delay Method Used | No | Yes | Yes |
| Ingredient Added After Facilitating acid Delay | N/A | Magnesium sulfonate | Magnesium sulfonate |
| Temp (F.) at which ingredient added after Facilitating acid Delay | N/A | 190-200 | 77 (ambient) |
| Converting Agent Delay Method Used | Yes | Yes | Yes |
| Converting Agent Holding Delay Temperature, F. | 190-200 | 190-200 | 190-200 |

TABLE 10-continued

Summary of Examples 27, 35-36

| | Example | | |
|---|---|---|---|
| | 27 | 35 | 36 |
| Converting Agent Holding Delay Time, minutes | 30 | 30 | 30 |
| Alkali Metal Hydroxide Added | No | No | No |
| Worked Penetration | 290 | 283 | 293 |
| Dropping Point, F. | 617 | >650 | 520 |

Example 37—(Facilitating Acid Delayed Addition; Magnesium Sulfonate Delayed Addition; and Delayed Converting Agent Addition)

Another grease was made similar to the previous Example 36 grease. The only significant difference was that 25.0 grams boric acid mixed in 50 ml hot water was added to the grease just before the phosphoric acid. This is the same amount of boric acid as was added when making the previous Example 13 grease. The final milled Example 37 grease had a worked 60 stroke penetration of 269. The percent overbased oil-soluble calcium sulfonate in the final grease was 29.55%. However, the dropping point was >650 F.

No Conventional Non-Aqueous Converting Agent Examples

Example 38

A grease was made similar to the previous Example 27 grease. Like the Example 27 grease, this grease had a ratio of overbased calcium sulfonate to overbased magnesium sulfonate that was about 90/10. All the overbased magnesium sulfonate was added at the beginning along with the overbased calcium sulfonate, before the facilitating acid was added. This Example 38 grease used the same good quality overbased calcium sulfonate as the Example 27 grease. The only significant difference between this grease and the Example 27 grease was that this grease did not have any conventional non-aqueous converting agent added. Water was added as the only conventional converting agent and additional water was added as required to replace any water lost due to evaporation during the conversion process. Conversion was monitored by FTIR spectra and took 2 hours to complete. The conversion took place due only to water, the overbased magnesium sulfonate, and any effects due to the initial amounts of the pre-conversion complexing acids that were added. As the grease was heated to its top temperature, it significantly softened in a manner similar to the Example 27 grease. The grease texture was recovered upon milling, just as was observed in the Example 27 grease. This extreme rheopectic property has the same potential utility as mentioned in Example 1.

Example 38

Another grease was made similar to previous Example 383 grease. The only significant difference was that a poor quality overbased calcium sulfonate was used. Conversion was monitored by FTIR spectra and took 7 hours to complete.

Example 40

Another grease was made similar to previous Example 39 grease. The only significant difference was that only about half the amount of overbased magnesium sulfonate was used. This grease used the same poor quality overbased calcium sulfonate as was used in previous examples of this document. Conversion was monitored by FTIR spectra and took 10.5 hours to complete. A summary of the Examples 38-40 greases are provided below in Table 11.

TABLE 11

Summary of Examples 38-40

| | Example | | |
|---|---|---|---|
| | 38 | 39 | 40 |
| % Overbased Calcium Sulfonate | 32.77 | 37.05 | 34.49 |
| % Overbased Magnesium Sulfonate | 3.47 | 3.72 | 1.68 |
| Quality of Calcium Sulfonate | Good | Poor | Poor |
| Ratio of Ca Sulfonate to Mg Sulfonate | 90/10 | 90/10 | 95/5 |
| Time to Conversion, hrs | 2 | 7 | 10.5 |
| Unworked Penetration | 280 | 289 | 267 |
| Worked Penetration | 292 | 295 | 295 |
| Dropping Point, F. | >650 | 558 | 562 |
| Four Ball EP, Weld Load, kg | 500 | 500 | ND |
| Four Ball Wear | 0.37 | 0.37 | 0.38 |
| Roll Stability at 25 C., 2 hrs: | | | |
| Initial worked Penetration | 269 | 295 | 295 |
| Final Worked Penetration | 267 | 317 | 303 |
| % Change | −0.7 | 7.5 | 2.7 |
| Dropping Pt After Test, F. | 633 | 520 | 522 |
| Roll Stability at 150 C., 2 hrs: | | | |
| Initial worked Penetration | 269 | 295 | 295 |
| Final Worked Penetration | 281 | 301 | 291 |
| % Change | 4.5 | 2 | −1.4 |
| Dropping Pt After Test, F. | >650 | 583 | 574 |

Except for the omission of a conventional non-aqueous converting agent and the addition of overbased magnesium sulfonate, the Example 38-40 greases had essentially the same composition as the greases of Examples 6-9 of the '406 patent (which used hexylene glycol and water as conventional converting agents). The Example 6-9 greases of the '406 patent used the same poor quality overbased calcium sulfonate as the Example 39 and 40 greases herein. The only compositional difference was that the Example 39-40 greases contained overbased magnesium sulfonate and did not include the hexylene glycol. Although the dropping points of the Example 39 and 40 greases (which contained the poor quality overbased calcium sulfonate) were rather low, they were much improved over the Examples 6-9 greases of the '406 patent (which also contained the same poor quality overbased calcium sulfonate and had dropping points ranging from 483 F-509 F). It appears that the addition of magnesium sulfonate acts as a converting agent, so that the addition of a conventional non-aqueous converting agent is not required. The conversion process did take much longer when poor instead of good quality overbased calcium sulfonate was used. However, the beneficial effect of the overbased magnesium sulfonate on conversion was apparent by comparing the required conversion times for Example 39 and 40. When the concentration of overbased magnesium sulfonate was significantly reduced, the conversion time significantly increased. This shows that the overbased magnesium sulfonate is having a positive effect on conversion. Also, the dropping point of both Example 39 and 40 greases improved after being sheared at 150 C, as indicated by the roll stability test data. This again shows the potential beneficial effect of overbased magnesium sulfonate on improving high temperature structural stability when used at higher temperatures.

Another important observation is made by comparing the dropping point of the Example 36 grease with the Example 39 and 40 greases. All three greases were compositionally similar. They all contained the same poor quality overbased calcium sulfonate and the same overbased magnesium sulfonate. They also contained the same complexing acids added in a similar way. There was only one significant compositional difference: the Example 36 grease contained a conventional non-aqueous converting agent (hexylene glycol) whereas the Example 39 and 40 greases did not. Yet, the dropping points of the Example 39 and 40 greases were significantly higher than that of the Example 36 grease. This demonstrates that when a calcium magnesium sulfonate complex grease is made without a conventional non-aqueous converting agent, a higher dropping point is possible compared to a similar grease made with a conventional non-aqueous converting agent. This result is a surprising and unexpected benefit of using overbased magnesium sulfonates in these greases, and it was not expected based on the teachings of the prior art.

Example 41

Another grease was made similar to the previous Example 38 grease. However, a significant difference was that a facilitating acid delay method was used. Specifically, the facilitating acid was added after the initial base oil portion and the overbased calcium sulfonate was added. The facilitating acid was allowed to mix with these components for 30 minutes at ambient temperature before adding the next reactive component—the overbased magnesium sulfonate (this is a simultaneous facilitating acid delay period and magnesium sulfonate delay period as described above). Also, a second amount of powdered calcium carbonate was added post-conversion and a higher amount of 12-hydroxystearic acid was added thereafter. Finally, this example was finished so that it was an NLGI No. 1 grade grease.

The grease was made as follows: 310.35 grams of 400 TBN overbased oil-soluble calcium sulfonate were added to an open mixing vessel followed by 345.38 grams of a solvent neutral group 1 paraffinic base oil having a viscosity of about 600 SUS at 100 F. The 400 TBN overbased oil-soluble calcium sulfonate was a good quality calcium sulfonate as defined by our recently issued U.S. Pat. No. 9,458,406. Mixing without heat began using a planetary mixing paddle. Then 31.03 grams of a primarily C12 alkylbenzene sulfonic acid were added. After mixing for 30 minutes, 31.18 grams of overbased magnesium sulfonate A was added and allowed to mix in for 15 minutes (a facilitating acid delay period and a magnesium sulfonate delay period). Then 75.25 grams of finely divided calcium carbonate with a mean particle size below 5 microns were added and allowed to mix in for 20 minutes. Then 0.87 grams of glacial acetic acid and 8.09 grams of 12-hydroxystearic acid were added. The mixture was stirred for 10 minutes. Then 40.0 grams water were added, and the mixture was heated with continued mixing to a temperature of 190 F to 200 F. As the mixture reached 181 F it was showing visible signs of thickening. After one hour and 30 minutes, FTIR spectroscopy indicated that the conversion of the amorphous calcium carbonate to crystalline calcium carbonate had occurred. During that time, two 40 ml portions of water were added to replace water lost due to evaporation.

Another 25.05 grams of the same powdered calcium carbonate were added and allowed to mix for 20 minutes.

Then 1.53 grams of glacial acetic acid and 41.97 grams of 12-hydroxystearic acid were added. These two complexing acids were allowed to react for 30 minutes. Then 16.90 grams of a 75% solution of phosphoric acid in water were slowly added and allowed to mix in and react. The grease was then heated to 340 F. The grease retained its grease consistency during the heating to top temperature. The heating mantle was removed from the mixer and the grease was allowed to cool while continuing to be mixed. When the temperature was below 170 F, a sample was removed from the mixer and given three passes through a three-roll mill. The milled grease had an unworked penetration of 192. Three more portions of the same paraffinic base oil totaling 125.29 grams were added. The grease was then removed from the mixer and given three passes through a three-roll mill to achieve a final smooth homogenous texture. The grease had a worked 60 stroke penetration of 326, an NLGI No. 1 grade product. The percent overbased oil-soluble calcium sulfonate in the final grease was 30.64%. The dropping point was 619 F.

Example 42

Another grease was made similar to the previous Example 41 grease. Like the previous Examples, this calcium sulfonate complex grease was made based on the calcium carbonate-based calcium sulfonate grease technology of the '265 patent. Like the previous Example 41 grease, the ratio of overbased calcium sulfonate to overbased magnesium sulfonate was about 90/10. Also, a facilitating acid delay method was used. Specifically, the facilitating acid was added after the initial base oil portion and the overbased calcium sulfonate was added. The facilitating acid was allowed to mix with these components for 30 minutes at ambient temperature before adding the next reactive component—the overbased magnesium sulfonate. All the overbased magnesium sulfonate was added at that time. The only significant differences between this grease and the previous Example 41 grease were as follows: this grease had a higher total amount of the powdered calcium carbonate added with equal portions added before and after conversion; a higher amount of 12-hydroxystearic acid was added after conversion; powdered anhydrous calcium sulfate was added after the grease had been heated to top temperature; and the batch size was increased to allow better mixing during the early part of the batch.

The grease was made as follows: 372.10 grams of 400 TBN overbased oil-soluble calcium sulfonate were added to an open mixing vessel followed by 316.03 grams of a solvent neutral group 1 paraffinic base oil having a viscosity of about 600 SUS at 100 F. The 400 TBN overbased oil-soluble calcium sulfonate was a good quality calcium sulfonate as defined in the '406 patent. Mixing without heat began using a planetary mixing paddle. Then 37.47 grams of a primarily C12 alkylbenzene sulfonic acid were added. After mixing for 30 minutes, 37.29 grams of overbased magnesium sulfonate A (the same commercial source used in several examples described above) was added and allowed to mix in for 15 minutes. This represents a facilitating acid delay period and a magnesium sulfonate delay period. Then 90.11 grams of finely divided calcium carbonate with a mean particle size below 5 microns were added and allowed to mix in for 20 minutes. Then 1.01 grams of glacial acetic acid and 9.25 grams of 12-hydroxystearic acid were added. The mixture was stirred for 10 minutes. Then 48.14 grams water were added, and the mixture was heated with continued mixing to a temperature of 190 F to 200 F. As the mixture reached 170 F it was showing visible signs of thickening. After one hour and 30 minutes, FTIR spectroscopy indicated that the conversion of the amorphous calcium carbonate to crystalline calcium carbonate had occurred. During that time, two 30 ml portions of water were added to replace water lost due to evaporation. Also, another 19.70 grams of the same paraffinic base oil was added due to the increasing thickness of the grease.

After conversion was considered complete, another 90.17 grams of the same powdered calcium carbonate were added and allowed to mix for 20 minutes. Then 1.88 grams of glacial acetic acid and 86.75 grams of 12-hydroxystearic acid were added. These two complexing acids were allowed to react for 30 minutes. Another 39.87 grams of the same paraffinic base oil was added. Then 19.89 grams of a 75% solution of phosphoric acid in water were slowly added and allowed to mix in and react. The grease was then heated to 340 F. The grease retained its grease consistency during the heating to top temperature. The heating mantle was removed from the mixer and the grease was allowed to cool while continuing to be mixed. When the grease had cooled to below 300 F, 60.14 grams of food grade anhydrous calcium sulfate having a mean particle size below 5 microns were added. When the temperature was below 170 F, a sample was removed from the mixer and given three passes through a three-roll mill. The milled grease had an unworked penetration of 189. Six more portions of the same paraffinic base oil totaling 244.17 grams were added. The grease was then removed from the mixer and given three passes through a three-roll mill to achieve a final smooth homogenous texture. The grease had a worked 60 stroke penetration of 256. The percent overbased oil-soluble calcium sulfonate in the final grease was 26.10%. Using the customary inverse linear relationship between worked penetration and percent overbased calcium sulfonate concentration, this example grease would have had a percent overbased calcium sulfonate concentration of 23.9% if additional base oil had been added to bring the worked penetration to a value of 280 (the center of the NLGI No. 2 grade range). The dropping point was 646 F. It should be noted that this Example 42 grease had a thickener yield that was superior to any other calcium carbonate-based calcium magnesium sulfonate complex grease described in the above examples, where a conventional non-aqueous converting agent was used. Furthermore, this Example 42 grease had a thickener yield that was superior to any grease described in the '265 patent. This excellent thickener yield was obtained while maintaining a very high dropping point. This shows the surprising and unexpected benefit of using an overbased magnesium sulfonate without any conventional non-aqueous converting agent when making a calcium magnesium sulfonate complex greases.

A series of six grease examples were prepared to examine the ability of overbased magnesium sulfonate to act as a new, non-conventional converting agent in place of a conventional non-aqueous converting agents when making calcium magnesium sulfonate greases with added calcium hydroxyapatite as a calcium containing base for reacting with complexing acids.

Example 43

A grease similar to Example 38 grease was made. The only significant difference was that a portion of calcium hydroxyapatite was added after the initial portion of base oil, the overbased calcium and magnesium sulfonates, and the facilitating acid. None of the preferred delay methods were used in making this grease. Also, the weight/weight ratio of overbased calcium sulfonate to overbased magnesium sulfonate was about 90/10.

The grease was made as follows: 310.06 grams of 400 TBN overbased oil-soluble calcium sulfonate and 31.16 grams of overbased magnesium sulfonate A were added to an open mixing vessel followed by 345.96 grams of a solvent neutral group 1 paraffinic base oil having a viscosity of about 600 SUS at 100 F. The 400 TBN overbased oil-soluble calcium sulfonate was a good quality calcium sulfonate according to the '406 patent. Mixing without heat began using a planetary mixing paddle. Then 31.14 grams of a primarily C12 alkylbenzene sulfonic acid were added. After mixing for 20 minutes, 10.02 grams of calcium hydroxyapatite with a mean particle size below 5 microns were added and allowed to mix in for 5 minutes. Then 75.08 grams of finely divided calcium carbonate with a mean particle size below 5 microns were added and allowed to mix in for 20 minutes. Then 0.91 grams of glacial acetic acid and 8.12 grams of 12-hydroxystearic acid were added. The mixture was stirred for 10 minutes. Then 40.15 grams water (as the only conventional converting agent added) were added, and the mixture was heated with continued mixing to a temperature of 190 F to 200 F. As the mixture reached 190 F it was showing visible signs of thickening. After one hour and 40 minutes, FTIR spectroscopy indicated that the conversion of the amorphous calcium carbonate to crystalline calcium carbonate had occurred. During that time, two 20 ml portions of water were added to replace water lost due to evaporation.

Then 1.42 grams of glacial acetic acid and 17.40 grams of 12-hydroxystearic acid were added. These two complexing acids were allowed to react for 30 minutes. Then 17.07 grams of a 75% solution of phosphoric acid in water were slowly added and allowed to mix in and react. The grease was then heated to 390-400 F. The grease lost nearly all its grease consistency as it began to be heated to the top temperature. This thinned out texture was retained until the grease was milled. This is similar to the behavior observed in the both the Example 27 grease (which used a conventional non-aqueous converting agent) and the Example 38 grease (which did not use a conventional non-aqueous converting agent). The heating mantle was removed from the mixer and the grease was allowed to cool while continuing to be mixed. When the temperature was below 170 F, a sample was removed from the mixer and given three passes through a three-roll mill. The milled grease had an unworked penetration of 189. Two more portions of the same paraffinic base oil totaling 100.54 grams were added. The grease was then removed from the mixer and given three passes through a three-roll mill to achieve a final smooth homogenous texture. The grease had a worked 60 stroke penetration of 273. The percent overbased oil-soluble calcium sulfonate in the final grease was 32.68%. The dropping point was 614 F. It should be noted that in this grease, like the Example 27 and 38 greases, the magnesium sulfonate was added at the beginning prior to adding the facilitating acid. This allowed the facilitating acid to mix and react with both the calcium sulfonate and magnesium sulfonate. Interestingly, all these greases also exhibited marked thinning out as they were heated to top temperature, and they recovered their grease consistency only when milled.

Example 44

Another grease was made similar to the previous Example 43 grease. There were only two significant differences: first, the amount of calcium hydroxyapatite was essentially doubled, being increased from 10.02 grams to 20.62; second, the grease was heated to a top temperature of 340 F instead of 390-400 F. It was observed that this grease visibly converted to a grease much more quickly than the Example 43 grease. Also, this grease did not begin to thin out until it reached 330 F, and it thinned out significantly less during the rest of the process compared to the Example 43 grease. The final milled grease had a worked 60 stroke penetration of 291. The percent overbased oil-soluble calcium sulfonate in the final grease was 29.65%. The dropping point was 622 F.

Example 45

Another grease was made similar to the previous Example 44 grease. The only significant difference was that the amount of calcium hydroxyapatite was again nearly doubled, being increased from 20.62 grams to 40.12 grams. It was observed that this grease visibly converted to a grease almost as soon as it reached 190 F. Also, this grease did not thin out as much as the previous two greases when it was heated to 340 F. Although it softened somewhat, it retained a distinct grease structure. The final milled grease had a worked 60 stroke penetration of 285. The percent overbased oil-soluble calcium sulfonate in the final grease was 30.43%. The dropping point was 621 F.

Example 46

Another grease was made similar to the previous Example 45 grease. The only significant difference was that the amount of overbased magnesium sulfonate was cut in half. The weight/weight ratio of overbased calcium sulfonate to overbased magnesium sulfonate was about 95/5. It was observed that conversion to a grease took much longer for this Example compared to the previous Example. This grease required about 30 minutes of mixing at 190-200 F to visibly convert to a grease. However, this grease retained its grease structure all the way through the process of making it. The final milled grease had a worked 60 stroke penetration of 289. The percent overbased oil-soluble calcium sulfonate in the final grease was 29.69%. The dropping point was 635 F. By comparing the results of the Example 43-46 greases it appears that once again the overbased magnesium sulfonate is acting as a new, non-conventional converting agent and that the use of a conventional non-aqueous converting agent is not needed. When the magnesium sulfonate concentration was significantly reduced (Example 46 compared to Example 45) conversion took significantly longer. Also, it appears that the presence of calcium hydroxyapatite added before conversion has an effect of reducing the thinning out effect that otherwise occurs when such calcium-magnesium sulfonate greases are made.

The next two example greases explore what happens when a delayed magnesium sulfonate addition method is used in a grease that also used calcium hydroxyapatite and omitted any conventional non-aqueous converting agent.

Example 47

A grease was made similar to the previous Example 46 grease. The only significant difference was that the overbased magnesium sulfonate was not added until the unconverted mixture had been heated to 190-200 F (a magnesium sulfonate temperature adjustment delay period) and held at that temperature for 30 minutes (a magnesium sulfonate holding delay period).

The grease was made as follows: 310.09 grams of 400 TBN overbased oil-soluble calcium sulfonate was added to an open mixing vessel followed by 340.03 grams of a solvent neutral group 1 paraffinic base oil having a viscosity of about 600 SUS at 100 F. The 400 TBN overbased oil-soluble calcium sulfonate was a good quality calcium sulfonate as defined in the '406 patent. Mixing without heat began using a planetary mixing paddle. Then 31.10 grams of a primarily C12 alkylbenzene sulfonic acid were added. After mixing for 20 minutes, 40.16 grams of calcium hydroxyapatite with a mean particle size below 5 microns were added and allowed to mix in for 5 minutes. It should be noted that the 20 mixing delay without heat between the addition of a facilitating acid and the next ingredient in this example and Examples 43-46 do not constitute a facilitating acid delay method as described herein. This is because the next ingredient added after the facilitating acid is calcium hydroxyapatite, which is not significantly reactive towards the facilitating acid, as shown in the '406 patent. Then 75.23 grams of finely divided calcium carbonate with a mean particle size below 5 microns were added and allowed to mix in for 20 minutes. Then 0.89 grams of glacial acetic acid and 8.11 grams of 12-hydroxystearic acid were added. The mixture was stirred for 10 minutes. Then 40.45 grams water were added, and the mixture was heated with continued mixing to a temperature of 190 F to 200 F. The mixture was held at that temperature range for 30 minutes during which time it began to thicken to a grease. During the 30 minutes, another 40.2 grams water was added to replace water lost due to evaporation. After the 30 minutes, 16.21 grams of overbased magnesium sulfonate A was added.

After one hour, FTIR spectroscopy indicated that the conversion of the amorphous calcium carbonate to crystalline calcium carbonate had occurred. During that time, two 40 ml portions of water were added to replace water lost due to evaporation. Then 1.53 grams of glacial acetic acid and 16.41 grams of 12-hydroxystearic acid were added. These two complexing acids were allowed to react for 30 minutes. During that time another 49.50 grams of the same paraffinic base oil was added as the grease continued to thicken. Towards the end of the 30 minutes of mixing, the temperature of the grease increased to about 240 F, The heating mantle was removed and the batch was allowed to cool to 200 F. Then 17.28 grams of a 75% solution of phosphoric acid in water were slowly added and allowed to mix in and react. The grease was then heated to 340 F. The grease retained all its grease consistency during the entire heating process. The heating mantle was removed from the mixer and the grease was allowed to cool while continuing to be mixed. When the temperature was below 160 F, three more portions of the same paraffinic base oil totaling 132.07 grams were added. The grease was then removed from the mixer and given three passes through a three-roll mill to achieve a final smooth homogenous texture. The grease had a worked 60 stroke penetration of 287. The percent overbased oil-soluble calcium sulfonate in the final grease was 29.86%. The dropping point was >650 F.

Example 48

Another grease was made similar to the previous Example 47 grease. However, there were several important differences. After the initial base oil, overbased calcium sulfonate, and facilitating acid were added and mixed, heating to 190-200 F began (since the mixture was heated, this is a facilitating acid temperature adjustment delay). Only when this temperature range was reached were the calcium hydroxyapatite and powdered calcium carbonate added and allowed to mix for 30 minutes. Then the initial portions of 12-hydroxystearic acid and acetic acid were added and allowed to react in the normal expected way for 30 minutes before adding the water. Once the water was added, there was another 3 hour and 40 minute delay before adding the overbased magnesium sulfonate (a magnesium sulfonate delayed period). Since the calcium hydroxyapatite and powdered calcium carbonate would likely not react significantly with the facilitating acid (given what has been previously disclosed in the '406 patent), there would be additional facilitating acid delay holding delay periods after the facilitating acid temperature adjustment delay until the overbased magnesium sulfonate was added (as the next added ingredient that is reactive with the facilitating acid). This Example 48 grease also differed from the previous Example 47 grease in that after conversion was complete, some powdered calcium hydroxide was added. The post-conversion amount of 12-hydroxystearic acid was increased, and boric acid was added as a post-conversion complexing acid. Finally, anhydrous calcium sulfate and a small amount of an antioxidant were added as the grease was cooled down from its top temperature.

The grease was made as follows: 310.02 grams of 400 TBN overbased oil-soluble calcium sulfonate was added to an open mixing vessel followed by 345.83 grams of a solvent neutral group 1 paraffinic base oil having a viscosity of about 600 SUS at 100 F. The 400 TBN overbased oil-soluble calcium sulfonate was a good quality calcium sulfonate as defined in the '406 patent. Mixing without heat began using a planetary mixing paddle. Then 31.04 grams of a primarily C12 alkylbenzene sulfonic acid were added. The mixture was then heated to 190-200 F (a facilitating acid temperature adjustment delay period). Once this temperature range was reached, 40.23 grams of calcium hydroxyapatite with a mean particle size below 5 microns were added followed by 75.04 grams of finely divided calcium carbonate with a mean particle size below 5 microns were added and allowed to mix in for 30 minutes. Then 0.88 grams of glacial acetic acid and 8.10 grams of 12-hydroxystearic acid were added. The mixture was stirred for 30 minutes to allow reaction of the two complexing acids. Then 40.26 grams water were added, and the mixing continued at the 190-200 F temperature range. After one hour of mixing, the batch began to visibly change to a grease. The mixture was stirred for another 2 hours and 40 minutes during which time four portions of 40 ml water was added to replace water lost due to evaporation. During this time FTIR spectroscopy indicated that partial conversion of the amorphous calcium carbonate had occurred. Then 16.12 grams of overbased magnesium sulfonate A was added. This represents a 3 hour and 40 minute magnesium sulfonate delayed addition method relative to the first addition of water. It also represents a facilitating acid delay since there was a facilitating acid temperature adjustment delay and several holding delays between the facilitating acid temperature adjustment delay period and the addition of the magnesium sulfonate (the next added ingredient that is reactive with the facilitating acid).

Once the overbased magnesium sulfonate was added, FTIR spectroscopy indicated that the conversion of the amorphous calcium carbonate to crystalline calcium carbonate was completed within 30 minutes. Then 11.02 grams of food grade purity calcium hydroxide having a mean particle size below 5 microns was added and allowed to mix in for 15 minutes. Then 1.54 grams of glacial acetic acid and 31.30 grams of 12-hydroxystearic acid were added. These two complexing acids were allowed to react for 30 minutes. During that time another 46.92 grams of the same paraffinic base oil was added as the grease continued to thicken. Then 16.00 grams of boric acid mixed in 50 ml of hot water was added and allowed to mix in for 15 minutes. Then 17.50 grams of a 75% solution of phosphoric acid in water were slowly added and allowed to mix in and react. The grease was then heated to 340 F. The grease retained all its grease consistency during the entire heating process. The heating mantle was removed from the mixer and the grease was allowed to cool while continuing to be mixed. When the grease had cooled to below 300 F, 40.06 grams of food grade anhydrous calcium sulfate having a mean particle size below 5 microns were added. When the grease was cooled to 250 F, 2.21 grams of an aryl amine antioxidant were added. Once the grease was cooled to 170 F, four more additions of the same paraffinic base oil totaling 131.86 grams were added. After additional mixing, the grease was removed from the mixer and given three passes through a three-roll mill to achieve a final smooth homogenous texture. The grease had a worked 60 stroke penetration of 283. The percent overbased oil-soluble calcium sulfonate in the final grease was 27.36%. The dropping point was >650 F.

Although the examples provided herein fall primarily in the NLGI No. 1, No. 2, or No. 3 grade, with No. 2 grade being the most preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base oil had been used so as to provide a No. 2 grade product, as will be understood by those of ordinary skill in the art.

While this invention deals primarily with greases made in open vessels, and the examples are all in open vessels, the complex calcium magnesium sulfonate grease compositions and methods may also be used in closed vessels where heating under pressure is accomplished. The use of such pressurized vessels may result in even better thickener yields than those described in the examples herein. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art.

As used herein: (1) quantities of dispersed calcium carbonate (or amorphous calcium carbonate) or residual calcium oxide or calcium hydroxide contained in the overbased calcium sulfonate are by weight of the overbased calcium sulfonate; (2) some ingredients are added in two or more separate portions and each portion may be described as a percentage of the total amount for that ingredient or a percentage of final grease by weight; and (3) all other amounts (including total amounts) of ingredients identified by percentages or parts are the amounts added as an ingredient by weight of the final grease product, even though the particular ingredient (such as water, or calcium-containing bases or alkali metal hydroxides that react with other ingredients) may not be present in the final grease or may not be present in the final grease in the quantity identified for addition as an ingredient. As used herein "added calcium carbonate" means crystalline calcium carbonate that is added as a separate ingredient in addition to the amount of dispersed calcium carbonate contained in the overbased calcium sulfonate. As used herein "added calcium hydroxide" and "added calcium oxide" means calcium hydroxide and calcium oxide, respectively, that are added as a separate ingredient in addition to the amount of residual calcium hydroxide and/or calcium oxide that may be contained in the overbased calcium sulfonate. As used herein to describe the invention (as opposed to how the term is used in some prior art references), calcium hydroxyapatite means (1) the compound having the formula $Ca_5(PO_4)_3OH$ or (2) a mathematically equivalent formula (a) having a melting point of around 1100 C or (b) specifically excluding mixtures of tricalcium phosphate and calcium hydroxide by such equivalent formula.

As used herein, the term "thickener yield" as it applies to the subject invention shall be the conventional meaning, namely, the concentration of the highly overbased oil-soluble calcium sulfonate required to provide a grease with a specific desired consistency as measured by the standard penetration tests ASTM D217 or D1403 commonly used in lubricating grease manufacturing. In like manner, as used herein the "dropping point" of a grease shall refer to the value obtained by using the standard dropping point test ASTM D2265 as commonly used in lubricating grease manufacturing. Four Ball EP tests as described herein shall refer to ASTM D2596. Four Ball Wear tests as described herein shall refer to ASTM D2266. Cone Oil Separation tests as described herein shall refer to ASTM D6184. Roll Stability tests as described herein shall refer to ASTM D1831. As used herein, "non-aqueous converting agent" means any converting agent other than water and includes converting agents that may contain some water as a diluent or an impurity. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

We claim:

1. A sulfonate-based grease composition comprising the following ingredients: (1) overbased calcium sulfonate; (2) overbased magnesium sulfonate; (3) water as a converting agent; (4) optionally one or more complexing acids; and (5) optionally a base oil.

2. The sulfonate-based grease composition of claim 1 wherein the composition comprises 10-22% overbased calcium sulfonate and 0.1-10% overbased magnesium sulfonate as ingredients by weight of the final grease.

3. The sulfonate-based grease composition of claim 1 wherein water is the sole conventional converting agent that is not also a complexing acid.

4. The sulfonate-based grease composition of claim 1 further comprising an alkali metal hydroxide.

5. The sulfonate-based grease composition of claim 1 wherein no conventional non-aqueous converting agents are included.

* * * * *